US005890238A

United States Patent [19]

Votel

[11] Patent Number: 5,890,238

[45] Date of Patent: Apr. 6, 1999

[54] PATIENT TRANSFER SYSTEMS

[75] Inventor: Thomas W. Votel, St. Paul, Minn.

[73] Assignee: Ergodyne Corporation, St. Paul, Minn.

[21] Appl. No.: 713,412

[22] Filed: Sep. 13, 1996

Related U.S. Application Data

[63] Continuation-in-part of Ser. No. 527,519, Sep. 13, 1995.

[60] Provisional application No. 60/023,572, Aug. 19, 1996 and provisional application No. 60/025,084, Aug. 30, 1996.

[51] Int. Cl.[6] ..... A61G 7/10

[52] U.S. Cl. ..... 5/81.1 HS; 5/81.1 R; 5/84.1; 5/88.1; 24/498; 24/460; 24/265 EC

[58] Field of Search ..... 5/81.1 HS, 81.1 R, 5/83.1, 84.1, 86.1, 88.1, 89.1, 81.1 C; 24/265 EC, 460, 462

[56] References Cited

U.S. PATENT DOCUMENTS

| | | | |
|---|---|---|---|
| 4,747,170 | 5/1988 | Knouse | 5/81.1 HS |
| 4,776,047 | 10/1988 | DiMatteo | 5/88.1 X |
| 4,850,562 | 7/1989 | Mazzanti | 24/460 X |
| 5,005,232 | 4/1991 | Wright et al. | 5/83.1 |
| 5,319,813 | 6/1994 | DiMatteo et al. | 5/83.1 X |
| 5,428,851 | 7/1995 | Shore et al. | 5/81.1 R X |
| 5,539,941 | 7/1996 | Fuller | 5/88.1 X |

FOREIGN PATENT DOCUMENTS

| | | | |
|---|---|---|---|
| 2068850 | 1/1981 | United Kingdom | 5/86.1 |

*Primary Examiner*—Kenneth J. Dorner
*Assistant Examiner*—Robert G. Santos
*Attorney, Agent, or Firm*—Patterson & Keough, P.A.

[57] ABSTRACT

The invention includes several devices for readily transferring patients from one platform to another by one attendant. A first system of horizontal transfer of patients is adapted to use existing transfer sheets and cart appropriately modified. A transfer sheet is attached to a clamping device that has a releasable catch that holds the sheet in a cavity. A plurality of straps are attached to the clamping device. The other ends of the straps are attached to reels that are part of a winch. Activation of the winch winds the straps onto the reels. The invention also includes improved bed jackets that can be attached to a winch for lifting a patient either to re-position them on a surface or to transport them. The invention also includes devices with very low friction surfaces to assist with the transfer process.

17 Claims, 33 Drawing Sheets

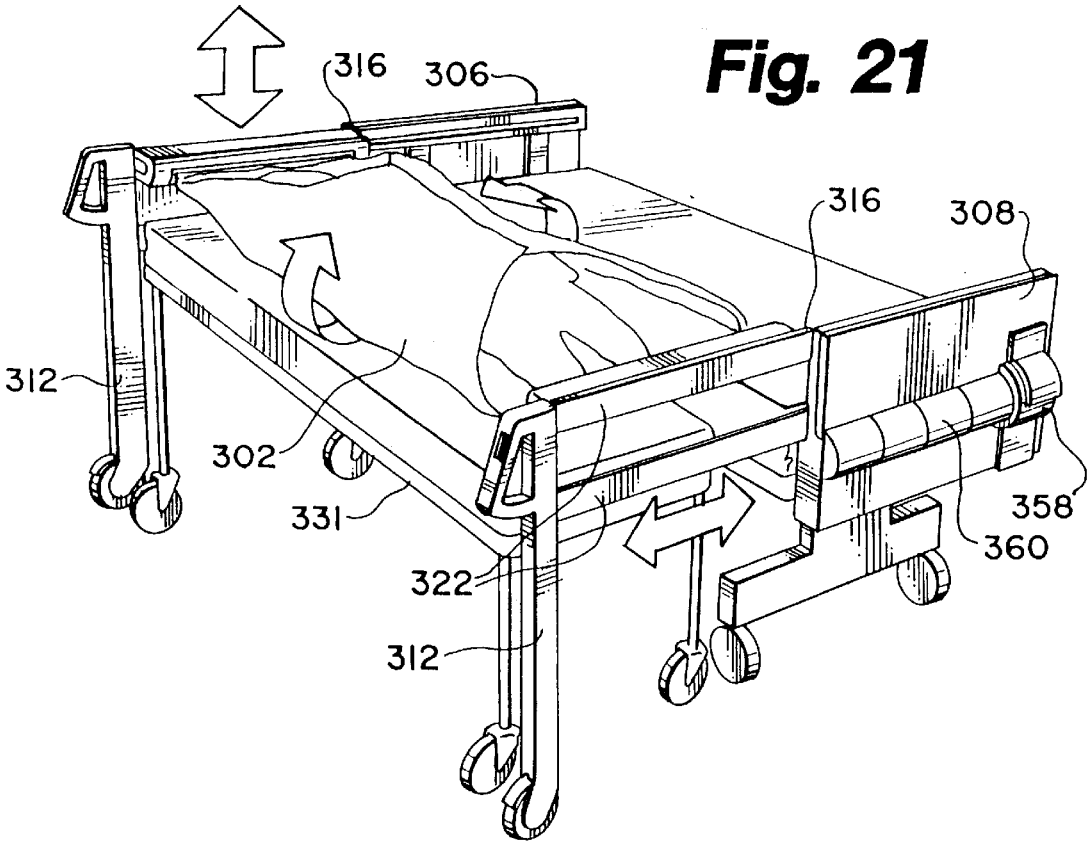
Fig. 21
Fig. 25
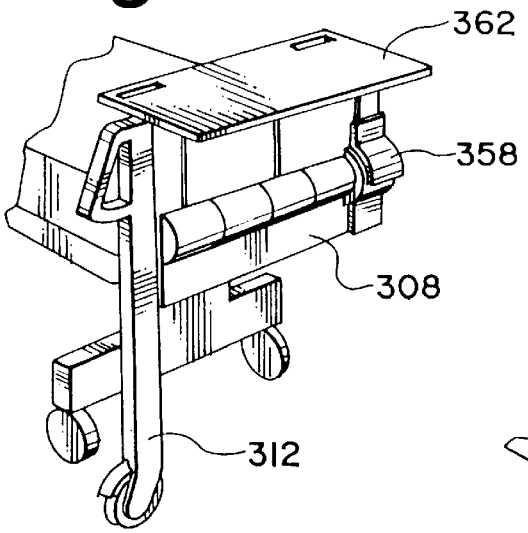
Fig. 24
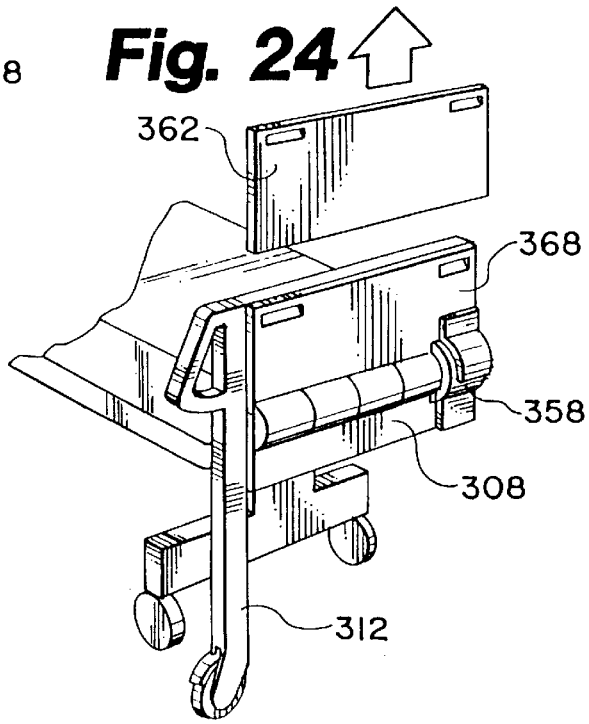

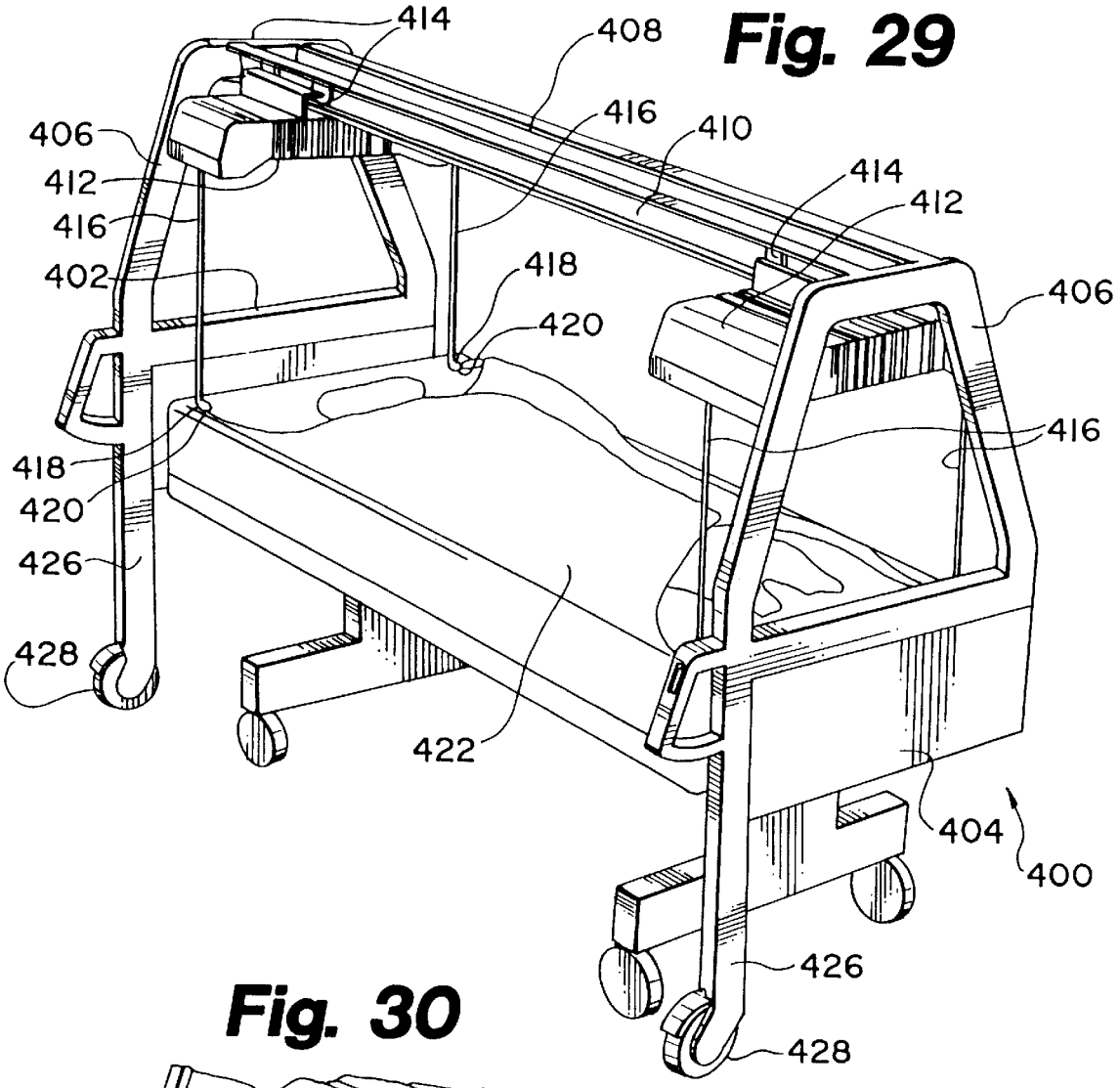
Fig. 29
Fig. 30
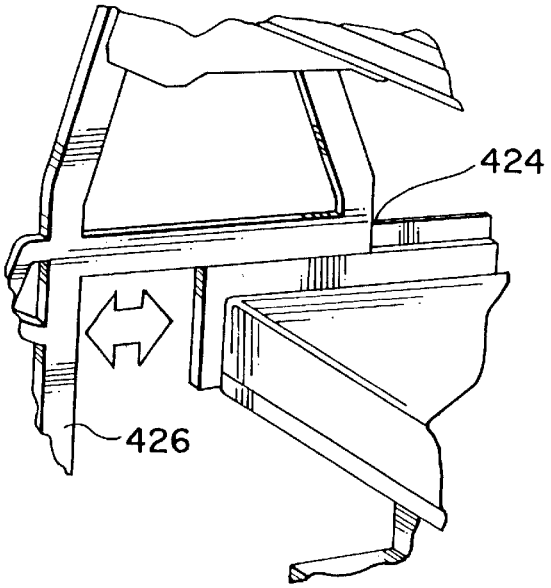

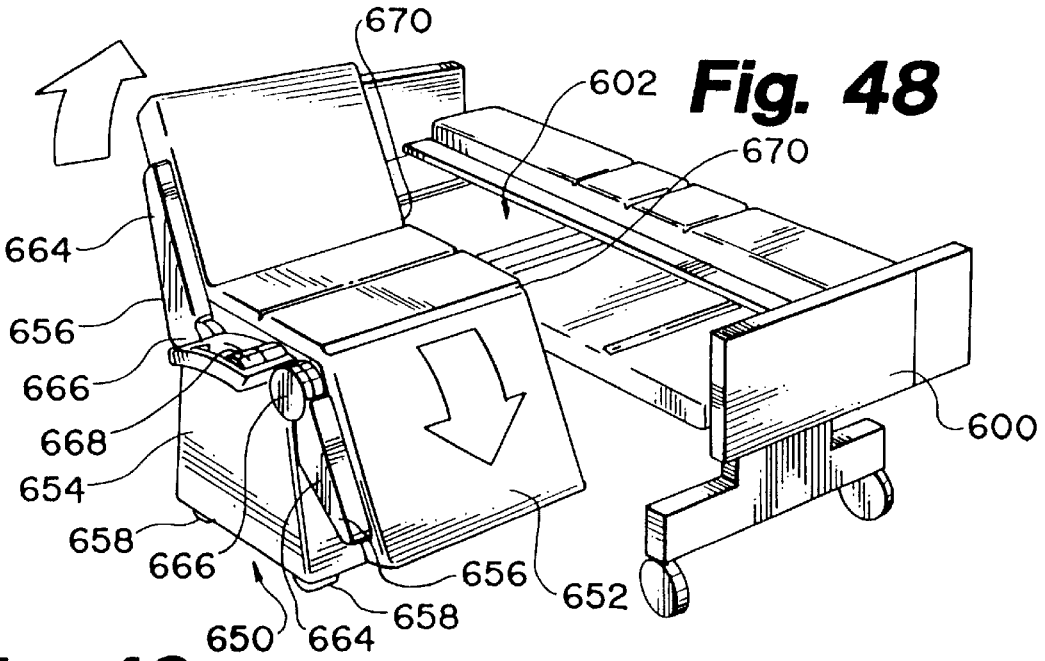
Fig. 48
Fig. 49
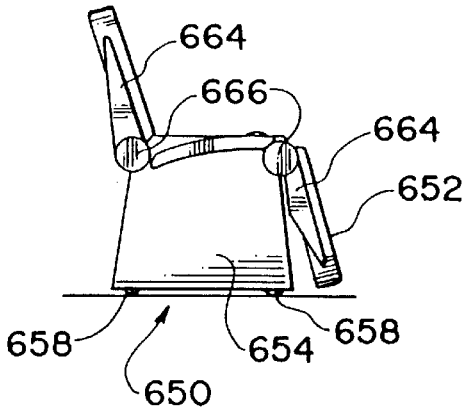
Fig. 50
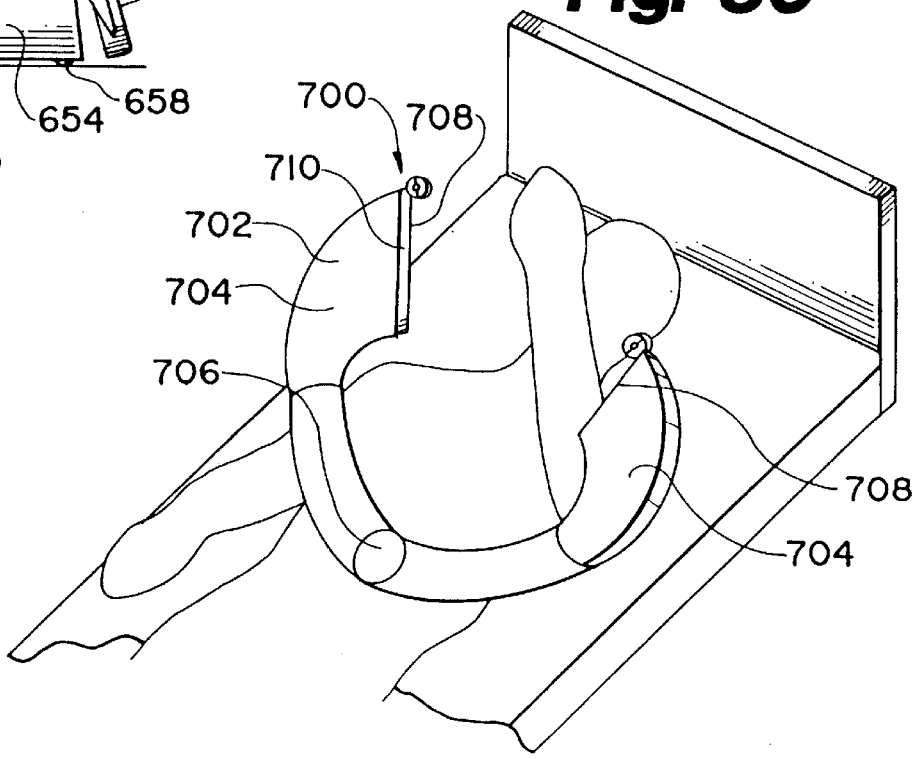

Fig. 51
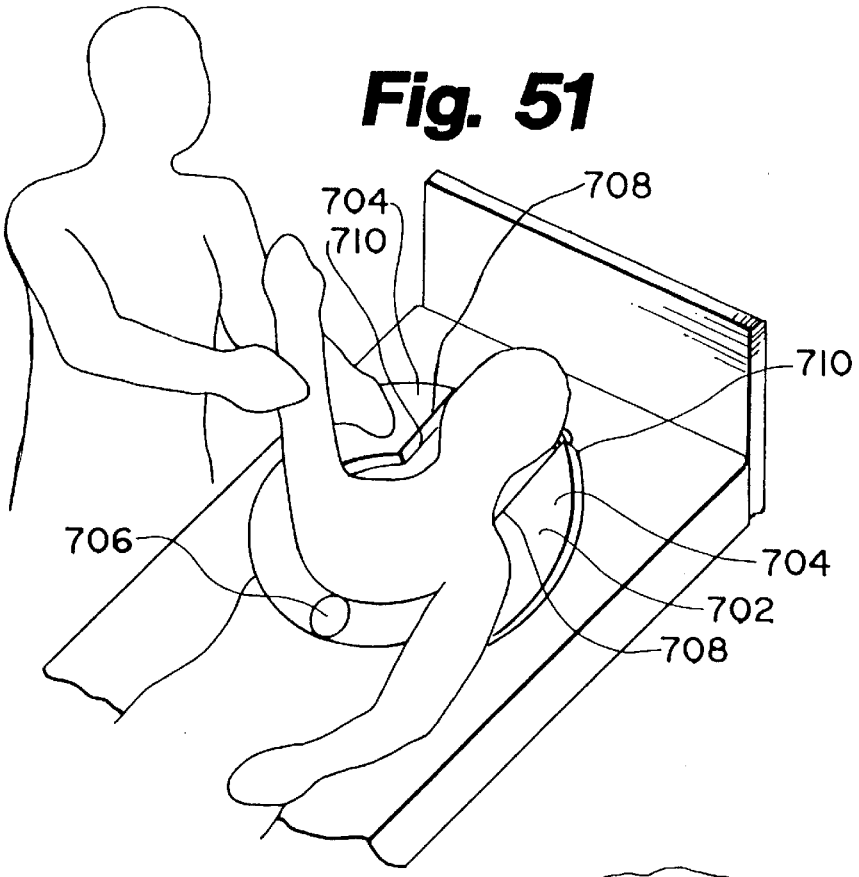
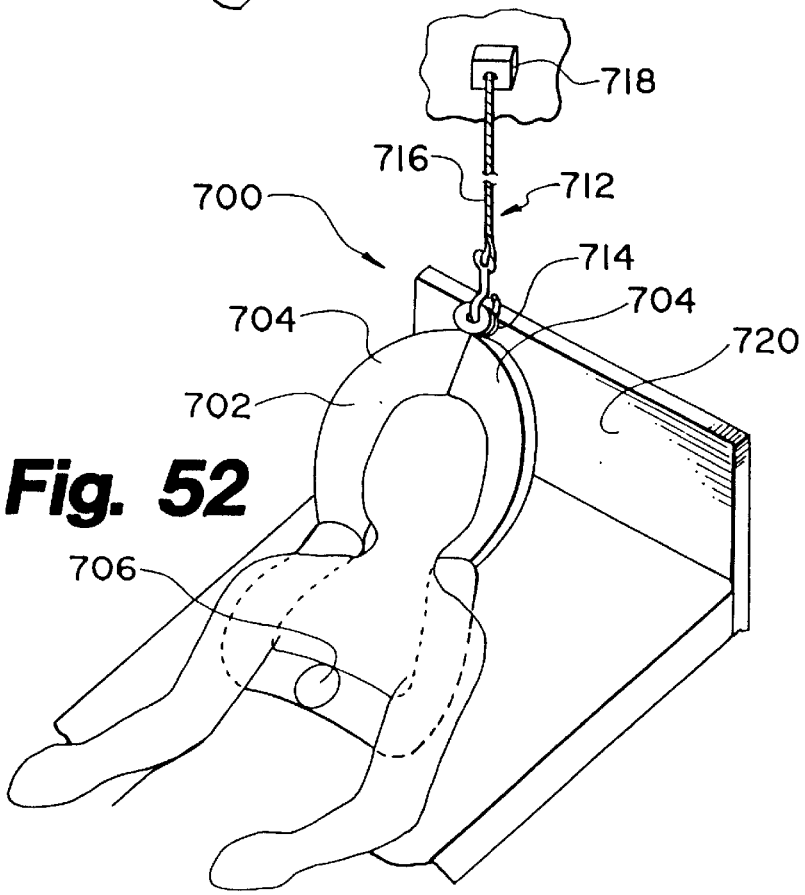
Fig. 52

PATIENT TRANSFER SYSTEMS

CROSS REFERENCE TO RELATED APPLICATIONS

This is a continuation-in-part of U.S. patent application Ser. No. 08/527,519, filed Sep. 13, 1995 and claims the benefit of U.S. Provisional Application Ser. No. 60/023,572, filed Aug. 19, 1996, and of U.S. Provisional Application Ser. No. 60/713,412, filed Aug. 30, 1996.

FIELD OF THE INVENTION

The invention relates to systems which assist with the movement of patients who are partly or completely incapacitated. The invention more particularly relates to systems which give a single health care worker the capability to move a patient from one bed to another bed, between a bed and a cart or gurney, between a sitting and a standing position or between a slumped position in a chair or bed and a more elevated position.

BACKGROUND OF THE INVENTION

Health care workers at hospitals, nursing homes, and home care programs face the challenge of moving partly or completely incapacitated patients. A typical patient weighs between 45 and 90 kilograms, although many others weigh much more. Consequently, at least two to four health care workers are usually needed to move the patient. These activities often create unacceptable risks of injury, almost without regard to the number of health care workers used in the patient transfer. The risks are particularly high when a sufficient number of workers is not available to assist in a patient transfer. For example, injuries to workers' backs account for approximately 50% of worker's compensation costs for workplace injuries in the health care industry in the United States, and thus are a particularly vexing problem.

Patient transfers can be placed in several broad categories. A first category includes the horizontal transfer of a patient from one flat surface to another. A second category involves upright transfers where a patient is moved from a horizontal position to an upright or sitting position in a wheelchair, chair or commode, and the return of the patient to the horizontal position from an upright or sitting position. A third category of transfer relates to the positioning or movement of patients in order to change their position in a bed or chair, for example pulling the patient up in the bed or rolling the patient from side to side. Although many attempts have been made to devise improved systems for patient transfer, almost all of these transfers continue to be manually performed.

Current healthcare guidelines typically recommend that four health care workers participate in a patient transfer. Two workers are at the bed side and two workers are at the cart side. Each worker grabs an edge of a draw sheet, which is positioned under the patient. The patient is then transferred between the bed and the cart through a combination of lifting, pulling, and pushing. An elongated plastic sheet is often placed beneath the patient to reduce friction or drag. Since a health care worker has to bend over at the waist to accomplish these patient transfers, the stresses encountered are magnified well beyond what would otherwise be expected for a maximum recommended lift of approximately fifty pounds. Normally this recommended maximum lift is measured with the lift at or near the worker's center of mass. Extremes in a health care worker's height, either taller or shorter than average, or any weakness in either the arms or legs further exaggerate these risks.

Many hospitals have swing-type mechanical lift devices to assist in certain patient transfers. However, these devices are not widely used because they are often cumbersome and time-consuming to set up and operate. Depending on the lift required, the devices may also be inappropriate.

The upright transfer and positioning categories provide similar difficulties, especially if the patient is unable to cooperate. For example, weak and elderly patients reclining in a semi-erect position tend to slide down. These patients must be returned to a position more toward the head of the bed. To do so, two health care workers usually grasp the patient by the upper arms to hoist the patient toward the head of the bed after the bed has been lowered to a more horizontal position. This manual transfer often causes strain on the workers' upper and lower backs and possible contact bruises on the patient. Similar difficulties occur with upright transfers.

Given these formidable difficulties, there have been other attempts to mechanize the patient transfer process. For example, U.S. Pat. No. 2,665,432 (Butler), describes a cart with a manual crank connected to an extensive pull unit. The pull unit has a large number of straps which connect at an edge by hooks to a transfer sheet. Rotation of the crank winds the pull unit onto a roller. The size of the pull unit presents many difficulties including its attachment at many locations to the sheet and the awkwardness of winding it on the roller. The pull unit must be placed under the patient just prior to transfer, since it would not normally be kept there otherwise. Also, no means are provided for transferring the patient off the cart.

U.S. Pat. No. 2,827,642 (Huff) describes a similar system mounted to the head of a bed and designed to move a patient from the foot toward the head of the bed. The '642 Patent does not describe the process of moving a patient laterally from one horizontal surface to another.

U.S. Pat. No. 4,970,738 (Cole) discloses another patient transfer system which employs a manual crank and self-locking gear system. This system has an advantage over the system described in the '432 patent in that the transfer is reversible. Rotating the crank drives a belt system, which is attached to a semi-rigid transfer apron. The apron is thereby transferred horizontally while supporting a patient. This system has the disadvantage that the apron must be first positioned under the patient before the patient can be transported from a bed onto a cart. Another disadvantage is that the transfer support alone does not provide sufficient support for the patient or the transfer system. Because of the complexity of its design, considerable operator interaction would be required for the transfer support to be mounted to a cart and then operated to transfer a patient.

U.S. Pat. No. 2,733,452 (Tanney) describes a transfer system that uses a motorized pulley to transfer a patient on a metal-reinforced transfer sheet. The transfer sheet has metal grommets in its corners for attachment to cables. A motor is used to wind the cables onto reels thereby resulting in the transfer of the sheet and the patient thereon. However, the patient must first be moved onto the transfer sheet before being moved from a bed to the cart. Moreover, this invention fails to provide support beneath a patient being transferred thereby.

U.S. Pat. Nos. 4,747,170 and 4,868,938 (both to Knouse) reveal a motorized winch-type transfer system. This transfer system has apparent advantages over the transfer system of the '452 patent, which include a more secure transfer sheet gripping mechanism and the use of a transfer sheet which does not need grommets or other similar devices. Though more secure, the gripping system is difficult and awkward to use.

U.S. Pat. No. 5,038,424 (Carter et al.) teaches a system for reciprocally transferring a patient between a bed and a cart. This system employs a pliable transfer web wound about two detachable, cylindrical rollers and a drive motor mounted on the bed and the cart. In use, the bed and cart are positioned side-by-side and the web is placed beneath the patient. The roller adjacent the cart or bed onto which the patient is to be transferred is detached. While unwinding a sufficient length of transfer web wound thereon, the roller is extended to the opposite side of the bed or cart onto which the patient is to be transferred, and there connected to the drive motor. The drive motor is then activated, thereby rewinding the transfer web onto the roller and transporting the patient disposed thereon. Thus, while enabling reciprocal transfer, the system of the '424 patent is time consuming and awkward to set up. Moreover, as in the previous inventions discussed hereinabove, the patient is not supported adequately while being transferred.

While considerable effort has gone into developing horizontal patient transfer systems, all of the systems previously developed have significant drawbacks. These drawbacks primarily relate to the significant difficulties encountered in set-up and operation.

The patent described hereinabove primarily relate to systems for transferring patients from one horizontal surface to another horizontal surface. By partial contrast, U.S. Pat. Nos. 4,700,415 and 4,837,873 (both to DiMatteo et al.) teach a system for transferring patients between a reclined wheelchair and a bed. The bed is equipped with a sheet wound about a right side roller and a left side roller, the sheet positioned beneath a patient reclining thereupon. The right and left side rollers are positioned laterally on each side of the bed, usually slightly below the plane of the patient. Two corner rollers are situated above the right side and left side rollers and approximately level with the top surface of the bed. The reclined wheelchair is equipped with two articulated rollers. Extending between these rollers is a sheet, the sheet including three bands. The lateral edges of the sheet may be joined or separate. If the lateral edges are to be joined, the sheet spans above and below the wheelchair upper surface. If the lateral edges are free, the sheet spans the wheelchair upper surface, its ends wound about the two rollers. The separate transfer systems for the bed and wheelchair must be powered such that both sheets rotate with equal velocities. In use, the patient reclining upon the bed is conveyed laterally by the bed transfer system. Upon encountering the wheelchair transfer system, the patient is thereupon further conveyed onto the wheelchair. The wheelchair may then be further adjusted, allowing the patient to assume a sitting position.

While the system of DiMatteo allows for transfer to or from a reclining wheelchair and for adjusting the wheelchair between sitting and reclining positions, its shortfalls include the complexity of its design, the need to retrofit beds with the rollers and sheet provided, and the possibility of pinching the patient or catching clothing in the gaps between the bands.

U.S. Pat. No. 3,597,774 (Warren) describes a harness and winch mechanism for raising a patient reclining upon a bed. The winch is mounted to a post attached to the head of the bed and is operated by a hand crank. The harness loops under the patient's armpits such that excessive stress may be applied thereto during operation of the device.

SUMMARY OF THE INVENTION

The invention includes devices for transferring patients which greatly simplify, and provide enhanced versatility over, any known device. The adoption of these transfer devices will likely reduce the wide incidence of back injuries in health care workers. A first system for the horizontal transfer of patients is adapted to use existing transfer sheets and an appropriately modified cart. The sheet is readily attached to a clamping device close to the patient. The clamping device has a releasable catch which holds the sheet. One or more straps are attached to the clamping device, and the other ends of the straps are attached to reels that are part of a winch. Activation of the winch winds the straps onto the reels. In a highly portable embodiment of this transfer device, the entire apparatus may weight only about 8–15 kilograms, and may be readily attachable and removable to bed and cart rails.

A long narrow rectangular cushion can be placed between the bed and cart when using the portable transfer device. The cushion is, optionally, the length of the bed, and may be partially coated with a low friction surface. The cushion may have fasteners for attachment to a bed or cart, or it may also be configured to hang from the side of the bed or cart by the fasteners when not in use. The cushion is particularly convenient when used with a portable transfer device of the invention because no other modifications to the bed or cart may be needed.

Other embodiments of horizontal transfer devices facilitate the transfer of the patient by providing some lift to the patient as well as horizontal motion. The vertical and horizontal transfer mechanisms may both be operably attached to a single bed or cart frame. One embodiment of a horizontal transfer mechanism within the invention has a transfer element that moves within tracks. Another embodiment of a horizontal transfer system of the invention moves the patient on a modularized cushion. In other embodiments, lift is added by use of a harness which provides significant advantage in distributing the weight of the patient without the need to lift the patient to place a portion of the harness under the patient. The harness has a support that goes across the patient's upper body. Another portion of the harness goes under the patient's arms. The harness has a fastener that attaches a lift mechanism near the back of the patient's head.

An improved patient transfer system is capable of transferring a patient using only a single attendant. The transfer system includes patient transfer means for transferring the patient, a transfer sheet, a retaining member assembly operably coupled to the patient transfer means and a contact element assembly.

The improved transfer system may also include a highly portable transfer unit. The portable transfer unit may be totally self-contained or may be installable on a bed or cart and connectable to a separate clamp. The portable transfer unit may utilize a plurality of detachable spools, as well as means for sensing the proximity of a patient being transferred and means for discontinuing the transfer in response to the sensing.

The improved transfer system may still further include a transfer bridge support means for supporting a patient being transported when the patient spans the bed or cart. The transfer bridge support means may be foldable and may include a stabilizer, a cross sectional camber and a leading edge camber to further prevent the transfer bridge support means from being displaced during patient transfer, and improved slip-resistant features.

BRIEF DESCRIPTION OF THE DRAWINGS

FIG. 21 is a perspective view of the further embodiment of the horizontal transfer system with an alternative design for the horizontal drive;

FIG. 24 is a partial perspective view of one end of the embodiment of FIG. 21 with an arrow showing the disengagement of a removable panel;

FIG. 25 is a partial perspective view of one end of the embodiment of FIG. 21 with a removable panel attached as a shelf;

FIG. 29 is perspective view of an alternative embodiment of the horizontal transfer system;

FIG. 30 is a perspective view of a portion of the alternative embodiment of FIG. 29 showing extendable horizontal supports;

FIG. 48 is a perspective view of the mattress transfer system and position changing cart depicting the cart in a folded position;

FIG. 49 is a side view of the position changing cart in the chair orientation;

FIG. 50 is a perspective view of a lobster claw type of bed jacket being placed on one side of a person;

FIG. 51 is a perspective view of the bed jacket in place around a person;

FIG. 52 is a perspective view of the bed jacket secured around a person and hooked to hoisting mechanism;

These figures are intended to be merely illustrative and non-limiting.

DETAILED DESCRIPTION OF THE INVENTION

The invention includes improved devices and methods for moving patients and other individuals who lack full mobility. Patients must be moved in a variety of ways while providing care in various locations, including hospitals, nursing homes and other residences. For example, patients may need to be transferred horizontally between a bed and a cart, they may need to be repositioned in a bed or chair, or they may need to assume a prone, sitting or standing position. The unifying feature of the various embodiments of this invention is the enablement of empowering a single health care worker to now be able to move a patient in a substantially low risk manner to either the patient or the healthcare worker. The embodiments of this invention further allow a patient transfer event to require between about 20 seconds and 28 seconds and preferably about 24 seconds.

A feature of the horizontal transfer systems of the present invention includes a support beneath the patient and a mechanical or electromechanical system for applying a horizontal force to the support to effect the transfer. The design of the various embodiments incorporate varying features to achieve this utility. In order to reduce cost, the simplest systems are designed to be adapted for use with beds, carts and transfer sheets now commonly in use in health care facilities. Other embodiments optimize the particular characteristics of the design with less regard to adaptation to existing equipment. In all cases, each design focuses toward the goal of a safe and efficient patient transfer event by a single health care worker, or greatly reducing the number of healthcare workers required for each transfer event.

The embodiments of the present invention described hereinbelow are also taught in U.S. Provisional Application Ser. No. 60/023,572, filed Aug. 19, 1996, and in U.S. Provisional Application Ser. No. 60/713,412, filed Aug. 30, 1996, and with the entire contents of each being hereby incorporated by reference.

Figure 1:
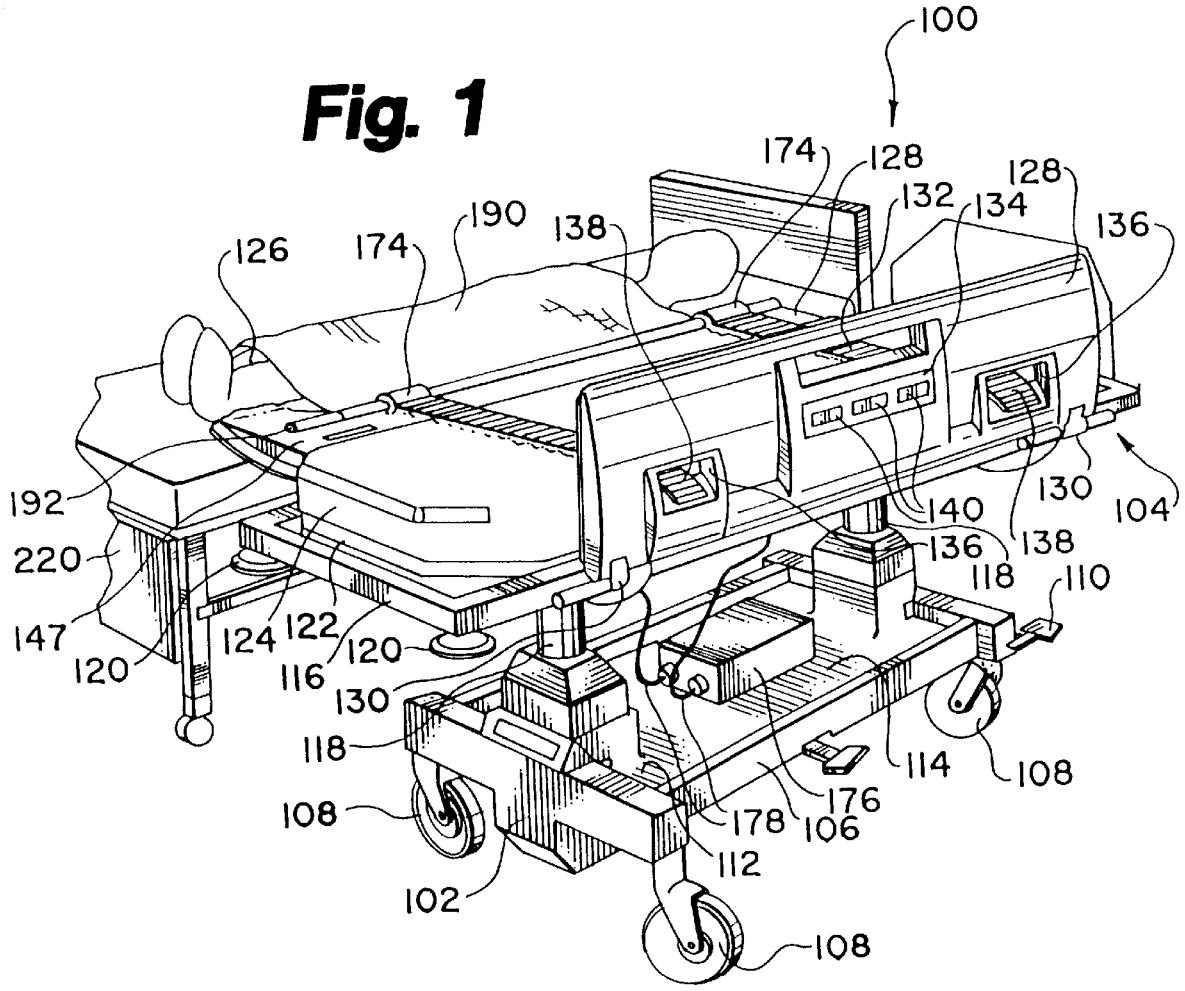
FIG. 1 is a perspective view of a bed with an adjacent cart adapted with a first embodiment of a horizontal patient transfer system.

Referring to FIG. 1, the first embodiment of the horizontal transfer system 100 includes a standard patient cart 102 retrofitted with a horizontal transfer mechanism 104. The cart 102 will generally have a base 106 with four wheels 108. The wheels 108 preferably have lock levers 110 for applying brakes that prevent the rotation of the wheels 108. The base 106 may have a top surface 112 that usually, but not necessarily, will have a flat portion 114.

Cart 102 has a support portion 116. The support portion 116 is attached to the base by one or more upright supports 118. The embodiment represented in FIG. 1 has two upright supports 118. Some designs may have the wheels 108 attached directly to the upright supports 118 eliminating the need for a base 106. The support portion will preferably have cushioned bumpers 120. The cart 102 can have the capability of raising and lowering the support portion 116 relative to the base 106 and other features. The support portion 116 provides a support structure 122 for supporting a cushion or mattress 124 for holding a patient 126.

Figure 2:
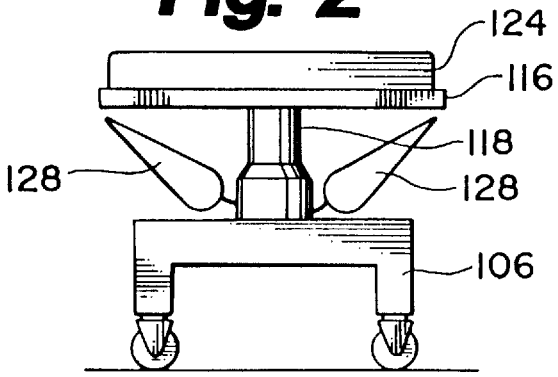
FIG. 2 is a front, schematic view of a cart adapted with the first embodiment of a horizontal patient transfer system with side rails in a lowered storage position.
Figure 3:
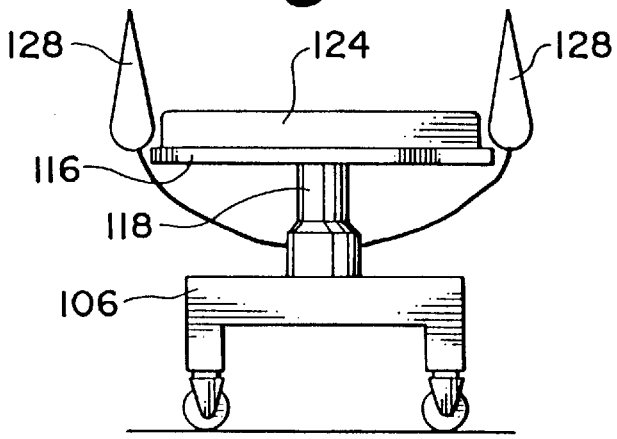
FIG. 3 is a front, schematic view of a cart adapted with the first embodiment of a horizontal patient transfer system with side rails in a raised patient transport position.
Figure 4:
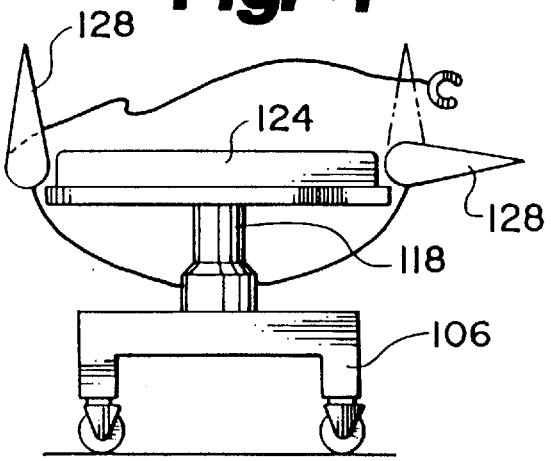
FIG. 4 is a front, schematic view of a cart adapted with the first embodiment of a horizontal patient transfer system with one side rail in a raised position and a second side rail in a bridge position used during patient transfer.
Figure 5:
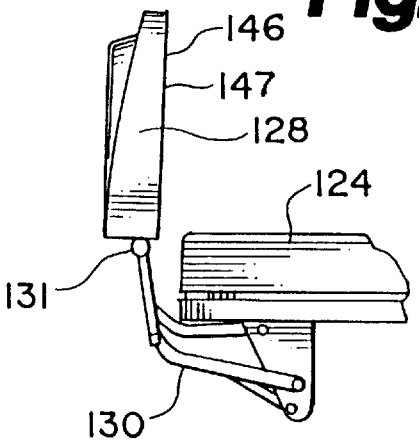
FIG. 5 is a front fragmentary view of one embodiment of hinges supporting a side rail.

Horizontal transfer mechanism 104 includes two side rails 128. Referring to FIG. 5, the side rails are mounted to the cart 102 with hinges 130 and 131. The side rails 128 and hinges 130 are preferably adapted from existing side rails and hinges on the cart 102. The hinges 130 can adjust to place the side rails 128 in either an elevated pull position or a lowered storage position. Preferably, hinges 131 are used to place the side rails 128 in a horizontal bridge position to provide support and a smooth surface for transferring the patient. The different positions are schematically depicted in FIGS. 2–4. Alternative designs for the side rail can allow for the side rail to slide straight down to a lowered position, and other variations are possible.

Each side rail 128 has a handle 132, a control panel 134 and two openings 136 for a power assembly, such as winch 138. Other numbers of openings can be used for access to the winch unit. The control panel 134 has a plurality of switches 140 to control the operation of the winch 138. The particular design of the side rail 128 and control panel 134 can be varied without effecting their function.

Referring to FIG. 3, a convenient structure for the side rail 128 has a frame 142, winch 138, a front cover 144 and a back cover 146. The frame 142 has extensions 148 attached to frame substructure 150 at frame hinge 152. The frame substructure 150 has a winch mounting portion 154. The frame substructure 150 is preferably made from metal, a rigid polymer or a composite material, although other materials exhibiting the proper strength, weight, and cost characteristics may be suitable. The back cover 146 has open portions 156 for the passage of extensions 148 and motion of frame hinges 152 as well as a portion of handle 132 and openings 136. The outer surface 147 of back cover 146 (FIG. 2) is a transfer surface that preferably is made from a very low friction material to assist with the transfer process and reduce the risk of injury. Front cover 144 has parts of handle 132 and openings 136, and control panel opening 158.

Figure 6:
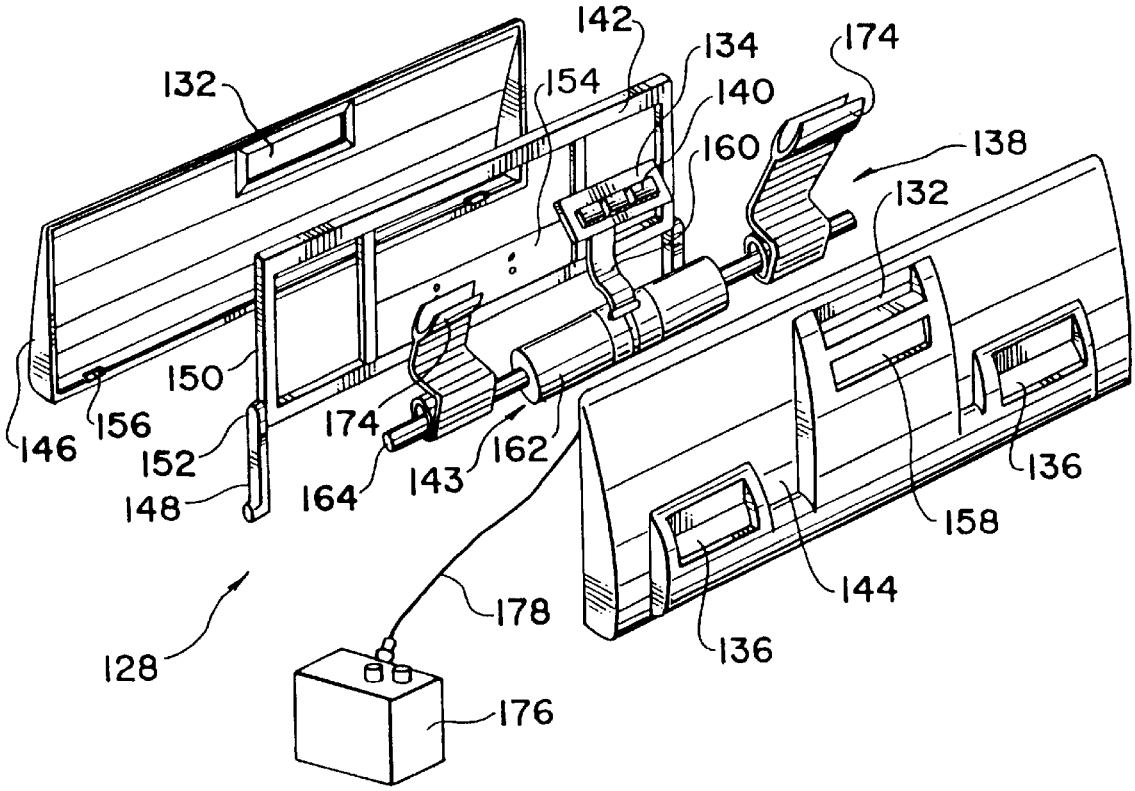
FIG. 6 is an exploded view of a side rail of the first embodiment of a horizontal transfer system.
Figure 7:
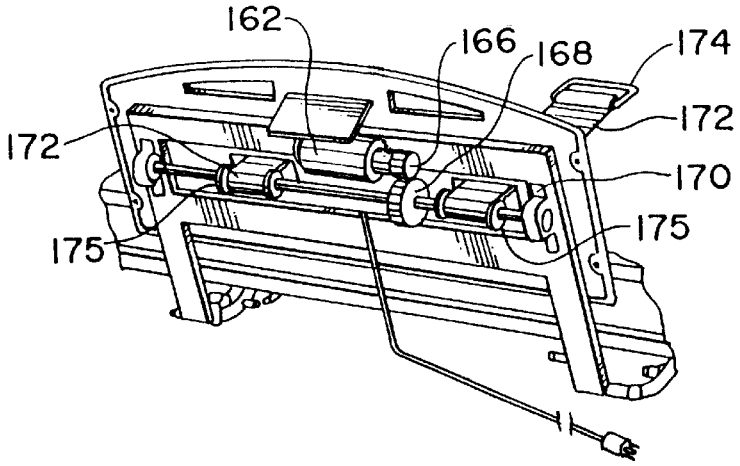
FIG. 7 is a cut away view of a second drive system within the side rail.
Figure 8:
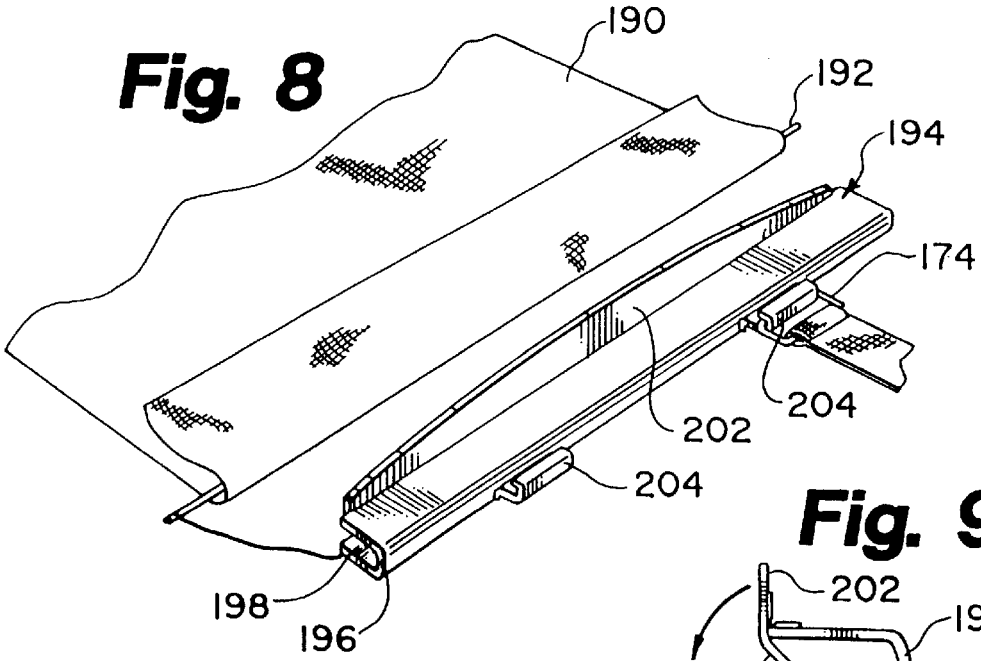
FIG. 8 is a perspective view of a first embodiment of a clamping device useful with a first embodiment of the horizontal transfer system in an orientation to be clamped to a transfer sheet folded over a rod.
Figure 9:
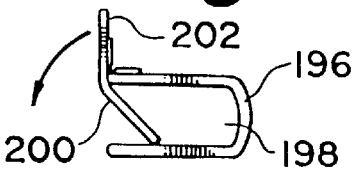
FIG. 9 is an end view of a first embodiment of the clamping device.
Figure 10:
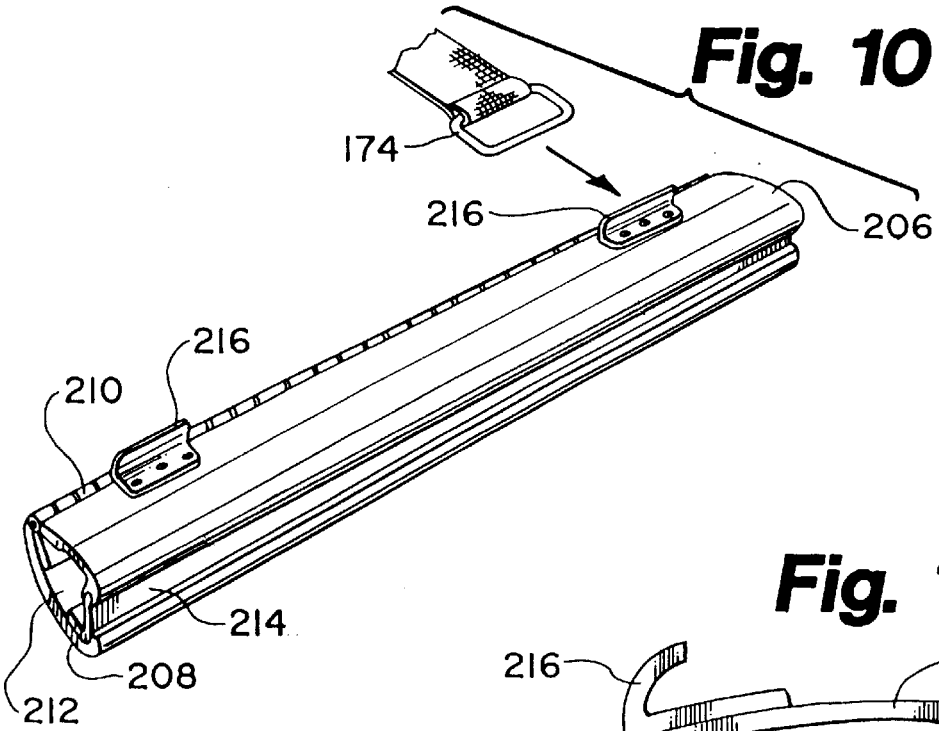
FIG. 10 is a perspective view of a second embodiment of the clamping device.
Figure 11:
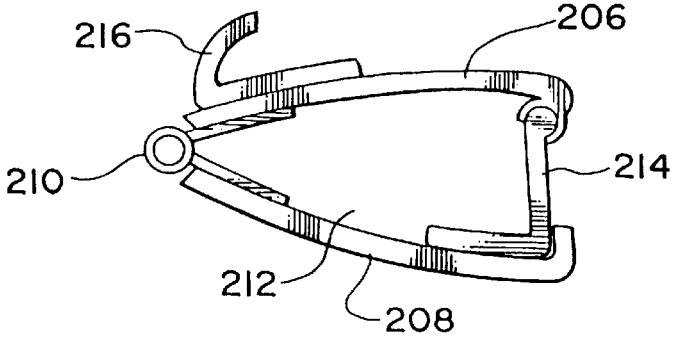
FIG. 11 is an end view of the second embodiment of the clamping device.
Figure 12:
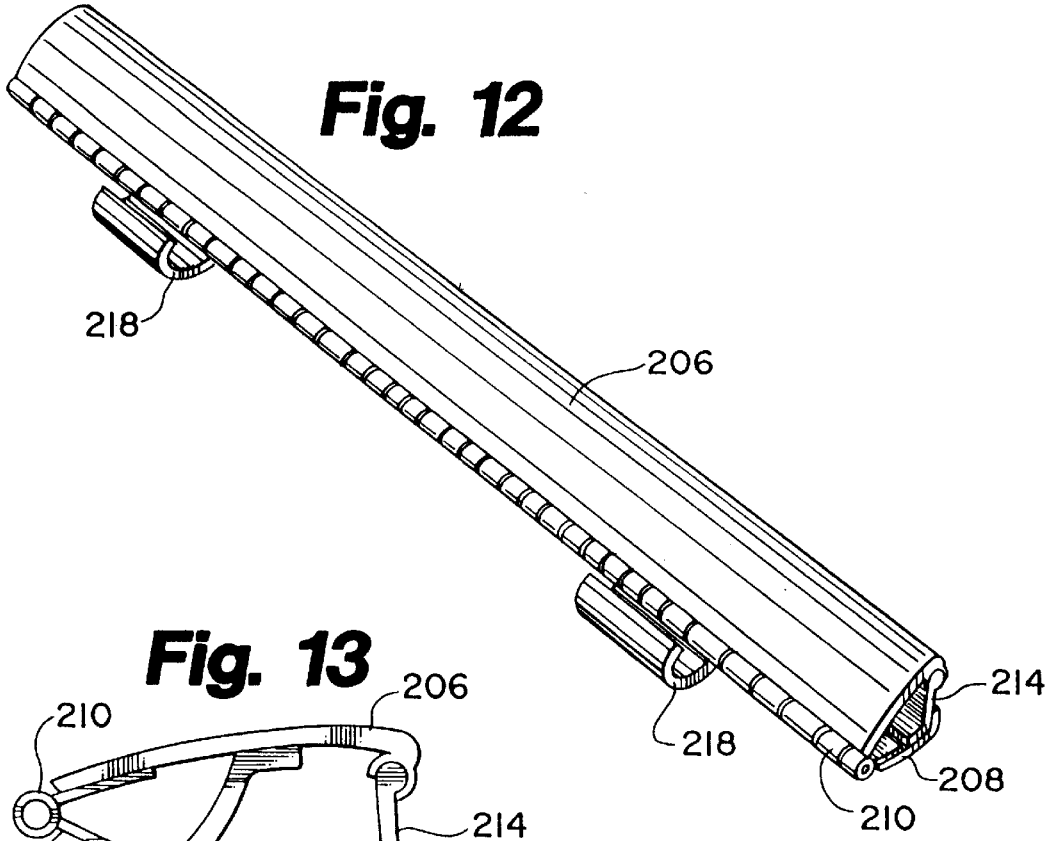
FIG. 12 is a perspective view of a third embodiment of the clamping device.
Figure 13:
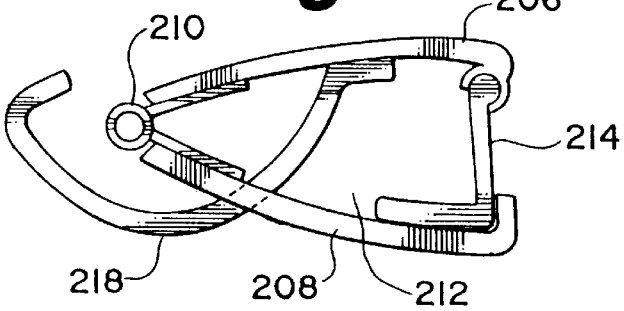
FIG. 13 is an end view of the third embodiment of the clamping device.

The winch 138 is coupled to control panel 134 by wires 160. A conventional manual winch can also be used without excess difficulty, but less conveniently. The drive system 142 preferably has at least one motor 162 and can use a variety of conventional designs. The motor may directly rotate the drive shaft as depicted in FIG. 6. Referring to FIG. 7, the motor 162 rotates a first drive shaft 164 which has a first gear 166. First gear 166 engages a second gear 168 which preferably has a larger diameter than first gear 166 so that the rotation of the motor 162 is reduced. Second gear 168 is connected to a second drive shaft 170.

Two belts 172 each with a clip 174 are attached to the second drive shaft 170 at positions aligned with openings 136. The belt preferably winds on spools 175 which help ensure that the belts 172 wind and unwind straight. The belts 172 are preferably made from very strong synthetic fabric such as the material used in seat belts for automobiles. The winch 138 can be powered by a battery pack 176 utilizing power cord 178. Alternatively, winch 138 can be powered by alternating current using a power cord (not shown). Cart 102, or any other embodiment of the present invention, may also include aligning and docking mechanisms. Aligning mechanisms include powering and steering means, whereby at least two of the wheels of cart 102 are powered and steered by operation of control switched 140. Docking mechanisms include clamps and electromagnets, also operated by control switches 140, and which secure cart 102 to the horizontal surface on which the patient is to be transported is disposed. In addition to control switches 140, hand-held remote control units communicating with the control mechanism of cart 102 by electric or electromagnetic means are within the scope of the present invention. Voice actuated controls are also within the scope of the present invention, thereby enabling the patient, as well as an attendant, to begin and discontinue a transfer event.

Cart 102, or any other embodiment of the present invention, may further include means for sensing an asynchronous operation of the transfer mechanisms. Such means include sensing the individual belt torque or drag experienced when belts 172 are being retracted and a comparison of these sensings. A difference between sensings exceeding a predetermined value or a sensing ratio greater than or less than a predetermined ratio range would result in an alarm being actuated or an automatic discontinuance of transfer to be effected.

Cart 102 of FIG. 1 is designed for use with a standard patient draw sheet 190. The standard patient draw sheet 190 is sufficiently wide so that it can be folded over the patient 126, if desired, but typically not long enough so that it rests under the head or feet of the patient. Rather than using several people to move the patient with the draw sheet 190, horizontal transfer mechanism 104 performs the comparable function. Clips 174 can be designed to attach directly to draw sheet 190, but it is preferred to use clamping device 194 to provide a more even pull over the length of the sheet 190 and smoother motion to the patient. For particularly tall patients, the draw sheet 190 can be wrapped around patient 126 for added support of the patient, and both ends of the sheet are attached to clamping device 194.

Three embodiments of the clamping device 194 are presented in FIGS. 8–13. In the first embodiment shown in FIGS. 8 and 9, clamping device 194 can be used to attach draw sheet 190 to winch 138 employing rod 192. A U-shaped portion 196 forms a cavity 198 which is covered by a spring loaded gate 200. Rod 192 can enter the cavity 198 when pushed against the gate 200. Force from the rod 192 against the gate 200 from inside the cavity 198 tends to force the gate 200 closed thereby preventing the withdrawal of the rod 192. Gate 200 has an upward extension 202. Forward force on the upward extension 202 opens the gate 200 for the withdrawal of rod 192 from cavity 198. Clips 174 are conveniently attached to the clamping device 194 at J-shaped flanges 204. Rod 192 can be optionally tethered to the clamping device 194 at one or more positions for convenience, and the rod 192 can be clipped to the clamping device 194 for storage.

In the second and third embodiments, the clamping device 194 has an upper portion 206 and a lower portion 208 attached at a hinge 210 to form a cavity 212. The front of the cavity 212 is closed by an L-shaped, hinged closure 214. The two embodiments differ in their design of J-shaped flanges 216 or 218 for the attachment of clips 174. In these two embodiments, the sheet 190 is directly placed into the cavity 212 without the need to wrap the sheet 190 around a rod 192, although a rod 192 could still be used if desired. The sheet is held in place by the L-shaped hinge closure. A thin rigid tucking device (not shown) of any convenient length can be used if desired to assist with tucking the sheet into the clamp.

Clearly, a variety of other designs for clamping device 194 are possible within the general concepts presented. For all of these embodiments, any portion of the sheet can be attached, not just the end of the sheet. This is important because the clamping device should, preferably, be placed as near as possible to the patient so that the transfer mechanism 104 can fully transfer the patient onto the second horizontal surface from the first.

In operation, the cart 102 is wheeled up to a patient's bed 220, as depicted in FIG. 1, or another cart. The side rail 128 facing the patient's bed 220 is placed in the bridge position with the low friction surface 147 directed upward. The draw sheet 190 is attached to a clamping device. The belts 166 are unwound from drive shafts 164 so that they are long enough to reach rod 192 at the edge of the bed 220. The belts are unwound either by activating the motor to unwind the belts or by using a clutch to allow the belts to be freely withdrawn from the drive shaft. The clips 174 on the ends of the belts 166 are attached to a clamping device 194 and the clamping device 194 is engaged by the rod 192 and sheet 190. Other embodiments of the clamping device can be used with or without the rod 192.

The appropriate switch 140 mechanism is actuated, and the winch 138 begins winding the belts 166 onto the drive shafts 164 (FIG. 6). The motor 162 should be designed to apply a slow, steady and constant force to move the patient 126 without jerking or applying any other inappropriate forces, or provide variable speeds of movement consistent with gradual starts and stops and safe transfer throughout travel. The draw sheet 190 helps to distribute the forces over significant areas of the patient's body. When the patient 126 is on the cart's cushion 124, the motor 162 is turned off or otherwise disengaged. At this point, the belts 172 are disconnected from the clamping device 194, and the sheet 190 is removed from the clamping device.

In order to transfer a patient from a cart to a bed, the bed would have to be adapted with a similar winch as described on cart 102. This bed-based transfer device would preferably be adapted with the side rails of a conventional bed. These side rails may go up and down rather than folding under the bed. The winch could easily be adapted on one or both sides of the bed, and may be retrofitted to a bed in a comparable fashion as a cart, based on the above description.

Figure 14:
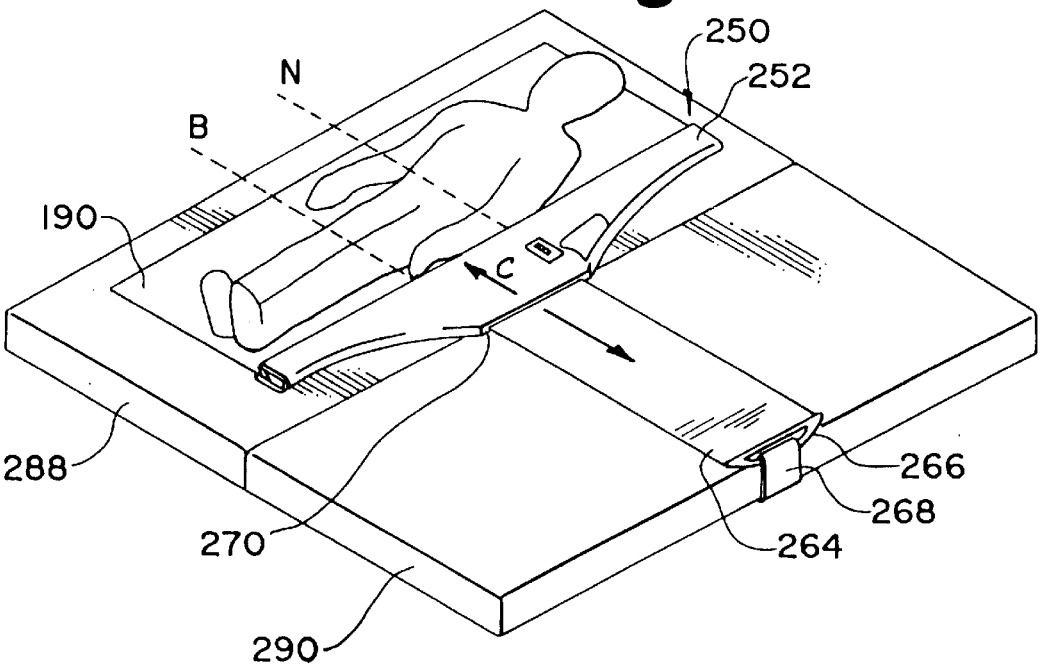
FIG. 14 is a perspective view of the attachment of a portable horizontal transfer device for the transfer of a patient from one horizontal surface to another.
Figure 15:
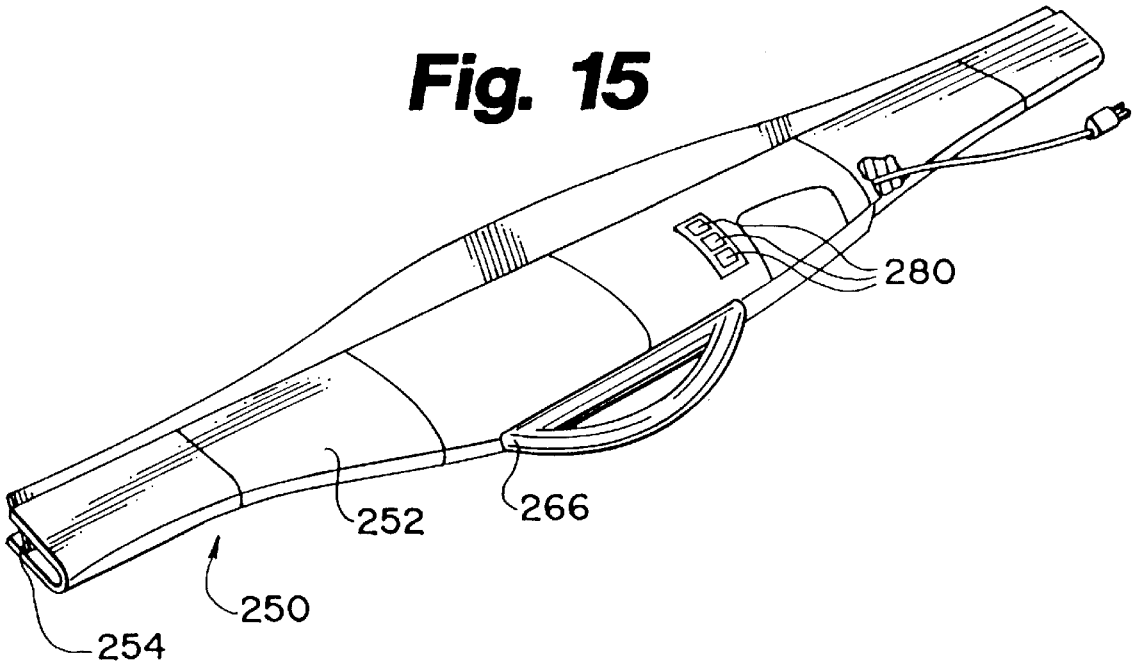
FIG. 15 is a perspective view of the portable horizontal transfer device.
Figure 16:
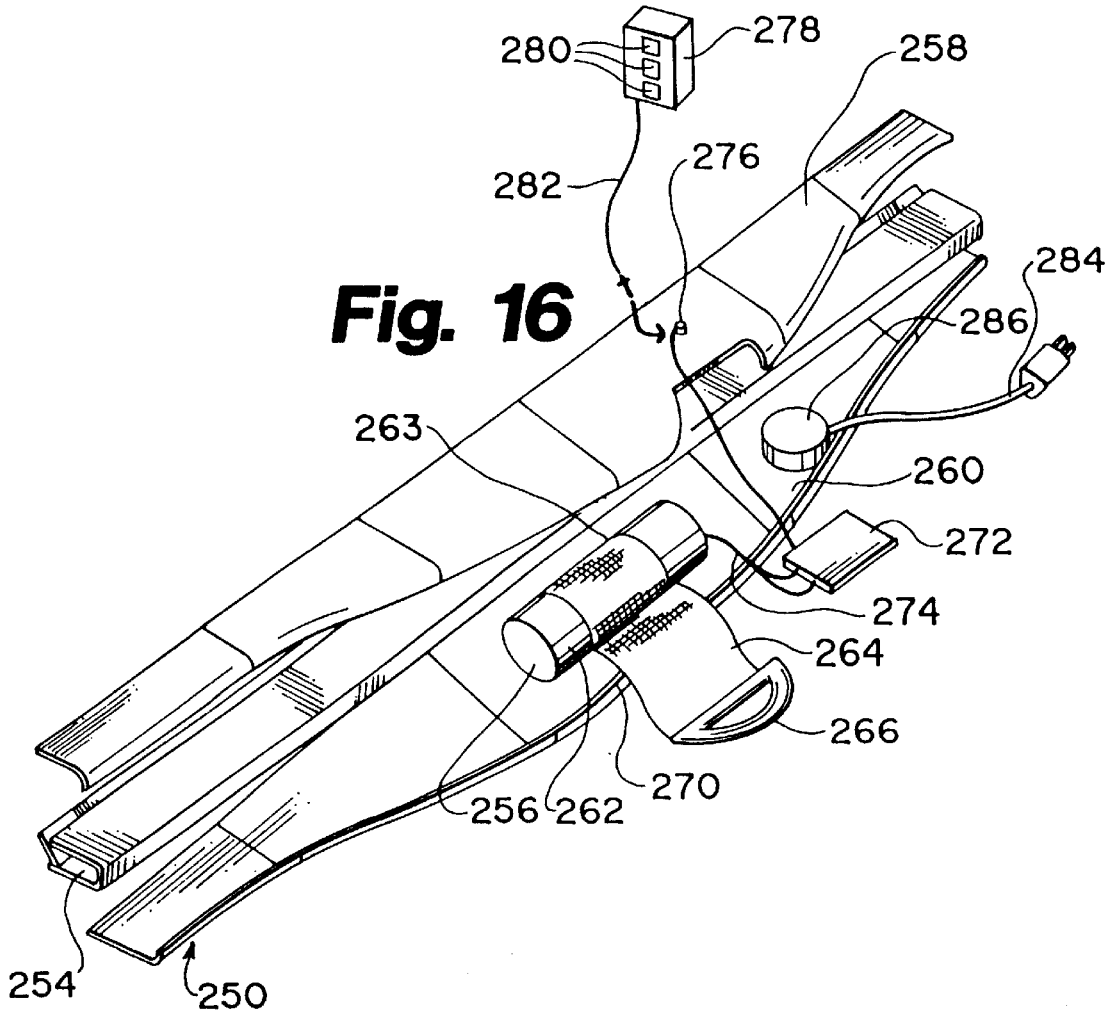
FIG. 16 is an exploded view of the portable horizontal transfer device.

Alternatively, a portable winch unit readily carried by a single health care provider can be used to replace the winch on the bed, on the cart or both. One embodiment of such a portable winch unit 250 is shown in FIGS. 14–16. The portable winch unit 250 includes a housing 252, a clamping device 254 and a winch 256. The clamping device 254 serves to hold a transfer sheet 190 in the same way as clamping device 194 in the first embodiment of the horizontal transfer device 100. The clamping device 254 also serves as a frame or a portion of the frame for the portable winch unit 250. The housing 252 preferably has a top portion 258 and a bottom portion 260 which are preferably heavy plastic shells surrounding the clamping device 254 and the winch 256, although other materials can be used.

The winch 256 includes a motor 262 that can rotate a drive shaft (not shown) connected to a reel 263. Belt 264 winds around reel 263. Belt 264 is comparable to belts 166 in embodiment 100. The free end of the belt 264 has a handle 266. Handle 266 attaches to a clamp 268 rigidly attached to the edge of a bed or cart. The clamp 268 can be designed to fold out of the way when not in use. The belt 264 passes out of housing 252 through an opening 270. The operation of winch 256 can be controlled through a circuit board 272 which is connected to motor 262 by wire 274. Circuit board 272 can be similarly connected to a port 276.

A control unit 278 with switches 280 can be connected to port 276 by way of tether 282. The operator can operate the winch 256 using control unit 278. Alternatively, control switches 280 can be made integral with the housing 252, as shown in FIG. 15, but this would be less desirable because the operator would have to lean over the bed or cart while the patient was being transferred. Control unit 278 can have a wireless connection with circuit board 272 using a transmitter/receiver (not shown). Winch 256 is powered by a standard wall outlet using a cord 284. A retractable cord assembly 286 is preferably used to keep the cord out of the way when not in use and to prevent excess cord being in the way during the transfer of the patient. Alternatively, a battery, preferably rechargeable, can be used to power the winch.

Figure 17:
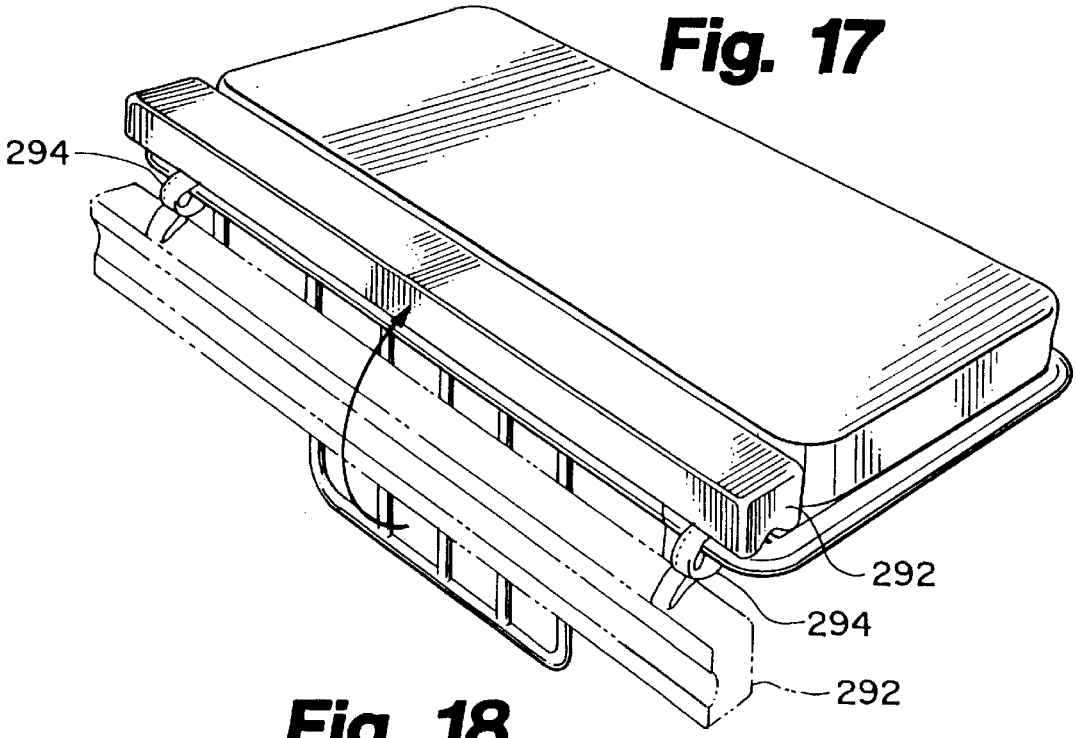
FIG. 17 is a perspective view of a portable cushion attached to a horizontal surface to provide a smooth continuous surface for the transfer of a patient with the portable horizontal transfer system, with the cushion in a lowered, stored position shown in phantom lines.

Referring to FIG. 14, to transfer a patient from a first bed/cart 288 to a second bed/cart 290, a draw sheet 190 is used under the patient in the same way as in the first embodiment 100. A portable cushion 292 can be placed between the first bed/cart 288 and the second bed/cart 290 to a relatively smooth continuous surface for transferring the patient, as shown in FIG. 17. Straps 294 with a hook and loop fastener can be used to attach the portable cushion 292 to the bed or cart when not in use. The portable cushion 292 can be used with other transfer devices or even as an aid during manual transfer. The cushion 292 would preferably have a top surface with a very low friction which is preferably made from a plastic material.

The portable winch unit 250 is attached to draw sheet 190 using clamping device 254, as shown in FIGS. 15 and 16. The design of the clamping device 254 can be similar to the clamping devices in FIGS. 8–13 or a comparable design based on similar concepts. The draw sheet 190 can be wrapped over a rod 192 (FIG. 8) for attachment to the clamping device 254. Referring to FIG. 14, belt 264 is withdrawn from housing 252 so that handle 266 can be attached to clamp 268. Clamp 268 is rigidly attached to the second bed/cart 290 on its side opposite the side near the first bed/cart 288. Clamp 268 can be optionally reversibly detachable or lowerable to storage position. The operator uses control unit 278 to activate the motor 262. As the motor 262 retracts belt 264, the portable winch unit 250 and the patient are drawn toward clamp 268 which result in the patient being moved onto second bed/cart 290.

Referring to FIG. 14, the transfer devices of the present invention, especially the clamps, are designed to be centered at the patient's center of gravity when the patient is in a supine position. A patient's center of gravity is usually about midway between the patient's navel and buttocks, represented as lines N and B, respectively. Thus, for transfer to move the patient smoothly and evenly, the clamp center of gravity (represented by arrow C) should be aligned about midway between lines N and B on the patient.

Figure 18:
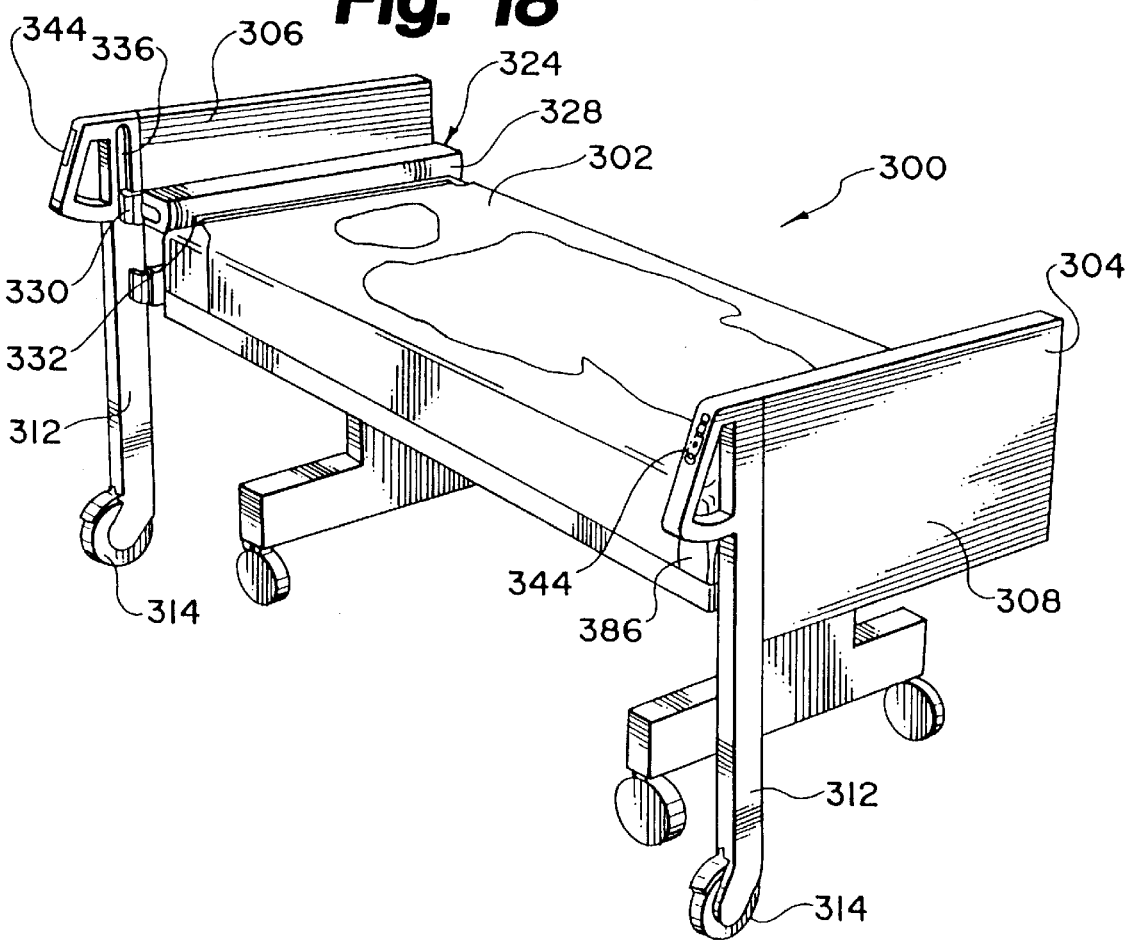
FIG. 18 is a perspective view of a further embodiment of a horizontal transfer (system.

A further embodiment of a horizontal transfer system 300 involves a specially designed transfer sheet 302 and a transfer unit 304, as shown in FIG. 18. Since the transfer unit 304 can move a patient in either of two directions, horizontal transfer system 300 has the advantage that only either the cart or the bed must be supplied with a transfer unit 304, not both. Therefore, the cart or bed not adapted with the transfer unit 304 can be conventional.

The transfer unit has a head frame 306 and a foot frame 308 attached to a drive system 310. The head frame 306 replaces or attaches to the head board of the bed or cart while foot frame 308 replaces or is attached to the foot board of the bed or cart. The head frame 306 and the foot frame 308 each have at least one vertical support 312 with a wheel 314 at the bottom of the vertical support 312. The wheels 314 should be oriented to roll along the direction defined by the width of the bed/cart. The wheels 314 can be attached to the vertical support 312 in a way that permits shifting of the wheels out of contact with the floor so that the bed or cart can be moved without interference from the wheels 314. The vertical supports 312 can have a removable brace (not shown) extending between the two vertical supports 312 to help compensate for the forces created by the weight of the patient.

Figure 19:
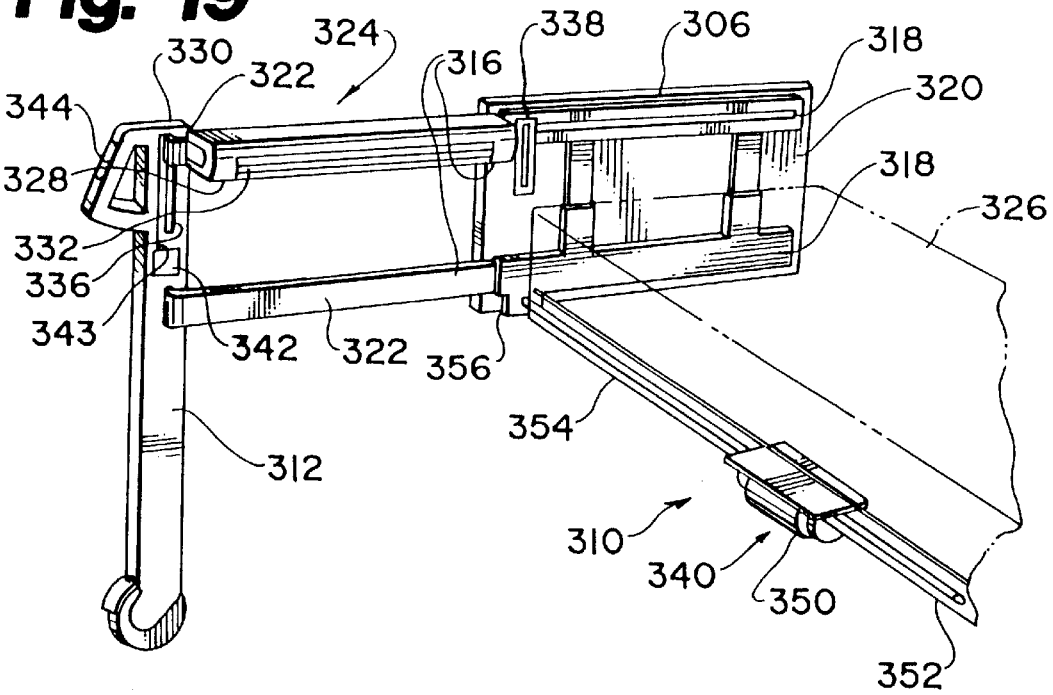
FIG. 19 is a partial, cut away perspective view of the further embodiment of the horizontal transfer system showing the drive system for horizontal extensions.
Figure 20:
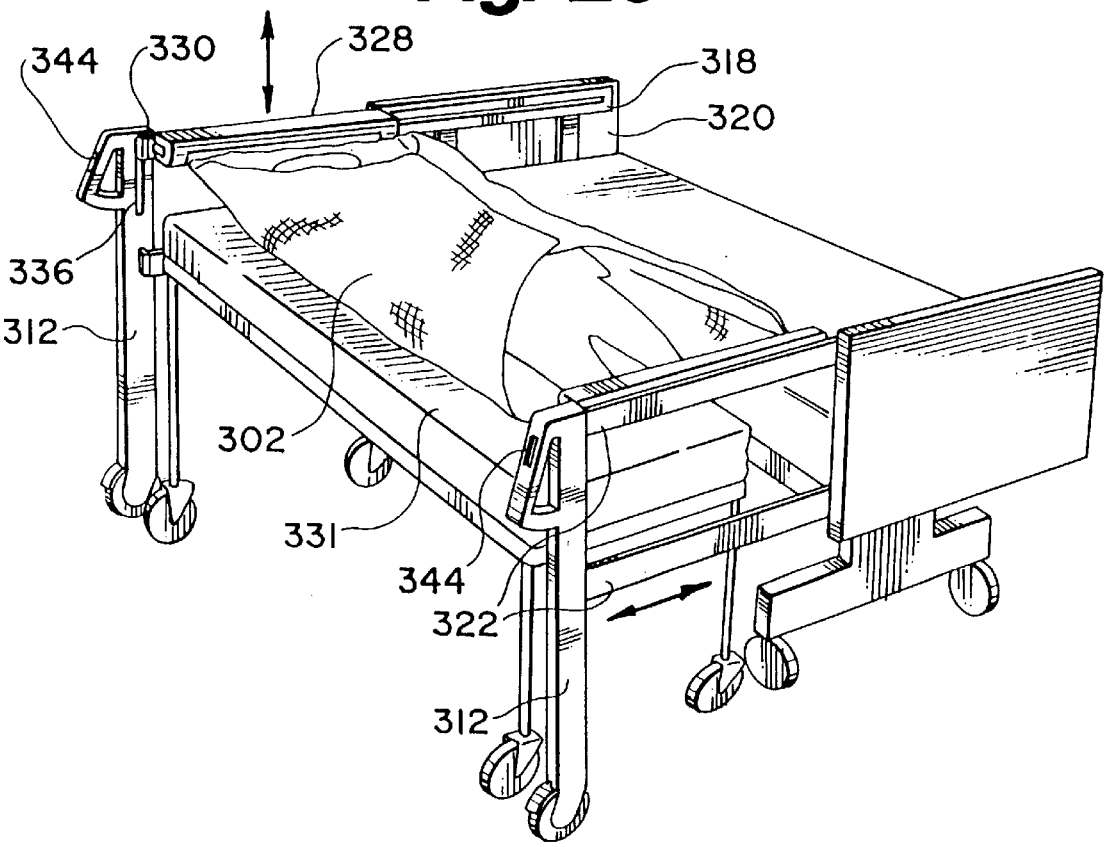
FIG. 20 is a perspective view of the further embodiment of the horizontal transfer system with a patient elevated over a cart to indicate the ranges of motion obtainable by the transfer system.

Referring to FIGS. 19–21, the head frame 306 and foot frame 308 each have at least one expandable horizontal support 316 extending from the vertical supports 312. The expandable horizontal supports 316 have fixed portions 318 that are attached to the head(foot) board or the head(foot) board portion 320 of the head(foot) frame 306 (308). Fixed portions 318 of the expandable horizontal support 316 typically would extend at least across the width of the bed or cart. Telescoping portions 322 of expandable horizontal support 316 are attached to a vertical support 312 and slidably engage a corresponding fixed portion 318. In certain embodiments, the telescoping portion 322 will slide into the corresponding fixed portion 318, although other types of slidable engagement are possible.

Figure 23:
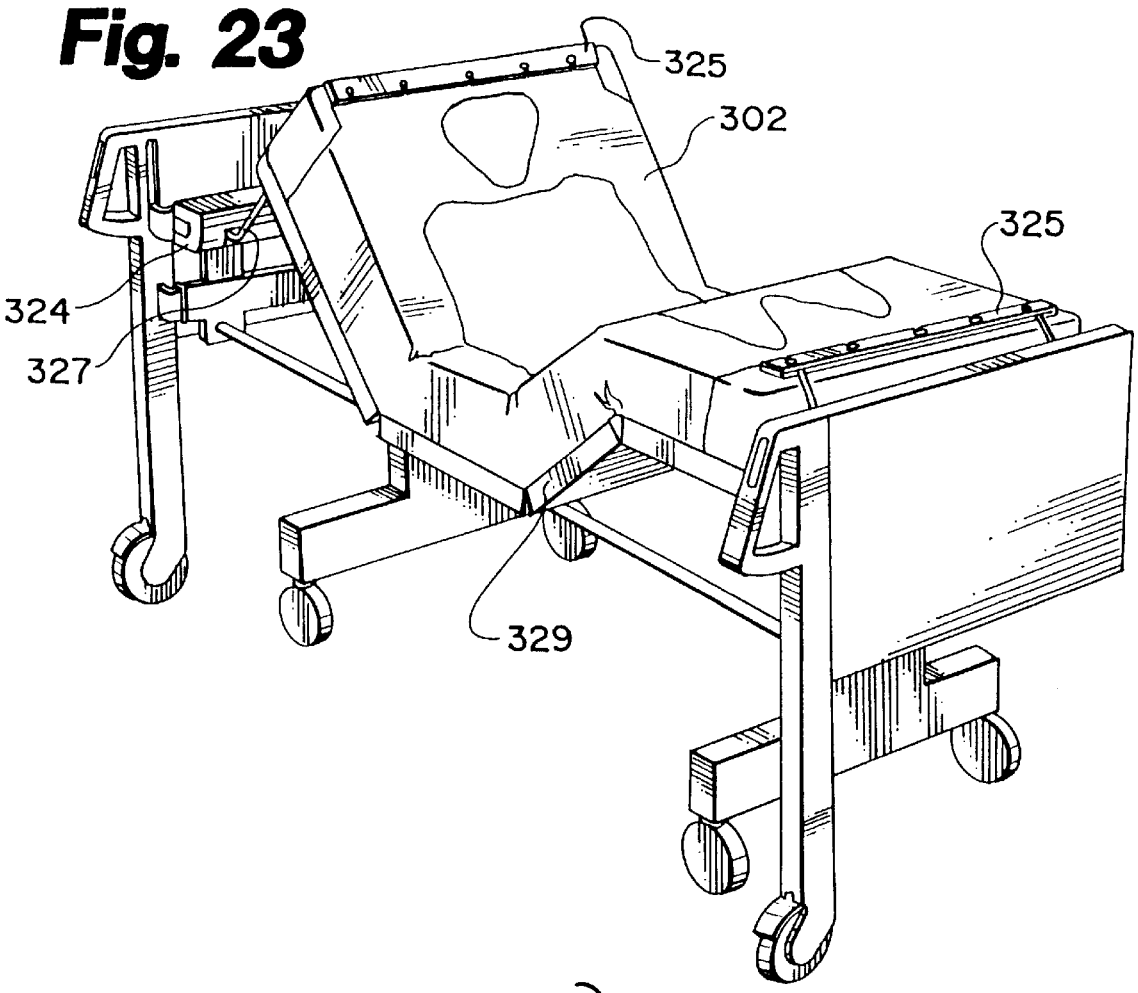
FIG. 23 is a perspective view of a bed equipped with the further embodiment of the horizontal transfer device with the bed in a raised position.
Figure 22:
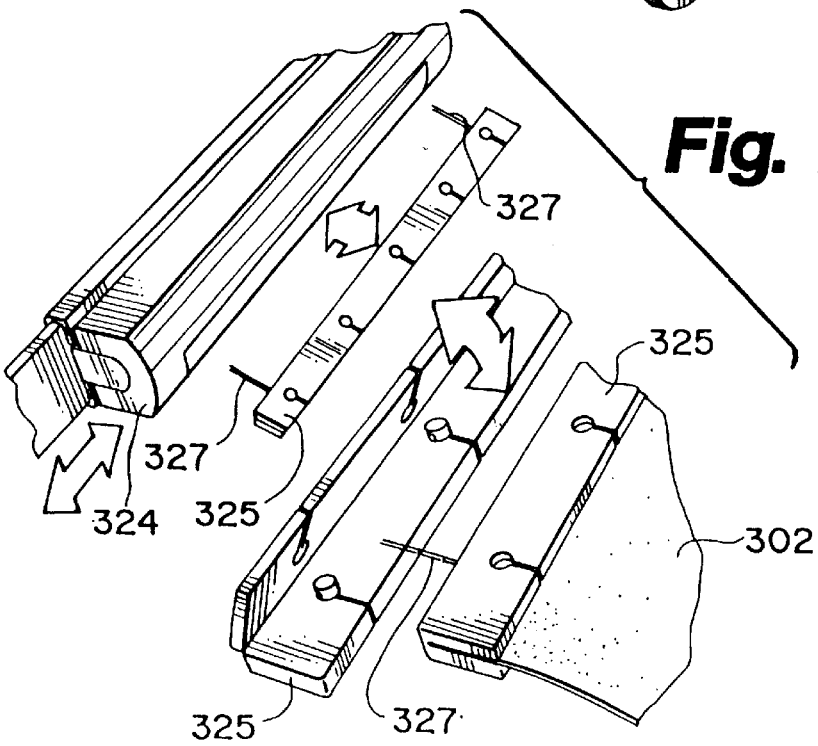
FIG. 22 is a fragmentary perspective view of a sheet clamp indicating its motion relative to a lifting support and its attachment to a transfer sheet.
Figure 26:
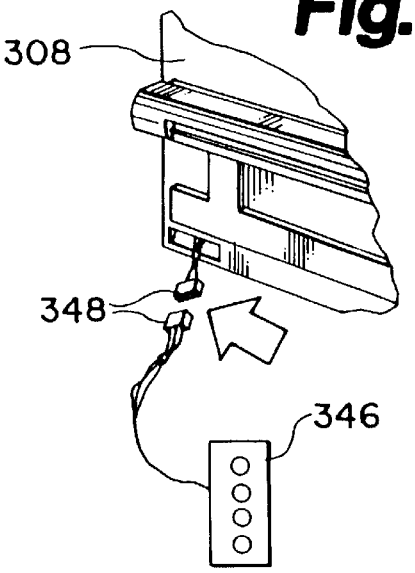
FIG. 26 is a perspective view of a portion of the foot board bed or cart adapted with the further embodiment of the horizontal transfer system indicating a location for the attachment of a control unit.

The head frame 306 and the foot frame 308 each have a lifting support 324. The lifting support 324 is attached in a way such that it moves with the vertical support 312 and the telescoping portions 322. Each lifting support 324 has a gripping portion 328 and generally two lifting portions 330. The gripping portion 328 has an opening 332 into which sheet clamp 325 can be withdrawn using cables 327, as shown in FIG. 22. Sheet clamp 325 can grasp transfer sheet 302. Referring to FIG. 23, cables 327 permit sheet clamps 325 to remain attached to transfer sheet 302 while the mattress support 329 goes through a range of motion. In a preferred configuration, one lifting portion 330 engages vertical support 312 at a slot 336. Another lifting portion 330 engages moving support 338 which is attached to a telescoping portion 322.

The lifting support 324 is capable of a range of vertical motion. The range of vertical motion will typically be between 6 inches and 12 inches. The range of vertical motion gives enough clearance for the horizontal transfer from a first bed/cart to a second bed/cart. In other words, the retrofitted bed/cart 326 with its attached transfer unit 304 can transfer patients from or to the retrofitted bed/cart 326. The vertical lift is also convenient for the changing of linens, although the transfer sheet would need to be changed separately.

Referring to FIG. 19, the drive system 310 includes a horizontal drive system 340 and a vertical drive system 342. The drive system 310 is operated from a control panel 344 (FIGS. 18–20) that is located on vertical supports 312 or a portable controller 346 (FIG. 23) that is patched into the head frame 306 or foot frame 308 through connector 348. Other arrangements for the control of the drive system 310 are possible. The drive 342 for the vertical motion of the lifting support can be adapted to operate by any conventional motor or hydraulic system, such as a motorized worm drive 343.

Two embodiments are shown for horizontal drive system 340 in FIGS. 19 and 21 respectively. The first involves a motor 350 fastened to the bottom of the bed/cart frame 352. The motor turns drive shafts 354 which go to a transmission 356 which transfers the rotation of the drive shaft to lateral motion of a telescoping portion 322 of an expandable horizontal support 316. The second embodiment of the drive system has a motor 358 mounted on either the head frame 306 or the foot frame 308. The motor 358 rotates a worm drive 360 that is mounted horizontally along side of the motor 358. The worm drive 360 transfers motion to a telescoping portion 322 of an expandable horizontal support 316. An optional removable panel 362 can be removed, as shown in FIG. 24 and mounted on the foot frame 308 where it can be used as a shelf or cardiopulmonary resuscitation (CPR) board for additional equipment as shown in FIG. 25.

Figure 27:
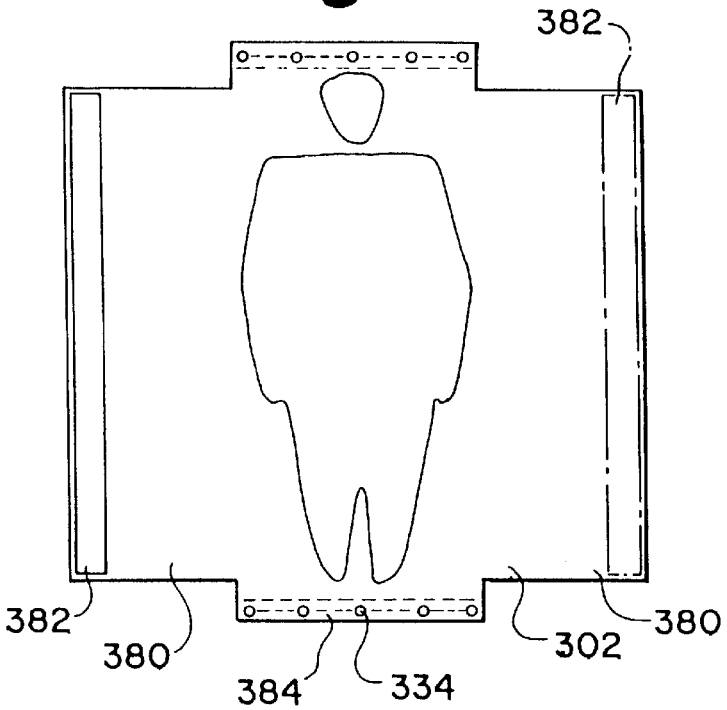
FIG. 27 is a top view of a transfer sheet designed for use with the further embodiment of the horizontal transfer system.
Figure 28:
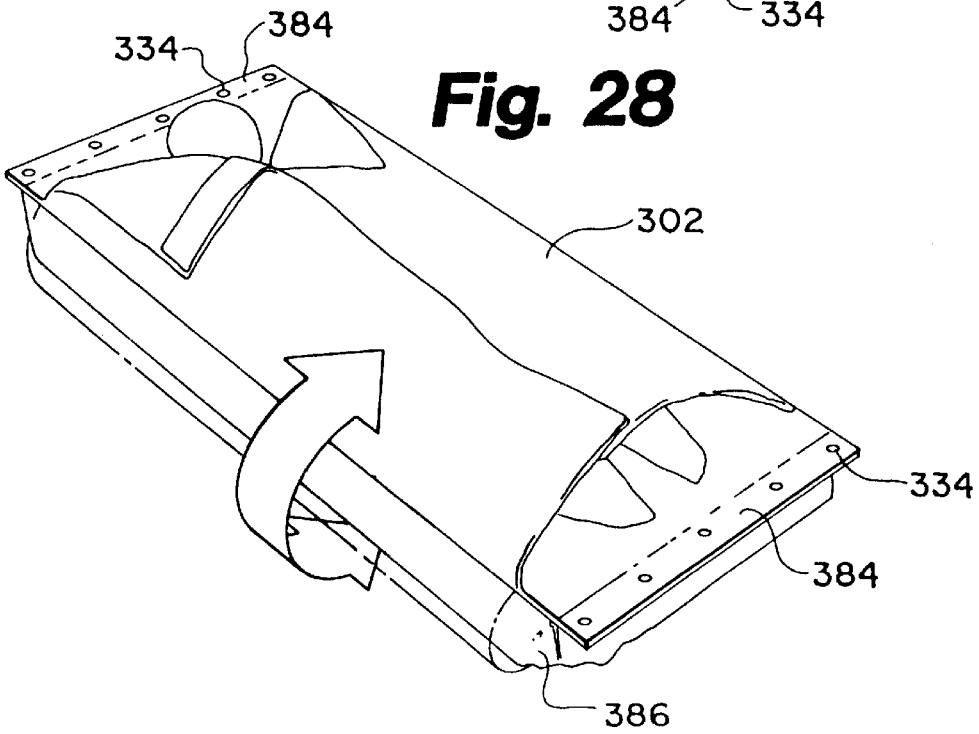
FIG. 28 is a perspective view of the transfer sheet of FIG. 27 shown in its folded position.

An appropriate transfer sheet 302 for use in this embodiment of the horizontal transfer unit 300 is depicted in more detail in FIGS. 27 and 28. The transfer sheet 302 has wings 380 with hook and loop or comparable fasteners 382 at the edges of the wings 380. The wings 380 can be folded over the patient and closed with fasteners 382. The shape of the wings can be selected as desired. The top and bottom of transfer sheet 302 can have reinforced attachment portions 384 optionally with reinforced holes, grommets 334, or other improved attachment means. Alternatively, the sheet can be attached to the sheet clamps 325 similar to the attachment of the sheet to the clamps shown in FIGS. 8–13. Having grommets on the sheet can be a disadvantage during the washing process. The attachment portions 384 will generally extend to or just beyond the end of the mattress 386. Other designs are possible for the sheet, for example a version that does not fold over the patient.

Referring to FIGS. 19 and 20, in operation, the vertical supports 312 and the telescoping portion 320 of horizontal supports 316 are initially placed in their retracted position if the patient is being moved from the retrofitted bed/cart 326 and are initially placed in their extended position if the patient is being moved from a separate bed/cart 327 to the retrofitted bed/cart 326. The transfer sheet 302 is optionally folded over the patient, and the fasteners 382 are secured. Attachment portions 384 are placed into opening 332, and sheet clamps 325 engage reinforced holes 334. At this point, the vertical drive system 342 originally in its lower point is engaged to its upper point to raise the patient into a suspended position.

The horizontal transfer system 300 is engaged accordingly to move the patient from an original location to the transfer location. If the patient was originally on the retrofitted bed/cart 326, the vertical supports 312 and the telescoping portion 320 move to their extended position, and if the patient was not originally located on the retrofitted bed/cart 326, the vertical supports 312 and the telescoping portion 320 move to their retracted positions. Once the horizontal transfer is complete, the vertical drive system 342 is lowered and the transfer sheet 302 is disengaged.

Another embodiment of a patient transfer device 400 is shown in FIG. 29. Head portion 402 and foot portion 404 are similar in construction to head frame 304 and foot frame 306 respectively except that head portion 402 and foot portion 404 lack lifting supports 324 attached to the telescoping portion 320 and have instead top supports 406 which support upper transverse support 408. The upper transverse support 408 provides support to counter the forces from the weight of the patient.

Upper transverse support 408 has transverse tracks 410 on both sides of upper transverse support 408 which support lifting elements 412. Lifting elements 412 have track wheels 414 which rotate within the tracks 410 yielding transverse motion of the lifting elements 412. Lifting elements 412 contain winches (not shown) for retracting cords 416. Cords 416 have fasteners 418 at their ends for attaching to reinforced holes or grommets 420 at the corners of a draw sheet 422. Retraction of cords 416 raises draw sheet 422 which contains a patient secured within the sheet 422.

As shown in FIG. 30, extendable horizontal supports 424 operate similarly to extendable horizontal supports 314 to allow the lateral motion of the vertical supports 426 on wheels 428 along with upper transverse support 408 and lifting elements 412. As with the previous embodiment system 300, the alternative embodiment device 400 can move a patient from the retrofitted bed/cart to a second bed/cart or from a second bed/cart to the retrofitted bed/cart.

Figure 31:
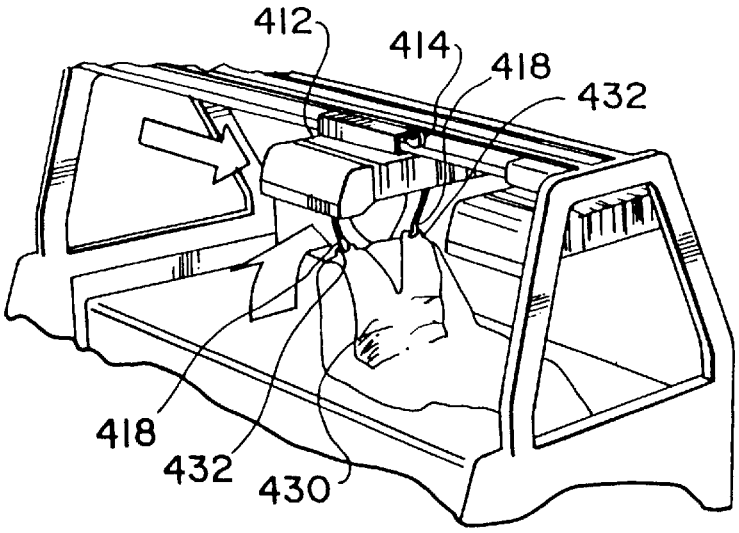
FIG. 31 is a perspective view of the alternative embodiment of FIG. 29 being used to assist a patient to sit up.
Figure 32:
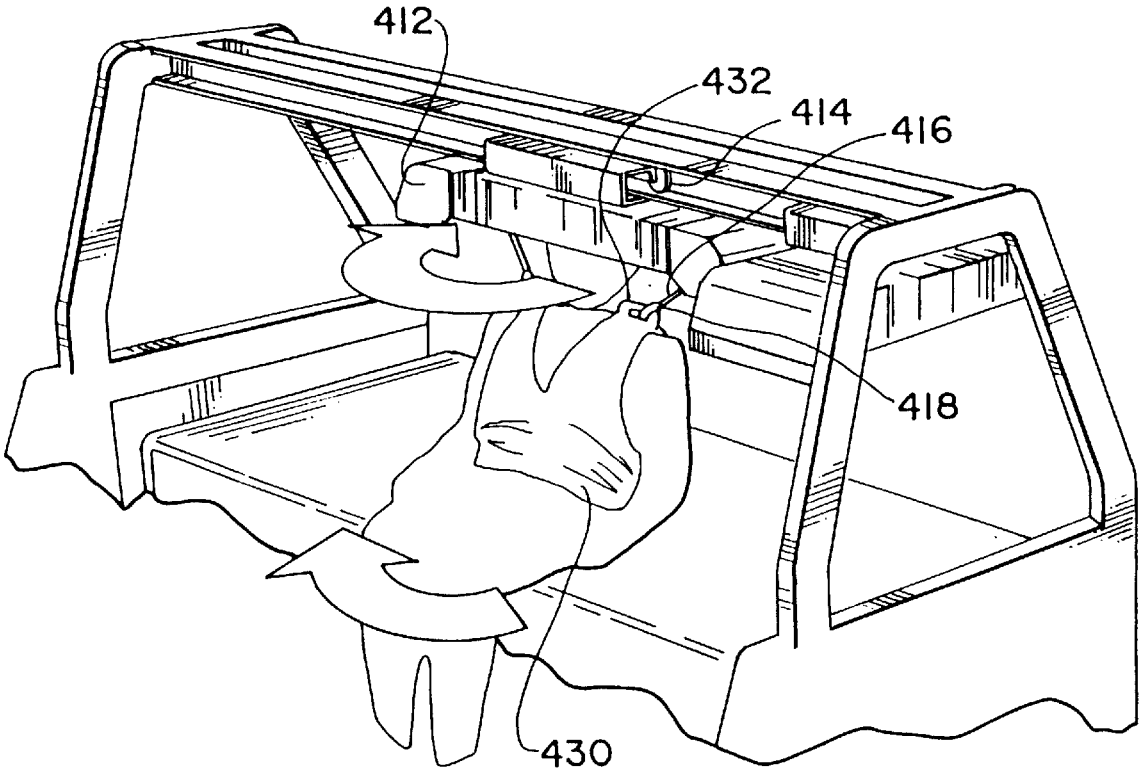
FIG. 32 is a perspective view as in FIG. 31 indicating the rotation of a lifting element.

Alternatively, referring to FIGS. 31–32, a single lifting element 412 can be used along with a lift jacket 430. Lift jacket 430 fits around the torso of a patient. Fasteners 418 attach to loops 432 on lift jacket 430. When attached to a lift jacket 430, retraction of cords 416 lifts the patient's torso off the bed into a bent position at the patient's waist. The lifting element 412 can then be translated and rotated as shown in FIGS. 31 and 32 to place the patient in a seated position at the side of the bed. The patient's back is supported in this position. In this way the horizontal transfer device 300 serves a second purpose in assisting a patient into a sitting position from a supine position on a bed.

Figure 33:
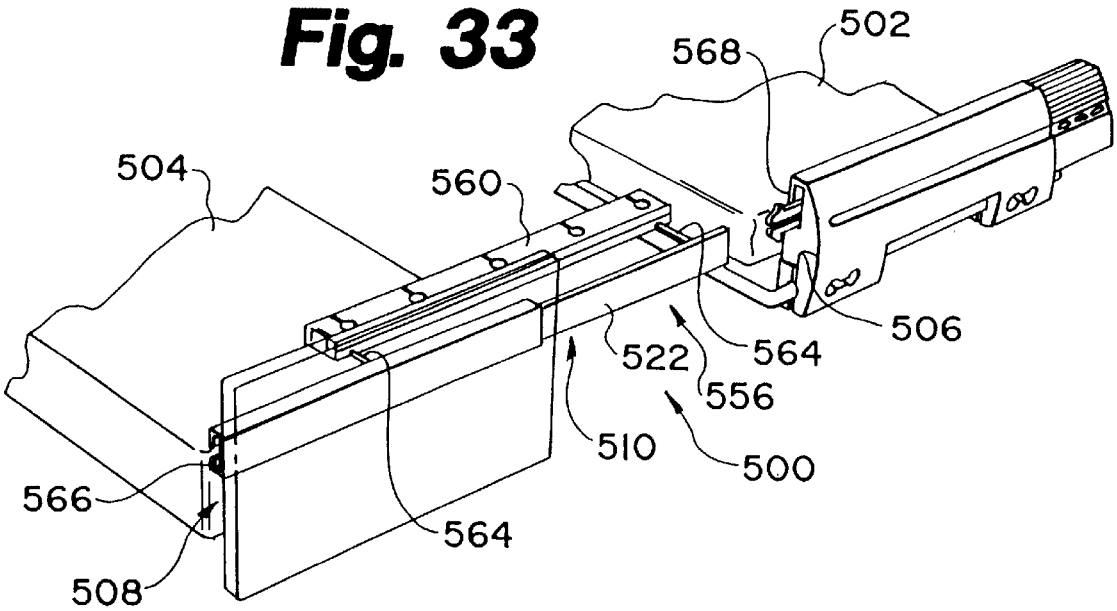
FIG. 33 is a perspective view of a transfer system with a horizontal transfer mechanism.
Figure 34:
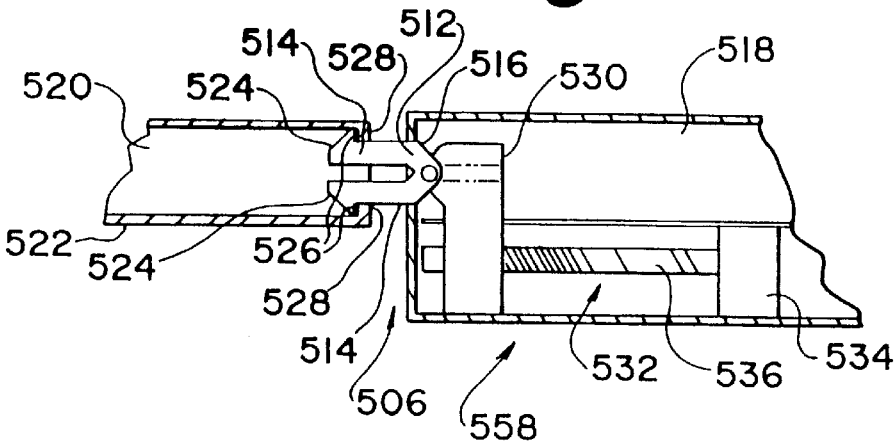
FIG. 34 is a cut away side view of one embodiment of a docking mechanism.
Figure 35:
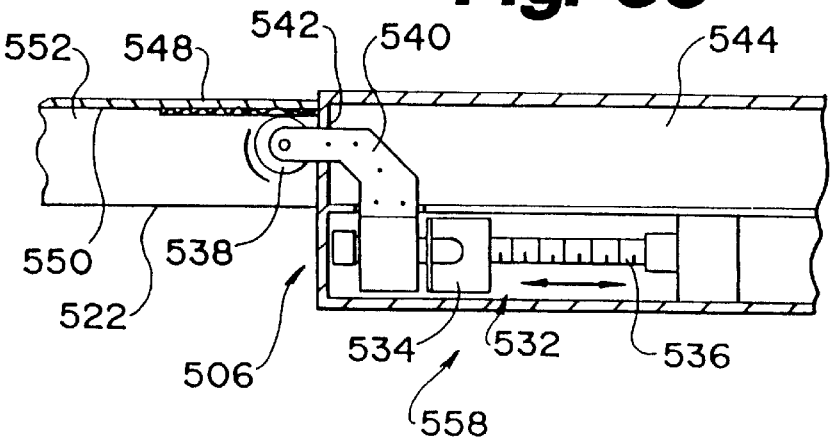
FIG. 35 is a cut away side view of a second embodiment of a docking mechanism.

A transfer system 500 designed for retrofitting of both the bed 502 and the cart 504 is depicted in FIG. 33. The transfer system 500 includes a horizontal transfer mechanism 508 and a transfer bridge 510 (FIGS. 37–41). The horizontal transfer mechanism includes a docking mechanism 506. FIGS. 34 and 35 depict two representative embodiments of the docking mechanism 506. The first embodiment has a spring loaded clamp 512 with arms 514. Arms 514 protrude from an opening 516 at the side of the foot board 518 of bed 502. Spring loaded clamp 512 engages a cavity 520 opening into transfer bar 522. When the angled front edge 524 of the arms 514 engage cavity 520, the arms 514 deflect towards each other against the spring (not shown) other until tips 526 clear flanges 528 at which point the arms return outward as tips 526 engage flanges 528. Arms 514 pivot on a docking support 530 within the bed foot board 518. The head boards (not shown) have a comparable docking mechanism. When the clamp 512 is protruding from opening 516, the arms can be disengaged by pressing arms 514 together.

In the second embodiment of the docking mechanism 506 depicted in FIG. 35, a gear 538 supported by a docking support 540 protrudes from an opening 542 in the side of the bed foot board 544. Protruding gear 538 engages teeth 548 in the top surface 550 of cavity 552 within transfer bar 522. Gear 538 can flex slightly on its support 540 to engage the teeth 548. Cavity 552 within transfer bar 522 does not have flanges at its opening. The gear 538 is disengaged by pressing downward on docking support 540 when docking support 540 is protruding from opening 542. Again, the head boards (not shown) have a comparable docking mechanism.

The two embodiments of the docking mechanisms 506 are described in a particular configuration with respect to the cart and the bed. This configuration can be reversed with the bed holding the protruding gear 532 or clamp 512. In either configuration, the protruding gear or clamp can be retracted by the worm gear drive 532 when docking is being performed.

The horizontal transfer mechanism 508 includes a transfer element 556 and a drive system 558. Transfer element 556 has a gripping mechanism 560 for gripping a transfer sheet such as transfer sheet 302 in FIGS. 27 and 28 and transfer bar 522. The gripping mechanism 560 is attached to transfer bar 522 by a plurality of support bars 564. Gripping mechanism 560 can be similar to sheet clamp 325. Transfer bar 522 moves within cart channel 566 and bed channel 568. Support bars 564 slide within slots 570 and 572 within cart channel 566 and bed channel 568 respectively. The docking supports 530 or 540 can be moved laterally by drive system 558 which can comprise a worm gear drive 532. The worm gear drive 532 has a motor 534 and a worm 536. The rotation of worm 536 moves the docking supports 530 or 540. The motion of the docking supports 530 or 540 moves the transfer bar 522 within channels 566 and 568. The worm gear drive 532 can move the transfer bar 522 in either direction to effect the movement of the patient in either direction.

Figure 41:
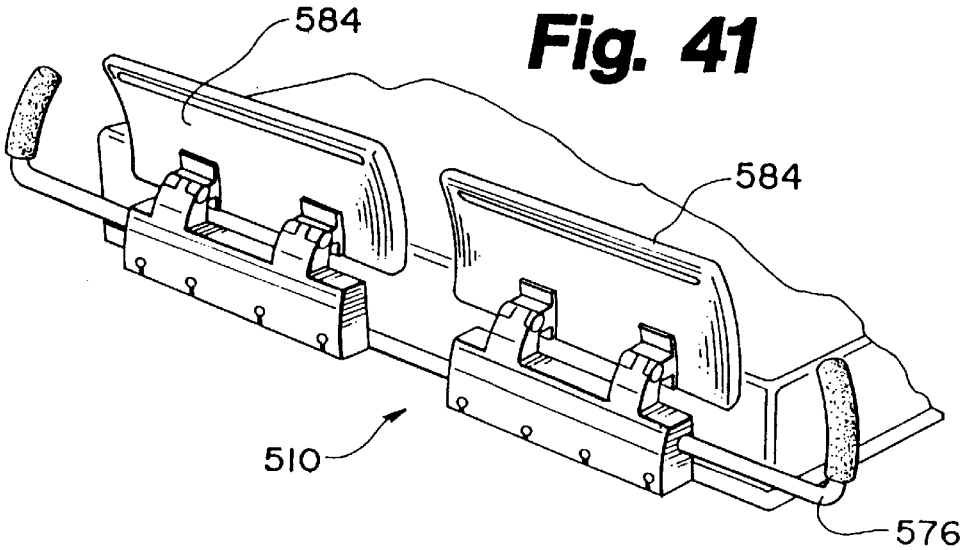
FIG. 41 is a perspective view of a split transfer bridge.

Transfer bridge 510 is mounted on the side of cart 504. Transfer bridge 510 has a bridge 574, lever 576 and mounting portions 578. Bridge 574 is preferably molded from a low friction material such as, for example, polypropylene, to facilitate the passage of the transfer sheet. It is recognized that other low friction materials may also be suitable. Mounting portions 578 are attached to the side of the cart 504 by rods 580. Mounting portions 578 have a hinge 582 which supports bridge 574. Lever 576 passes through mounting portions 578. Rotation of lever 576 changes the configuration of hinges 582 thereby moving bridge 510 between a stored position and a bridge position, as shown in FIGS. 37–40. In the bridge position, bridge 574 fills in the gaps between the bed 502 and cart 504. In the storage position, the bridge 574 acts as a side rail for the cart 504. FIG. 41 depicts a slightly different embodiment of the transfer bridge 510 having a split transfer bridge 584. These embodiments of the transfer bridge can be adapted for use with other transfer systems including the conventional manual transfer system.

Figure 36:
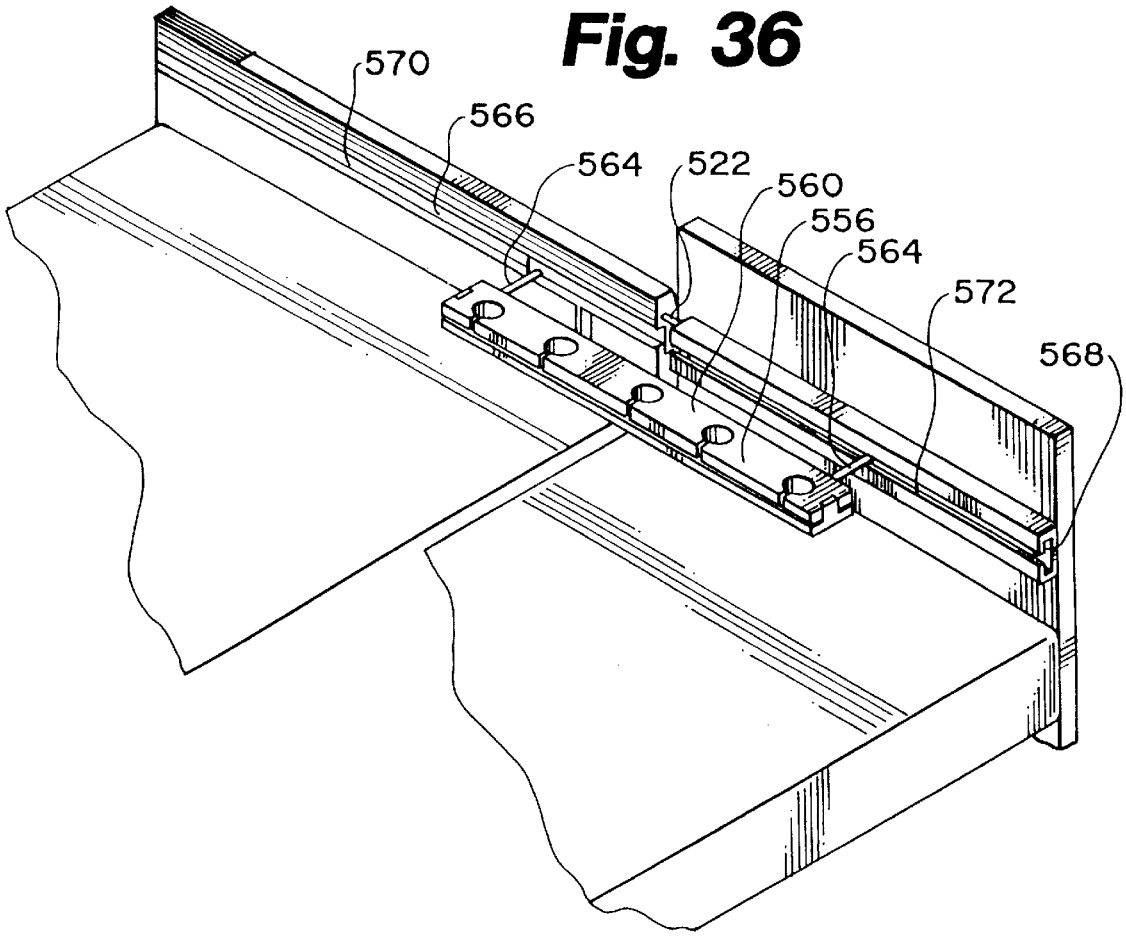
FIG. 36 is a perspective view of the transfer system of FIG. 33 with a transfer element bridging between a bed and a cart.
Figure 37:
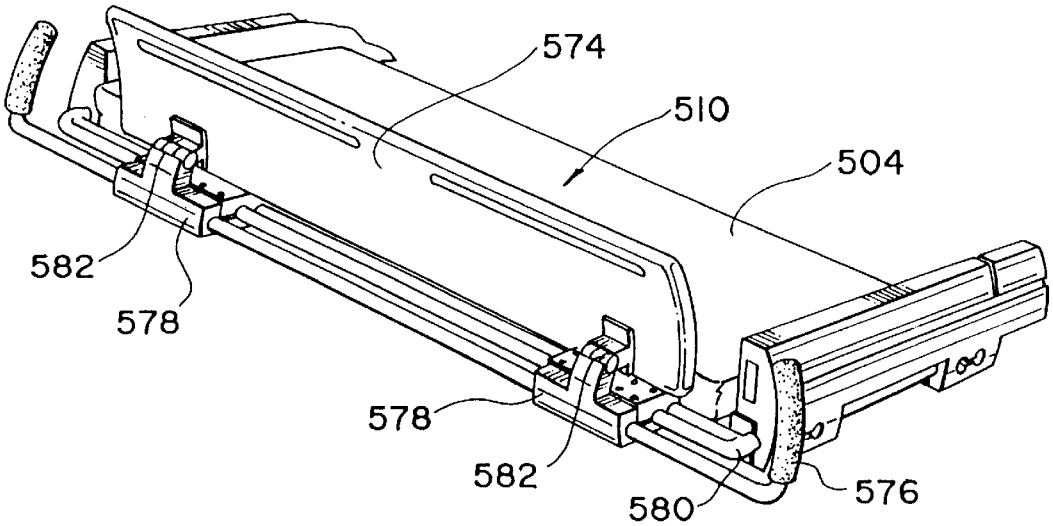
FIG. 37 is a perspective view of a transfer bridge used with the transfer system of FIG. 33.
Figure 38:
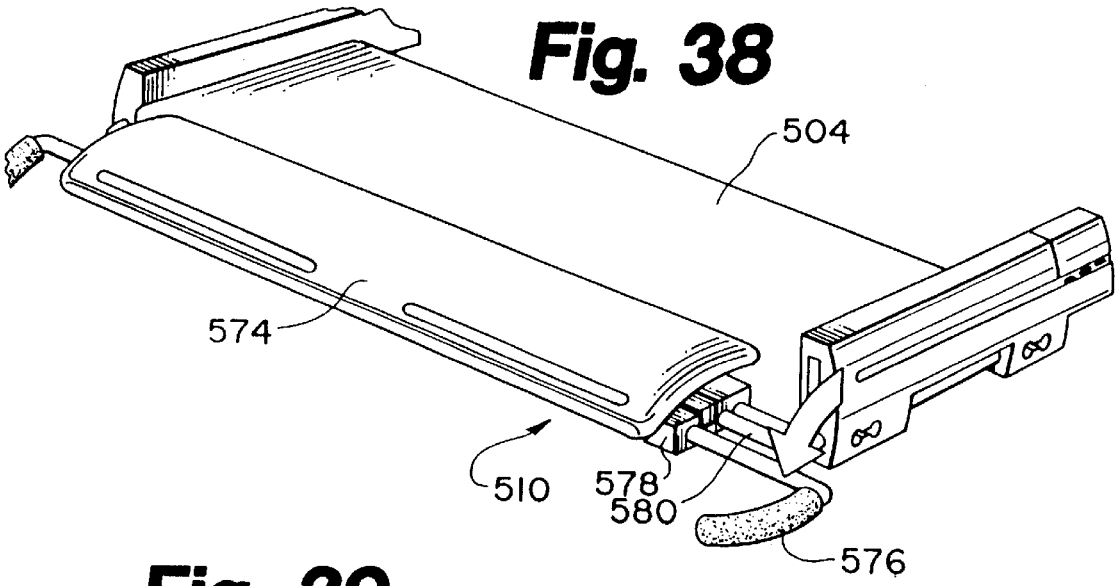
FIG. 38 is a perspective view of the transfer bridge of FIG. 37 with the bridge in the bridging position.
Figure 39:
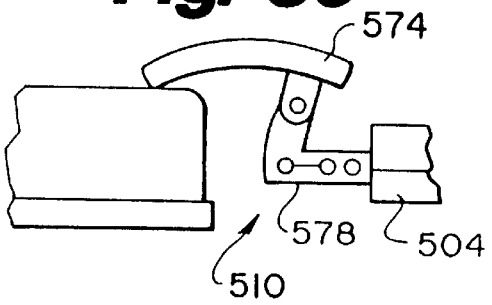
FIG. 39 is a side view of the transfer bridge in the bridging position with lever and rods removed.
Figure 40:
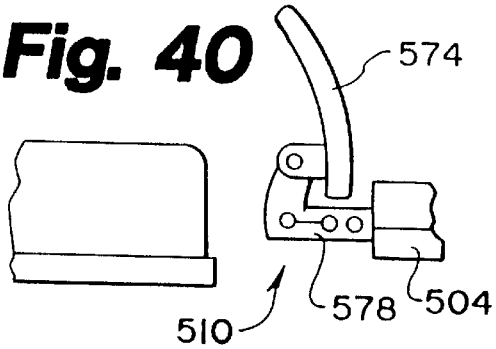
FIG. 40 is a side view of the transfer bridge in the raised position with lever and rods removed.

To transfer a patient between the bed 502 and cart 504, the transfer sheet 302 is attached to the gripping mechanisms 560 at the head and foot of the patient's resting place, similar to the attachment of transfer sheet 302 in the embodiment of FIG. 18. Referring to FIG. 36, the cart 504 and bed 502 are positioned to align channels 566 and 568. Referring to FIG. 38, the transfer bridge 510 is placed in its transfer position to fill the gap between the bed 502 and the cart 504. As shown in FIG. 36, the drive system 558 is engaged to move the transfer element 556 from the bed 502 or cart 504 where the patient was located to the bed 502 or cart 504 where the patient is being transferred. Once the patient is transferred, the cart 504 and bed 502 are undocked, and the transfer sheet 302 is disconnected from the gripping mechanisms 560.

The above transfer systems rely on supporting the patient on some type of sheet during the transfer. While relying on a sheet is similar to often used present methods with health care personnel providing the transfer forces, supporting the patient on a sheet may be inappropriate for patients with certain injuries. For these patients it would be safer to transfer the entire mattress or cushion, as described below.

Figure 42:
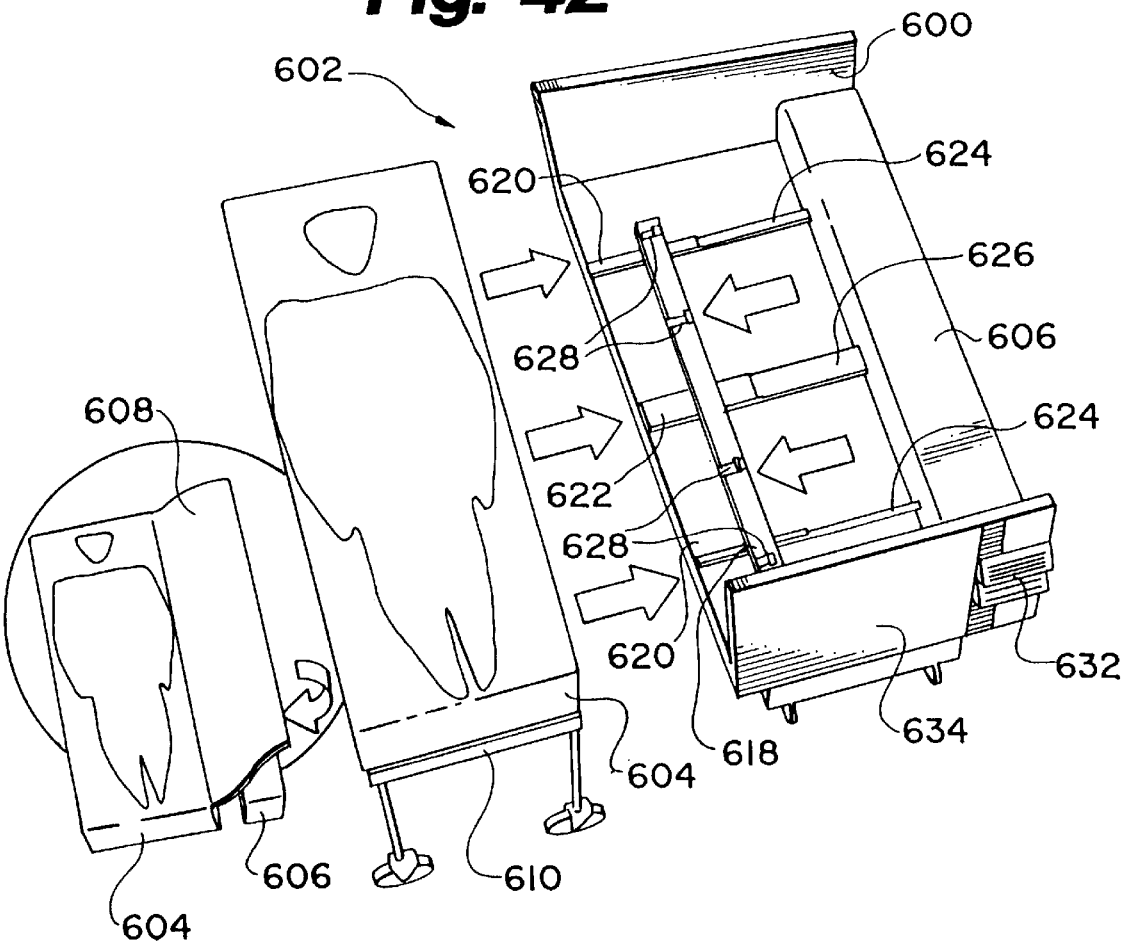
FIG. 42 is a perspective view of a mattress transfer system.
Figure 43:
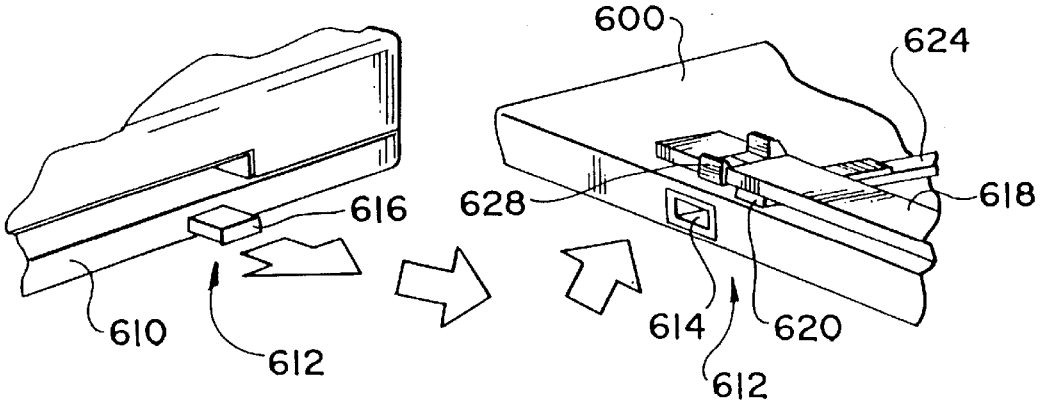
FIG. 43 is a perspective view of a docking mechanism used with the mattress transfer system of FIG. 42.

FIG. 42 displays a bed 600 including a mattress transfer system 602. The bed 600 supports a modular mattress 604 and a fixed cushion 606. The modular mattress 604 has wing 608 of padded fabric that wraps around fixed cushion 606 to form a smooth surface without any gaps, as shown in the insert of FIG. 42. Wing 608 tucks under the modular mattress 604 when not in use. Referring to FIG. 43, bed 600 connects with cart 610 by way of a docking mechanism 612 when the mattress 604 is to be transferred. The docking mechanism 612 has one or more apertures 614 for accepting projections 616. FIG. 43 displays apertures 614 on bed 600 and projections 616 on cart 610, but the opposite arrangement would work similarly. It is possible to have a locking mechanism (not shown) to lock projections 616 in apertures 614 to prevent relative motion of the bed 600 and cart 610 when the modular mattress 604 is being transferred, but the same effect can be accomplished by locking the wheels of the cart 610.

Figure 44:
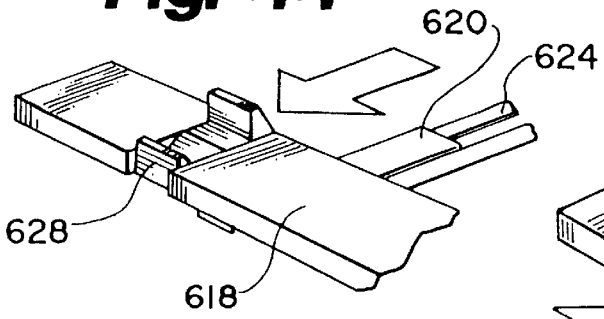
FIG. 44 is a perspective view of a gripping mechanism of the mattress transfer system in pushing position.
Figure 45:
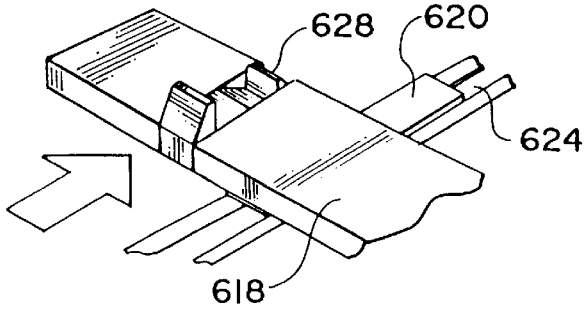
FIG. 45 is a perspective view of a gripping mechanism of the mattress transfer system in pulling position.

In one embodiment, the mattress transfer system 602 has a transverse bar 618 connected to a plurality of lateral bars 620 and at least one lateral drive bar 622. Lateral bars 620 slide along lateral tracks 624 while lateral drive bar 620 engages lateral drive track 626. The lateral bars 620 and lateral drive bars 622 allow the transverse bar 618 to extend just past the edge of bed 600. Transverse bar 618 has a plurality of gripping mechanisms 628. Each gripping mechanism 628 has a pushing position (FIG. 44) and a pulling position (FIG. 45) for pulling and pushing the modular mattress respectively.

Figure 46:
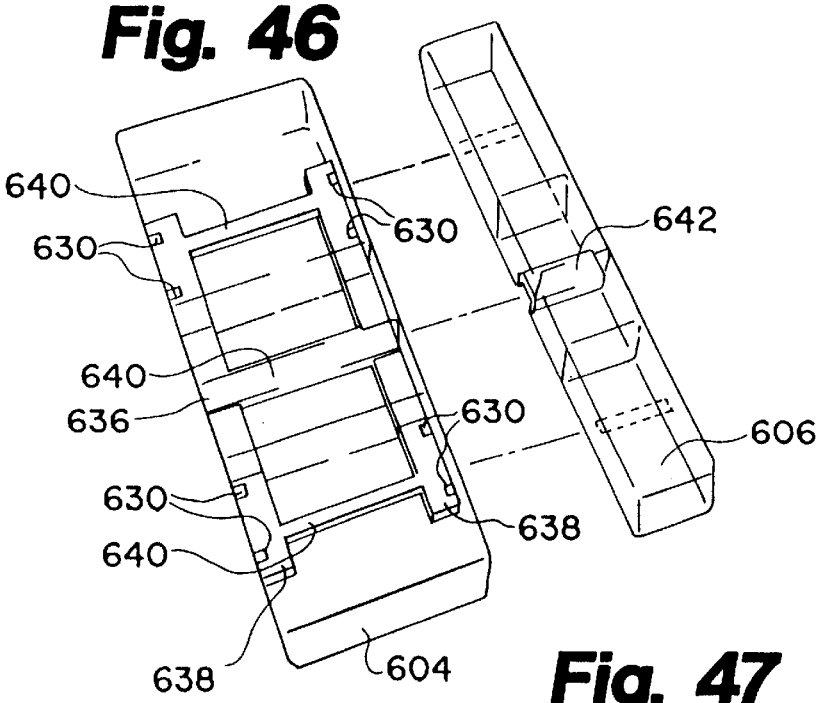
FIG. 46 is an exposed, top perspective view of a mattress and fixed cushion of the mattress transfer system indicating the location of structures within and below the mattress and cushion.
Figure 47:
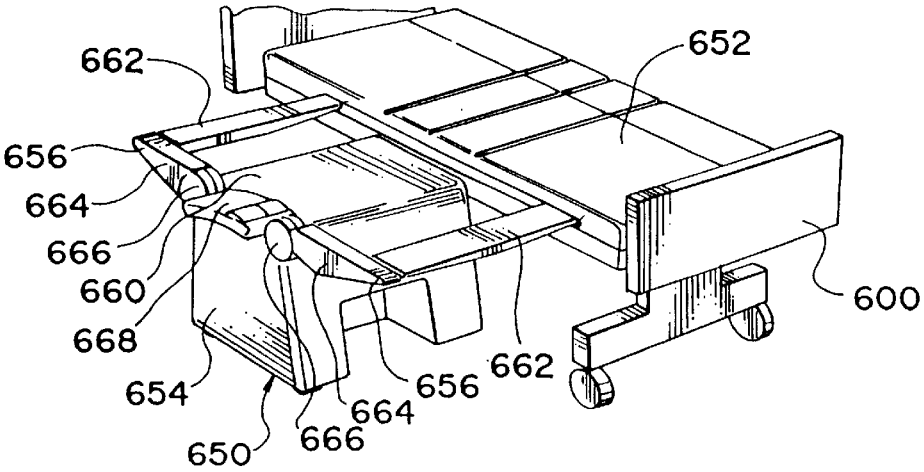
FIG. 47 is a perspective view of a mattress transfer system used with a position changing cart and a folding mattress.
Figure 56:
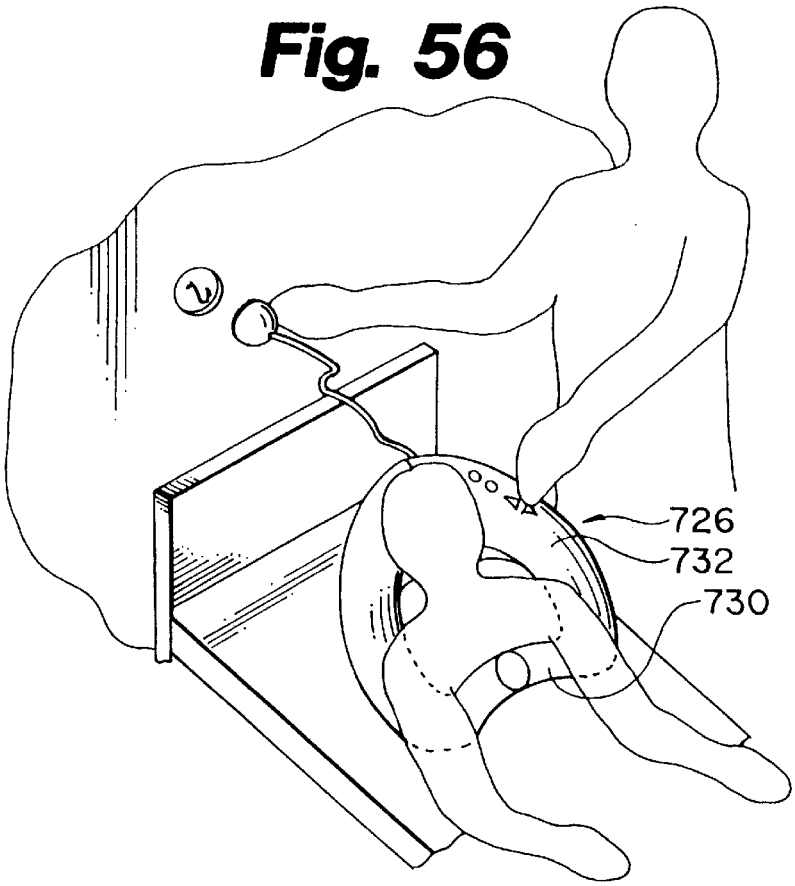
FIG. 56 is a perspective view of a motorized bed jacket being attached to a mount above a headboard.
Figure 58:
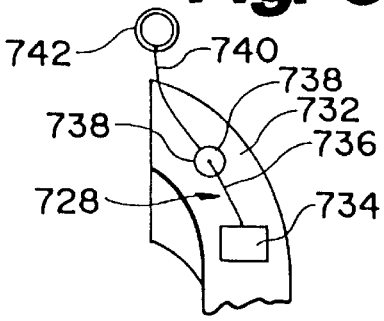
FIG. 58 is a partial cut away view of the drive system of the motorized bed jacket.
Figure 57:
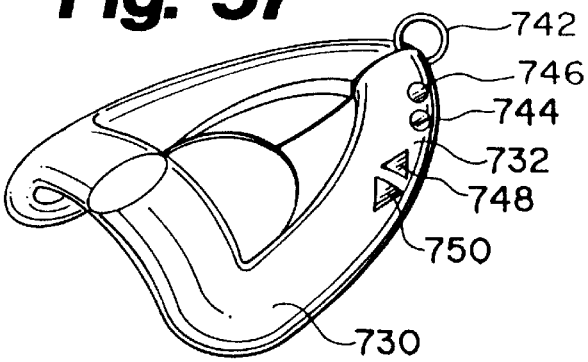
FIG. 57 is a top perspective view of the motorized bed jacket.

Referring to FIGS. 42 and 46, the gripping mechanisms 628 grip handles 630 near the edge of modular mattress 604. The mattress transfer system is controlled from a control panel 632 mounted on the foot board 634, as shown in FIG. 42. Operation of the mattress transfer system 602 moves the transverse bar 618 either toward or away from cart 610 by moving the lateral drive bar 622 accordingly. Of course, a variety of designs are possible for the mattress transfer system 602 besides the embodiment described.

Referring again to FIG. 46, the modular mattress 604 has a channel system 636 to accommodate the transfer system 602. The channel system includes a transverse void 638 to accommodate transverse bar 618 and longitudinal channels 640 to accommodate the lateral tracks 624 and lateral drive tracks 626. Handles 630 are located along the upper surface of transverse void 638. To the extent necessary, fixed cushion 606 may also have appropriate channels 642.

In order to transfer the modular mattress 604, the cart 610 is first docked with bed 600 using docking mechanism 612. If the modular mattress is being moved to the cart 610, the patient is centered on the modular mattress 604, and the gripping mechanisms 628 are set from control panel 632 in their pushing position. The mattress transfer system 602 is operated to move the transverse bar 618 toward cart 610. When the mattress is located on cart 610, the docking mechanism 612 is disengaged.

If the modular mattress 604 is being moved from the cart 610 to the bed 600, the cart 610 and bed 600 are docked appropriately. Then, the transverse bar 618 is placed in its extended position within transverse void 638. The gripping mechanisms 628 are placed in their pulling position. The mattress transfer mechanism 602 is operated to move transverse bar 618 away from cart 610. When the modular mattress 604 is in position on bed 600, the mattress transfer system 602 is stopped, and the docking mechanism is disengaged.

The bed 600 with the mattress transfer system 602 can be adapted to work with a position changing cart 650 when used with a folding mattress 652, as shown in FIGS. 44–47. The position changing cart 650 has a base 654 and a plurality of, preferably two, arms 656. Base 654 has a plurality of locking wheels 658 providing a relatively broad base of support for cart 650. The base should have sufficient weight and a relatively low center of mass such that cart 650 is stable. The top 660 of base 654 provides support for the center of folding mattress 652 when the mattress 652 is positioned on cart 650.

Arms 656 have a support portion 662 and a lever portion 664. Support portions 662 extend laterally toward bed 600 from the far edge of the cart 650. Lever portions 664 are rigidly attached to support portions 662 at one end and are attached to a hinge mechanism 666 at base 654. Support portions 662 support folding mattress 652 when the mattress 652 is positioned on cart 650. The folding drive within base 654 is operated from a control panel 668 at the side of base 654. The folding drive operates to rotate hinge mechanisms 666 to change the configuration of folding mattress 652 from a prone configuration to a seated configuration as in FIG. 49 or visa versa.

When going from a supine to a seated configuration, the lever portion 664 at the head of the mattress 652 rotates upward and the lever portion 664 at the foot of the bed 400 rotates downward. Folding mattress 652 has creases 670 to accommodate the change in configurations. The movement of the folding mattress 652 on and off of position changing cart 650 is analogous to moving the modular mattress 604 on and off of cart 610.

Figure 59:
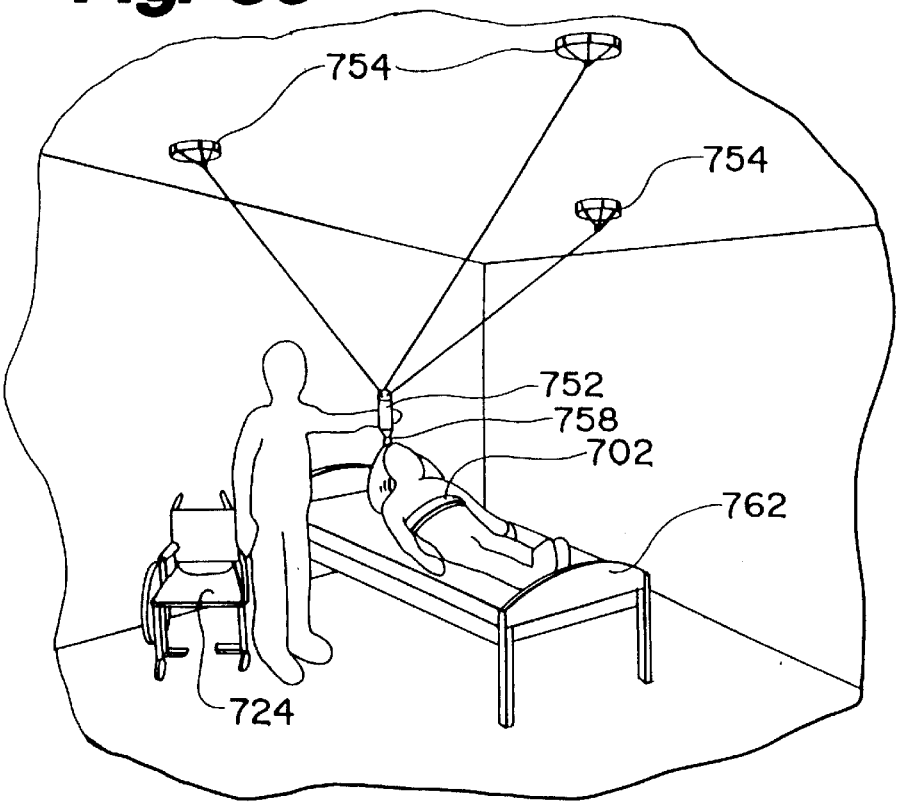
FIG. 59 is a perspective view of a bed jacket attached to three hoisting mechanism on a ceiling using a three way control cylinder.
Figure 60:
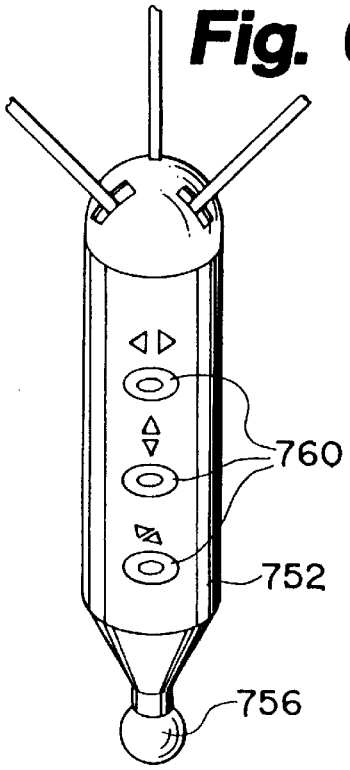
FIG. 60 is a side perspective view of the three way control cylinder.
Figure 61:
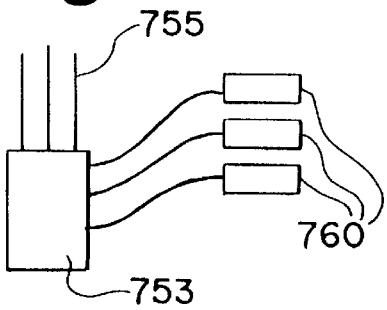
FIG. 61 is a schematic view of the internal components of the three way control it.

The next devices are designed to hoist or pull up a patient on a bed or a chair. These systems are configured with at least one lifting device and at least one winch system. In a first embodiment 700 of the hoist system, the lifting device is a lobster claw shaped bed jacket 702, as shown in FIGS. 59–61. The bed jacket 702 has two claw portions 704 joined at joint 706. Claw portions 704 are, in one embodiment, made of fabric enclosing padding of some kind. Joint 706 involves folds in the fabric that yield greater flexibility at the joint 706. The bed jacket 702 is easy to put on the patient because no part of it fits under the mid-torso of the patient. The lifting forces, however, are distributed across the patient's chest, while the neck is supported by the claw portions.

Claw portions 704 have edges 708 at their ends opposite joint 706. Edges 708 of opposing claws 704 can be joined by a hook and loop fastener 710, with clips (not shown), or other suitable fastener. The edges 708 do not necessarily have to be joined in contact. In use, joint 706 is placed across the patient's chest, and the claw portions are placed under the patient's arms. Edges 708 are joined behind the patient's neck, if desired. If the edges are not joined, they will still be held together by their attachment at their respective ends to the same winch.

Figure 53:
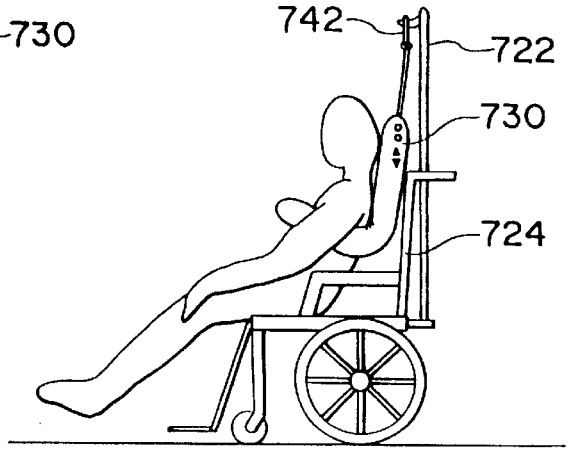
FIG. 53 is a perspective view of a motorized bed jacket attached to a stand above a wheel chair.

Bed jacket 702 can be used with at least two embodiments of the winch system. In a first embodiment of the winch system 712, shown in FIG. 52, the bed jacket 702 has a loop 714 for the attachment of a tether 716. The tether 716 is attached to an external winch 718. Depending on its intended use, the external winch 718 can be attached to a bed's head board 720, located on a support 722 elevated above a bed or wheel chair 724 (FIG. 53) or mounted to a ceiling (FIG. 52). External winch 718 can be operated manually with a hand crank (not shown) or with a motor (not shown) controlled by a control panel.

Figure 54:
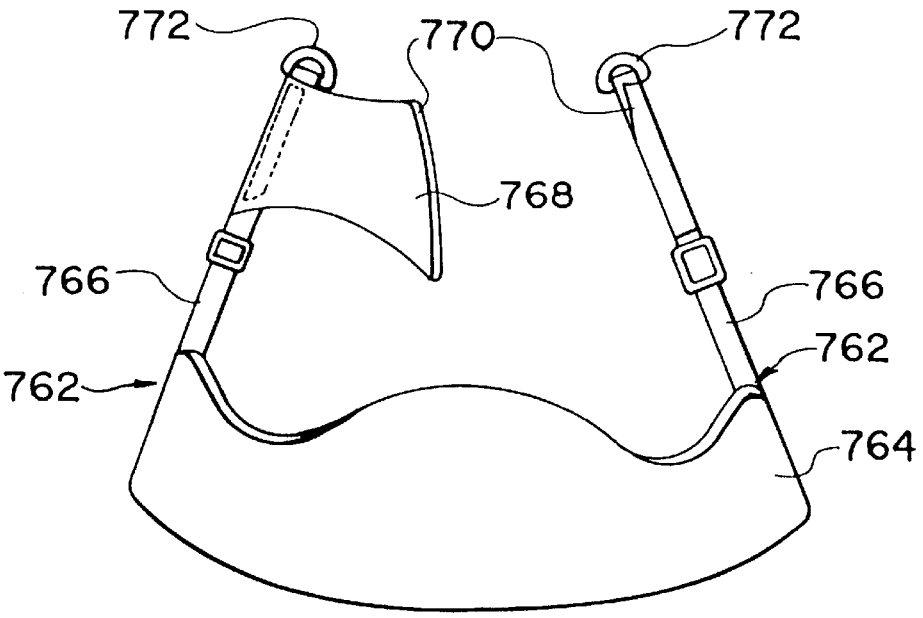
FIG. 54 is a front view of a padded vest.
Figure 55:
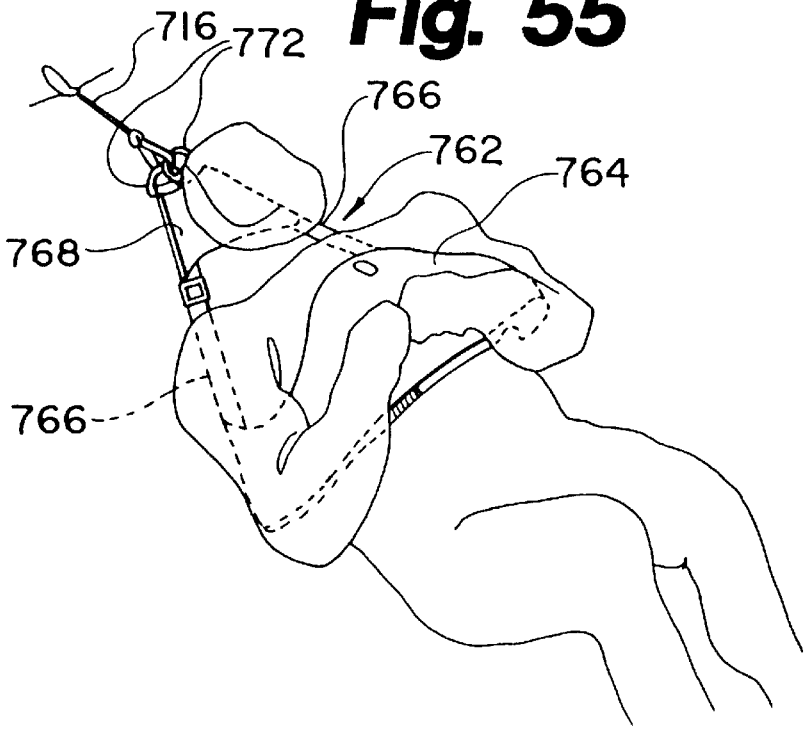
FIG. 55 is a perspective view of the padded vest around a person and attached to a tether where hidden portions of the vest are depicted with phantom line.

External winch 712 can also be used with padded vest 762 shown in FIGS. 54 and 55. The padded vest 762 has the same advantages as the lobster claw bed jacket 702. The padded vest 762 has a foam portion 764 that fits across the user's chest. Two adjustable straps 766 extend from the foam portion 764. One strap 766 has a head support 768 attached. The free end of the head support 768 is attached with a hook and loop fastener 770 or a comparable fastener to the other strap 766. Rings 772 attached to the end of straps 776 attach the vest 764 to a tether 716 for connection to a winch 718.

A second embodiment of the winch system 726 has a winch mechanism 728 within the bed jacket 730 itself, as shown in FIGS. 53, 56–58. The winch mechanism 726 is preferably motorized. The winch mechanism 728 is embedded in one of the claws 732 of the bed jacket 730, although the winch can be imbedded in other designs of bed jackets. The preferred winch mechanism 728 has a motor 734 which rotates a drive shaft 736 connected to a spool 738. Tether 740 is attached to spool 738 and has a ring 742 on its end.

Controls which can be found on claw 732 include a release switch 744, a recoil switch 746, a pull switch 748 and a lower switch 750. The release switch 744 releases the spool 738 so that the tether 740 can be pulled from bed jacket 730. The recoil switch 746 winds up tether 740 on spool 738 using a spring mechanism (not shown) assuming that there is little resistance on the tether 740. The pull switch 748 activates the motor 734 to wind tether 740 on spool 738, and the lower switch 750 runs the motor 734 in the opposite direction releasing tether 740 from spool 738. Optionally, the controls may be placed external to the bed jacket such as in a remote control unit or mounted to the bed. The external control units would communicate with the winch mechanism 728 either through a wired or wireless (transmitter/receiver) communication similar to the control unit for the embodiment in FIGS. 15 and 16.

The ring 742 can be attached to a head board, an elevated support on a wheel chair or a ceiling mount such that the motorized bed jacket 730 can be used in the same way as the non-motorized counterpart. The winch bed jacket combination 730 is more versatile because it can be used in a variety of ways without the need for having a variety of separate winches. Furthermore, the controls are conveniently located such that the health care worker can operate the controls while being close enough to the patient to assist in their motion.

Finally , bed jacket 702 can be connected by way of a three axis control cylinder 752 to three ceiling mounted winches 754, as shown in FIGS. 59 and 60. The control cylinder 752 connects to bed jacket 702 by way of ball 756 which fits into a ball joint 758. Control cylinder 752 has three switches 760 controlling motion along one of three axes. Referring to FIG. 61, the switches 752 are connected to a microprocessor 753 which has been preprogrammed with the locations of winches 754. The microprocessor 753 uses simple geometry to calculate instructions used to control winches 754 to perform the selected motions. Microprocessor 753 is connected to winches 754 by way of wires 755. This versatile system can be used in a variety of ways including transferring a patient from a bed 762 to a wheel chair 764 or pulling a patient up in either a bed 762 or a wheel chair 764. Padded vest 764 can also be used with a three axis control cylinder 752.

Figure 62:
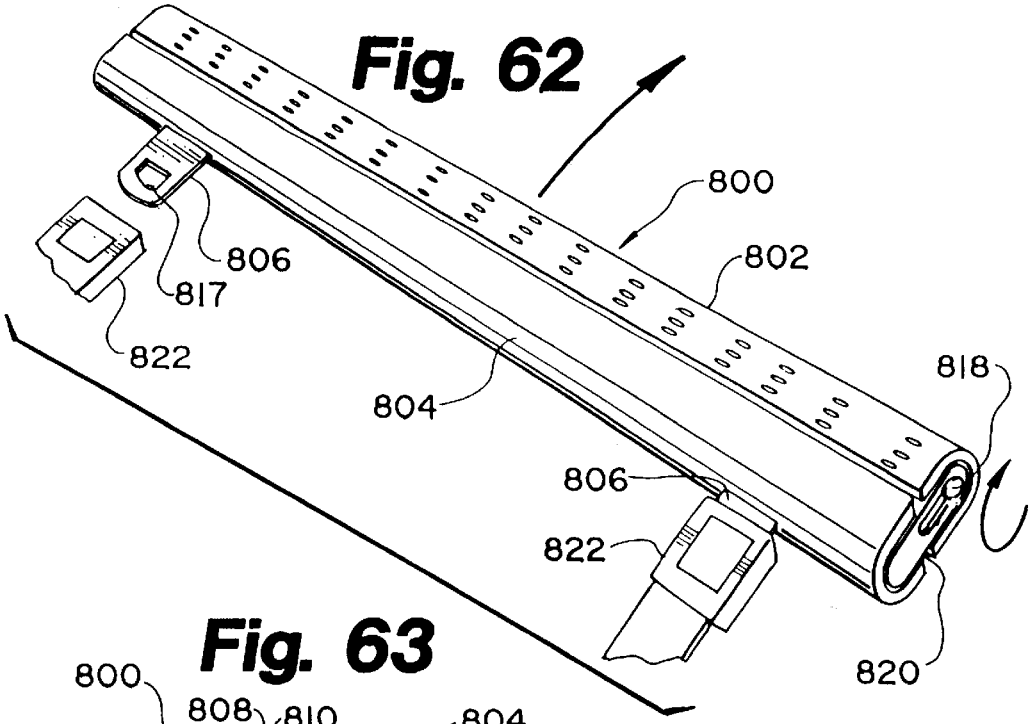
FIG. 62 is a top right perspective view of another clamp embodiment of the present invention.
Figure 63:
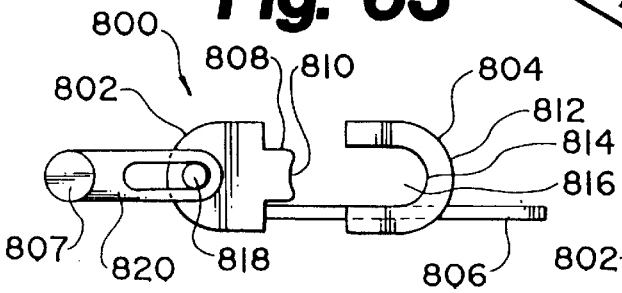
FIG. 63 is a side plan view of the clamp of FIG. 62, in an open position.
Figure 64:
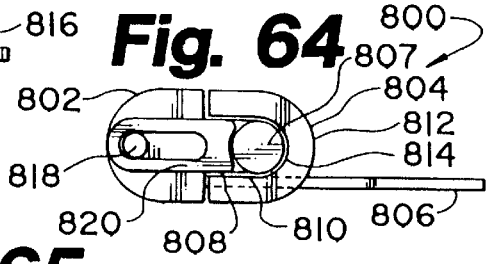
FIG. 64 is a side plan view of the clamp of FIG. 62 in a closed, locked position.

FIGS. 62–95 relate to features of a portable patient transfer system. The system design, and each component thereof, is consistent with the patient care and health care injury reduction goals stated above. Referring to FIGS. 62–64, an engaging mechanism 800 is shown. Engaging mechanism 800 is designed for engaging or clamping a sheet bearing a patient. Engaging mechanism 800 includes forwardly opening element 802, arcuate engaging element 804, belt engaging element 806 and cylindrical member 807. Elements 802, 804 are ideally elongated with a length of at least greater than about 60 centimeters and preferably at least about 100 centimeters (cm). Element 802 has an interiorly disposed movable extension 808. A laterally disposed edge, such as convex edge 810, is present on extension 808. Arcuate engaging element 804 has exterior surface 812 and interior surface 814. Interior surface 814 defines cavity 816. A plurality of belt engaging elements 806 are affixed to element 802 and extend through engaging element 804. Disposed exterior to engaging element 804 on belt engaging element 806 is at least one engaging slot 817. Disposed on each end of element 802 is pivot means 818. Slidingly and rotatingly affixed about pivot means 818 is pivoting member 820. Pivoting member 820, in turn, is rigidly affixed to portions of cylindrical member 807. The exterior surface of cylindrical member 807 may be smooth or ideally present a roughened surface to enhance gripping. A rubberized or tacky substance may be present on the surface of cylindrical member 807, or other means to either enhance gripping may be present using either a surface area increase or greater gripping features of the existing surface area. Also, a plurality of biasing springs or other biasing means (not shown) are optionally disposed within engaging mechanism 800.

Functionally, elements 802, 804 of engaging mechanism 800 are biased away from each other by means of biasing springs (not shown). When a user desires to place a transfer sheet within engaging mechanism 800, the user first wraps a portion of the transfer sheet around cylindrical member 807. Subsequently, cylindrical member 807 is pivoted proximate convex interior surface 810. Elements 802 and 804 are then forced toward each other by the user, thereby extending engaging slot 817 on belt engaging element 806 away from element 804. When elements 802, 804 are in a closed position, cylindrical member 807 and the portion of the transfer sheet wrapped around cylindrical member 807 are totally enclosed within clamp 800. Finally, engaging slot 817 is sufficiently distant from element 804 for belt buckle 822 to firmly latch onto belt engaging element 806. Belt buckles 822, when firmly attached onto engaging element 806, thereby hold elements 802 and 804 in a closed position, simultaneously enclosing cylindrical member 807 therein and exerting a gripping force on the portion of the transfer sheet enclosed. When a patient is being transferred, a transfer force is exerted on belt engaging elements 806 further forcing elements 802 and 804 toward each other and thus exerting an additional, or further, gripping force on the transfer sheet disposed therein.

Figure 65:
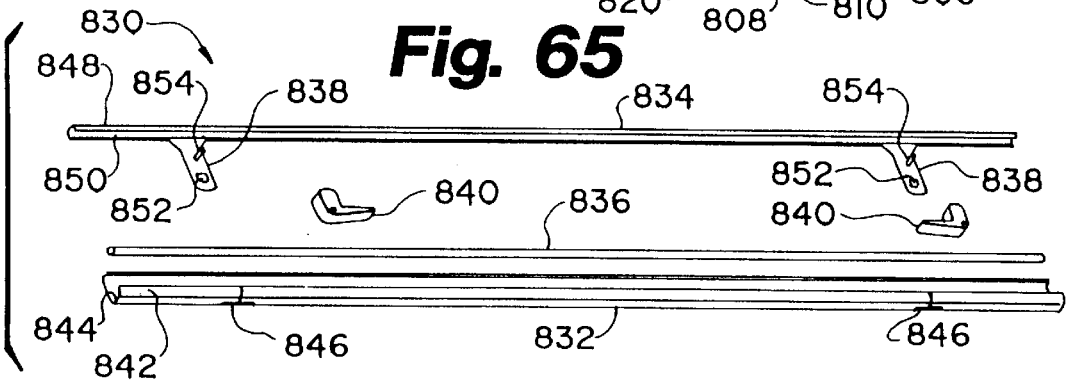
FIG. 65 is a top perspective view of another clamp embodiment of the present invention, the clamp disassembled and depicted in an exploded view.
Figure 66:
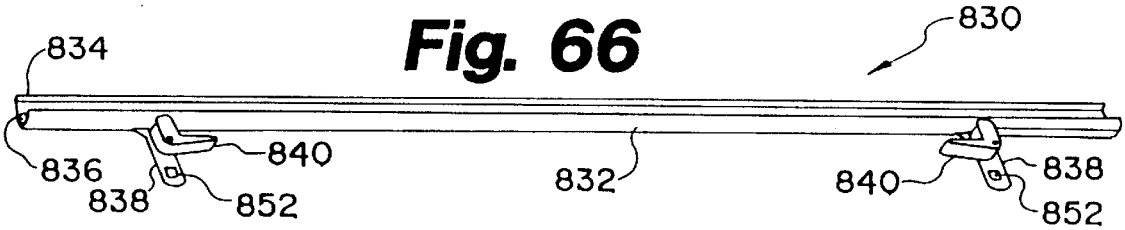
FIG. 66 is a top perspective view of the clamp of FIG. 65 assembled.

As shown in FIGS. 65 and 66, clamp 830 is another embodiment of the present invention. Clamp 830 includes large U-channel member 832, small U-channel member 834, cylindrical member 836, a plurality of belt engaging elements 838 and a plurality of cams 840. Large U-channel member 830 includes outer surface 842, inner surface 844 and a plurality of slots 846, each slot 846 optionally configured with a horizontal and a vertical dimension. Small U-channel member 834 includes outer surface 848 and inner surface 850. U-channel members 832, 834 are at least about 60 cm and preferably greater than about 100 in length. Cylindrical member 836 has a radial circumference sufficient to enable cylindrical member 836 to fit within the confines of inner surface 846 with a transfer sheet wrapped therearound. Preferably cylindrical member 836 has a length substantially the same as U-channel members 832, 834. The outer surface of cylindrical member 836 may be smooth, but is preferably somewhat rough to facilitate gripping, as described above. Belt engaging elements 838 are rigidly affixed to, and extend from, small U-channel member 834. Disposed on each belt engaging element 838 is an engaging means 852 as part of a cam attachment element 838.

Functionally, a transfer sheet (not shown) is wrapped around cylindrical member 836. Cylindrical member 836 and the enwrapped sheet is disposed proximate inner surface 850 of small U-channel member 834 adjacent belt engaging element 838. Belt engaging elements 838 are then passed through slots 846. Large U-channel member 832 and small U-channel member 834 are forced toward each other until cylindrical member 836 and the enwrapped sheet contact inner surface 844 of large U-channel member 832. At this point, the vertical notch component of slots 846 has served as a passageway for cam attachment elements 854. Cams 840 are then configured so as to lock members 832 and 834 together. Belt buckles or equivalent attaching means (not shown) are then affixed to belt engaging elements 838. As in previous embodiments, when a transfer force is exerted on clamp 830, members 832 and 834 are further forced together, thereby exerting an additional, or further, gripping force on the transfer sheet disposed therein. Clamps 800 and 830 are preferably made from resilient, rather stiff materials. Materials suitable would be various gauges of metal or synthetic resins. Buckle mechanisms, similar to those commonly used in automobiles, as well as the belts attached thereto, are possible for use as one embodiment of attaching means of the present invention.

Figure 67:
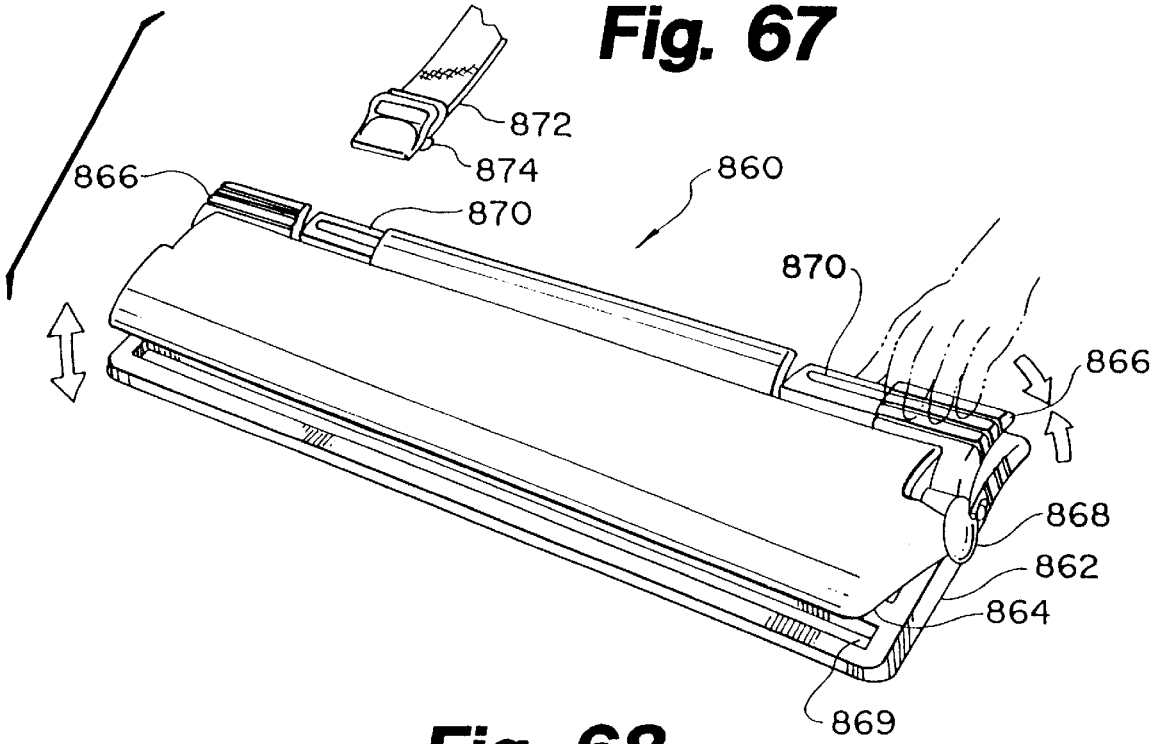
FIG. 67 is a top plan view of another clamp of the present invention.
Figure 68:
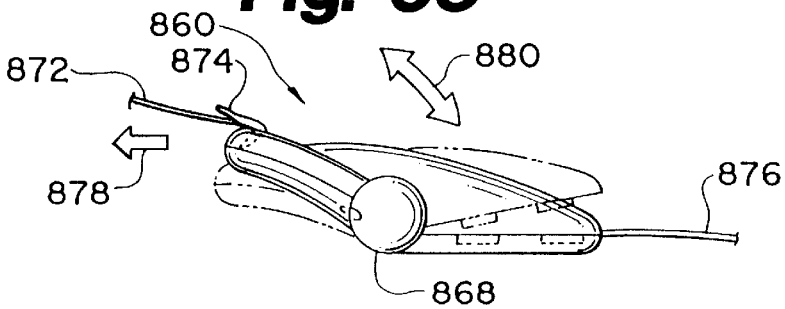
FIG. 68 is a side plan view of the clamp embodiment of FIG. 67.

Clamp 860, depicted in FIGS. 67 and 68, includes base member 862, pivoting upper member 864, two locking levers 866, locking mechanism 868 and a plurality of belt attachment sites 870. Pivoting upper member 864 pivots onto base member 862, with a pivot site at the base of member 864 and coincident with locking mechanism 868. A rubberized substance 869 or other material with increased tack is preferably present on the inner surfaces of base member 862 and upper member 864. A pair of locking levers 866 is present atop base member 862 and proximate the pivotal end of pivoting upper member 864. Locking mechanism 868 cooperates with locking levers 866 to secure pivoting upper member 864 in a locked position. Ideally, pivoting upper member 864 is biased in an open position by such means as a leaf or helical spring. Ideally two belt attachment sites 870 are disposed adjacent to each locking lever 866.

In practice, a portion of a transfer sheet (not shown) is disposed between base member 862 and pivoting upper member 864. Alternatively, the transfer sheet may be wrapped around a cylindrical element or other suitable member, and then placed between base member 862 and pivoting upper member 864. Pivoting upper member 864 is then pressed toward base member 862 until locking mechanism 868 locks, thereby securing base member 862 and pivoting upper member in a closed, locked position with the transfer sheet gripped securely therewithin. Alternatively, pivoting upper member 864 and locking levers 866 may be mechanically connected by a linkage or lever combination in which locking lever 866 is pressed down by a user, thereby forcing pivoting upper member 864 down until locking mechanism 868 securely locks base member 862 and pivoting member 864 in closed contact. Finally, belt or strap 872 is affixed to clamp 860 by disposing hook 874 within the slots located at belt attachment sites 870.

As depicted in FIG. 68, when transfer sheet 876 is secured within clamp 860, base member 862 and pivoting upper member 864 are in a closed and locked position, and belt 872 is retracted away from transfer sheet 876, a transfer force is exerted onto transfer sheet 876 in the direction of arrow 880. Due to the upper placement of belt attachment sites 870 and the angular configuration of the bottom portion of clamp 860, a pivot point is thereby formed proximate locking mechanism 868. This transfer motion, thereby, tends to pivot upper member 864 upwardly and the portion of clamp 860 proximate hook attachment site 870 downwardly, thus rotating clamp 860 about the pivot point located proximate locking mechanism 868 and as indicated in arrow 880. The angular orientation of the portion of transfer sheet 876 secured within clamp 860 relative to the remainder of transfer sheet 876 exerts a further gripping force thereon.

Figure 69:
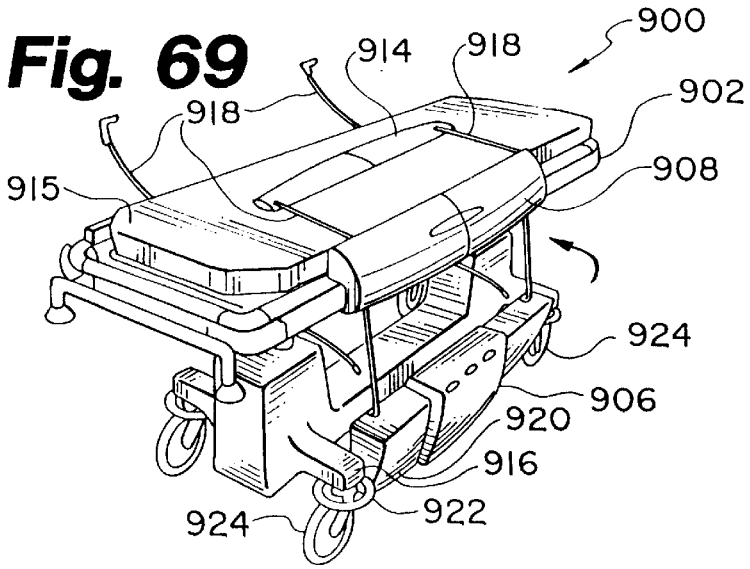
FIG. 69 is another embodiment of the transfer system of the present invention, whereby a patient may be bidirectionally transferred without the necessity of reinstalling this embodiment on another bed or cart.
Figure 70:
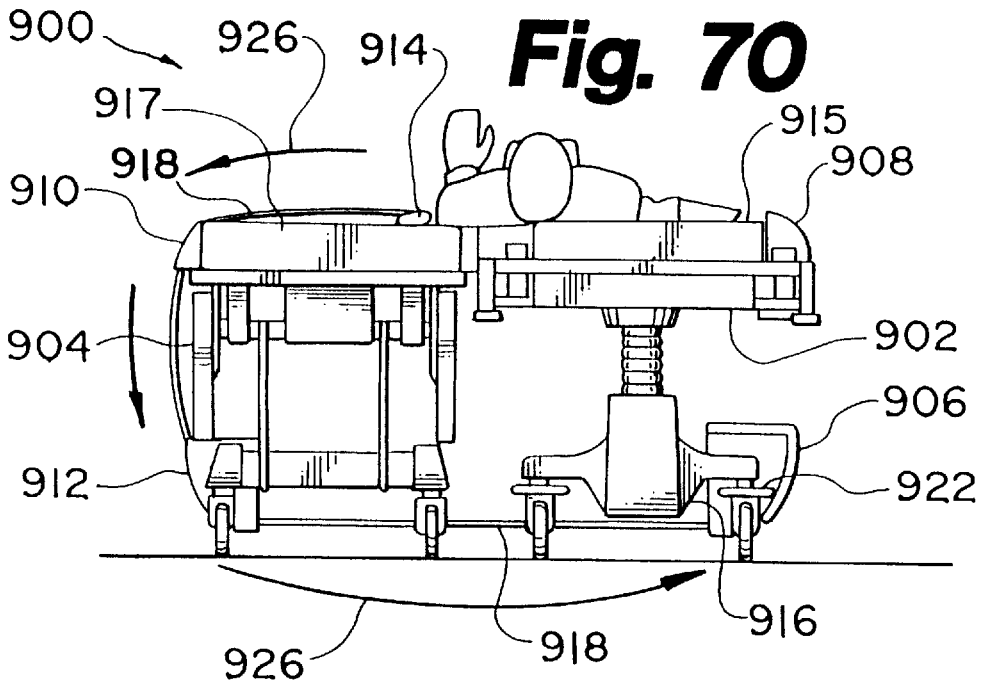
FIG. 70 is a side plan view of the embodiment of FIG. 69, wherein a patient is being transferred away from the bed on which the embodiment is installed.
Figure 71:
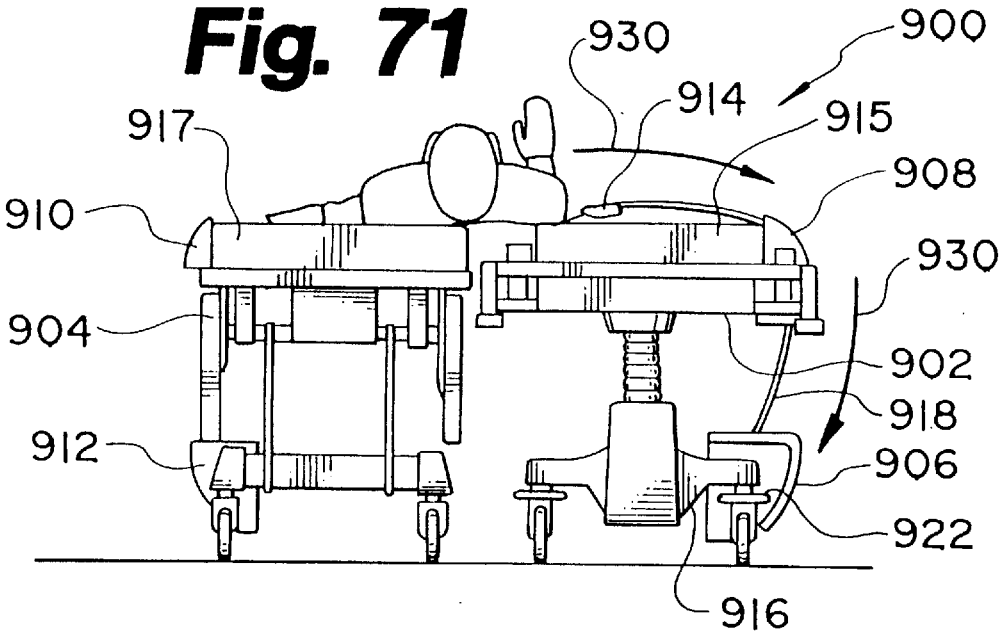
FIG. 71 is a side plan view of the embodiment of FIG. 69, wherein a patient is being transferred onto the bed or cart onto which the embodiment is installed.

Patient transfer system 900, as depicted in FIGS. 69–71, broadly includes bed 902, cart 904, motor-winch unit 906, perpendicular transfer units 908, 910, 912, clamp 914 and a plurality of belts discussed below. Although depicted as cart 904, a bed or other horizontal surface may be used and be within the scope of the present invention. Motor-winch unit 906 is ideally attached to base 916 of bed 902. Attached to the upper frame of bed 902 is perpendicular transfer unit 908. On adjoining cart 904, another perpendicular transfer unit 910 is attached to the upper frame. Finally, another perpendicular transfer unit 912 is attached to the lower frame of cart 904. As shown in FIG. 69, a pair of belts 918 may extend generally upwardly and vertically from motor-winch unit 906 through perpendicular transfer unit 908, finally extending horizontally on mattress 915. Belts 918 are then attached to clamp 914 in any manner such as described herein. Alternately, belts 918 may proceed horizontally from motor-winch unit 906 beneath bed 902 and cart 904 through perpendicular transfer unit 912. Extending generally upwardly and vertically from perpendicular transfer until 912, belts 918 pass through perpendicular transfer unit 910, then onto mattress 917. On mattress 917, belts 918 may be attached to a clamp such as a clamp of the present invention. Ideally, motor-winch unit 906 is attached to bed 902 by means of rings extending from housing 920. These rings 922 ideally enclose an upper portion of the casters 924 on which bed 902 is mounted.

In use, bed 902 and cart 904 are aligned and are preferably secured together. If a patient is to be transferred from bed 902 onto cart 904, clamp 914 is attached to a transfer sheet upon which the patient is disposed. The belts attaching to clamp 914 have been routed under bed 902 and cart 904 then upwards, and then horizontally by means of perpendicular transfer units 910 and 912. Once motor-winch unit 906 is activated, thereby retracting belts 918, the transfer force exerted will transport the patient in the direction of arrow 926 from bed 902 onto cart 904. Once the patient has been transferred onto cart 904, motor-winch unit 906 is disengaged. Alternatively, a sensing device may be attached to perpendicular transfer unit 910. This sensing device may be either mechanical, electronic, magnetic, optical or a combination thereof in its operation and may detect the presence of the patient, the buckle, the belt portion proximate the buckle, or the clamp within a predetermined distance from perpendicular transfer unit 910. If the patient is to be transferred from cart 904 onto bed 902, belts 918 are routed through perpendicular transfer unit 908 and onto mattress 915 where they are attached to clamp 914. Clamp 914 is then securely attached to a transfer sheet upon which the patient is disposed. Motor-winch unit 906 is then activated, thereby retracting belt 918 in the direction of arrows 930 and thereby generating a transfer force upon clamp 914. The transfer force acts upon the transfer sheet upon which the patient is disposed, thereby transferring the patient from cart 904 onto bed 902 and thereby further, or additionally, gripping the transfer sheet secured within clamp 914. Again, patient proximity sensing devices may be included in perpendicular transfer unit 908 as discussed hereinabove. Perpendicular transfer units 908, 910, and 912 may include either a pulley system or a roller system onto which belts 918 are emplaced prior to a patient transfer. Clamp 914 may be any of the clamps disclosed herein. Some exemplary embodiments of motor-winch unit 906 are discussed in more detail herein.

Figure 72:
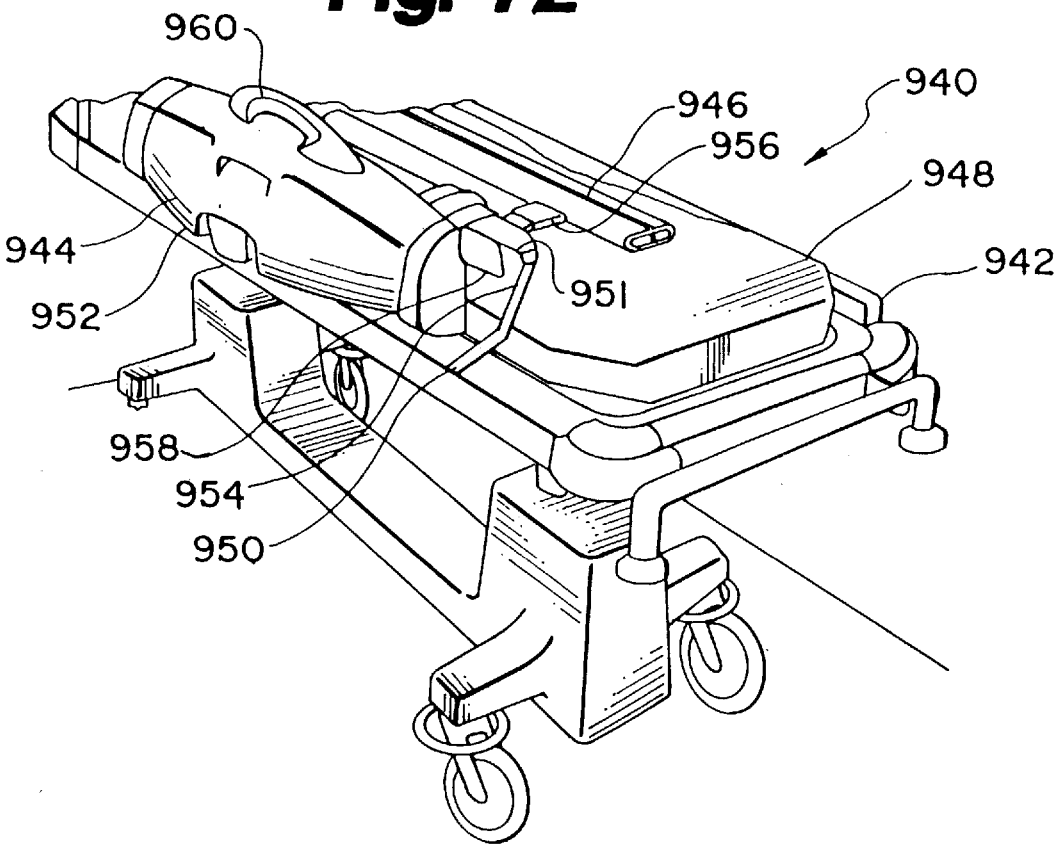
FIG. 72 is a top, side perspective view of a remote control usable for any of the embodiments described herein.
Figure 73:
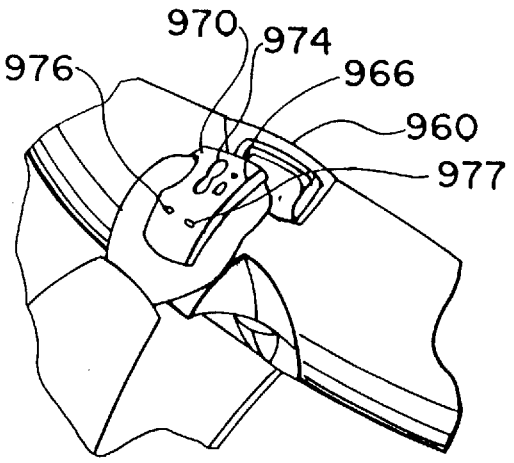
FIG. 73 is a top, side view of a remote control, which may be used for any of the embodiments described herein.
Figure 74:
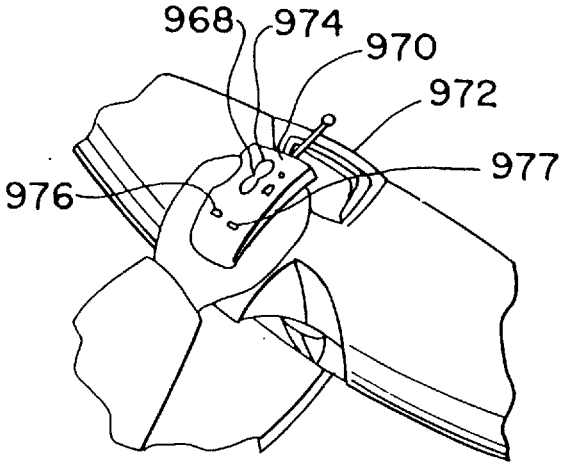
FIG. 74 is a top, side perspective view of a portable transfer device and clamp installed onto a hospital bed.
Figure 75:
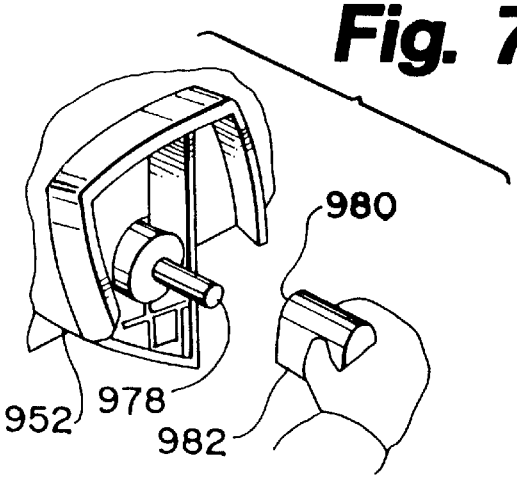
FIG. 75 is a top, side perspective view of an embodiment of the portable transfer device, wherein a spool or reel may be detachably installed onto a drive shaft.

Referring to FIGS. 72–74, patient transfer system 940 is depicted. Patient transfer system 940 broadly includes bed 942, portable transfer unit 944 and clamp 946. Bed 942 includes mattress 948 and side rail 950. Side rail 950 may include a plurality of horizontal bars 951. Portable transfer unit 944 includes housing 952, one or more belts 954, an equal number of attaching means or buckles 956 and a motor-winch unit. Further included in portable transfer unit 944 is mounting bracket 958 which will be further described below. Finally, handle 960 on portable transfer unit 944 enables an attendant to easily grasp and carry portable transfer unit 944 as desired. Housing 952 is preferably a light weight, resilient plastic or other suitable, light weight material. Portable transfer unit 944 has the advantage of being light in weight, hence readily transportable by an attendant of virtually any size and lifting ability with little likelihood of injury therefrom. Preferably, portable transfer unit 944 weighs between about 20 and 35 pounds. More preferably, portable transfer unit 944 weighs between about 15 and 25 pounds.

FIGS. 73 and 74 depict two, of many, possible embodiments (966, 968) of control units to control the operation of portable transfer unit 944. Controls 970 of control units 966, 968 serve to operate portable transfer unit 944. Control unit 966 may communicate with portable transfer unit 944 by means of electromagnetic radiation, more particularly by radio frequency, or other means. Controls 970 include on/off simultaneous transfer power control 974 and left and right transfer actuator controls 976, 977. Control unit 968 communicates with portable transfer unit 944 by means of a cord or other suitable connecting means. The cord is mechanically and electrically attached to control unit 968 and is disposed on a spool or other retaining means within portable transfer unit 944. This spool is biased so that cord 974 winds thereon when control unit 968 is released by the operator. Control units 966 and 968 are preferably housed in a recess contained within portable transfer unit 944 when not in use.

An alternative to the control unit of the patient transporting system of the current invention is via voice actuation. Voice actuation would enable the patient to effect the patient's own transfer and to halt a transfer in progress if the need to do so arose.

FIG. 66 depicts another embodiment of a portable transfer unit according to the teachings of the present invention. In this embodiment shaft 978 extends from housing 952 laterally. Exposed shaft 978 facilitates mounting of spools 980 thereon, with such spools providing means upon which belts 982 are wound. Since shaft 978 is exposed, each spool 980 may be easily and quickly detached from shaft 978, to facilitate cleaning and disinfecting of both shaft 978, spool 980 and belt 982.

Figure 93:
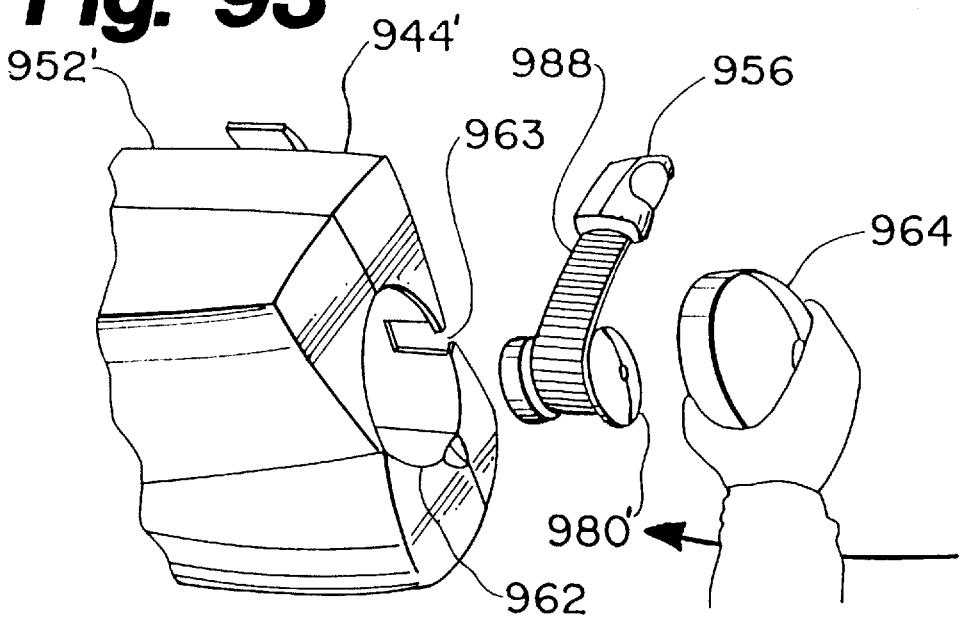
FIG. 93 is a side perspective view of a portable transfer unit.

Portable transfer unit 944' is depicted in FIG. 93. In this embodiment, a receiving cavity 962 is formed on the lateral portions of housing 952'. Within cavity 962 is a drive shaft upon which spool 980' may be reversibly mounted. Belt 988' is routed through slot 963 so that buckle 956 may be used to engage a clamp. Finally, cap 964 may be used to cover cavity 962 for various reasons.

Referring again to FIGS. 72–74, portable transfer unit 944 is secured to a side rail 950 by means such as those described below. Bed 942 is then placed beside a bed or cart onto which a patient is disposed upon a transfer sheet. The transfer sheet is then secured with clamp 946, proximate the patient, and belts 954 are extended from portable transfer unit 944 and attached to clamp 946. Either control unit 966 or 968 is detached from portable transfer unit 944 and used to actuate the motor-winch by means such as on/off controls 974. Upon actuation of the motor-winch mechanism, transfer unit 944 begins to wind belts 954 and thereby move clamp 946, the transfer sheet, and the patient. The motor-winch assembly ceases operation when the attendant operates control unit 966, 968 or when the sensing device, described above, functions.

During transfer it is desirable that the longitudinal axis of the patient be generally parallel to the longitudinal axis of the bed or cart onto which transfer is to be effected. If not, the patient may not be transferred completely onto the bed or cart and may require further manual adjustment by the attendant, possibly obviating some of the advantages of this system. Thus, left or right transfer actuator controls 976, 977 may be used. For example, left control 976 is actuated, the belt 982, attached toward the patient's head, continues to be wound and the other belt 982 either ceases to be wound or winding slows considerably. In similar manner, right control 977 is actuated, the belt 982 attached closest to the patient's feet continues to be wound and the other belt 982 either ceases to be wound or winding again decelerates.

When patient transfer is complete, much of patient transfer system 940 may be disengaged from the transfer sheet and detached from bed 942. Belts 954 may then be retracted until attached clamp 946 is proximate portable transfer unit 944. Control unit 968 (or 966) is then stowed within a niche in portable transfer unit 944. The attendant then grasps handle 960 and carries portable transfer unit 944 and attached clamp 946 to another location (FIG. 95), or stows the unit on the cart or bed awaiting subsequent use.

Figure 76:
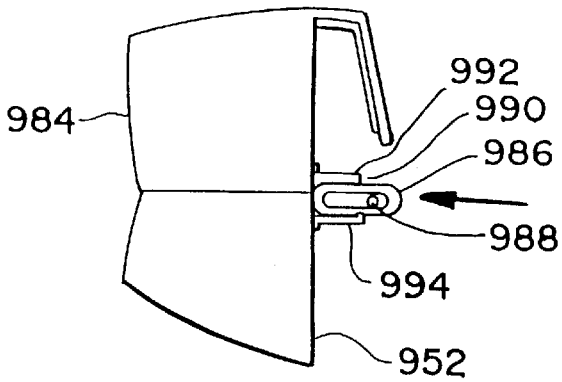
FIG. 76 is a side plan view of any of the portable transfer devices of the present invention depicting a reel for winding a retraction belt, wherein an automatic cutoff device is operationally installed.
Figure 95:
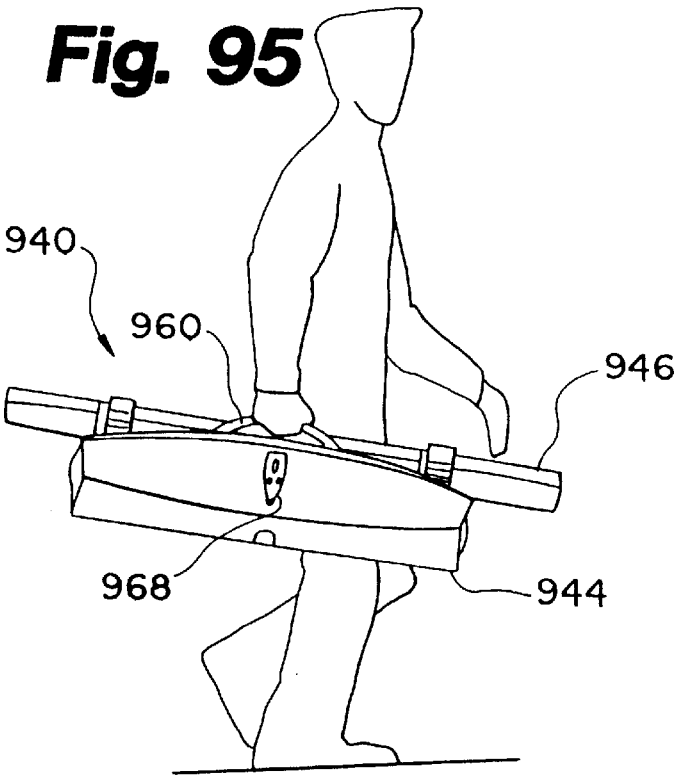
FIG. 95 depicts an attendant carrying a portable transfer unit.

Another portable transfer unit, designated as unit 984, of the present invention is depicted in FIG. 76. In this embodiment, belt 988 is bound onto spool 986. Spool 986, in turn, is detachably mounted onto bracket 990. Bracket 990 is, in turn, mounted onto the back of housing 952. Bracket 990 includes upper member 992 and lower member 994. An automatic sensing and motor disconnect may be included in this, as well as other, embodiments. A sensing mechanism detects the presence of either the patient, the clamp, or the terminus of an attached belt. Upon sensing one or more of these phenomena, portable transfer unit 984 ceases to wind belt 988, thereby stopping or easing (slowing) patient transfer.

Figure 77:
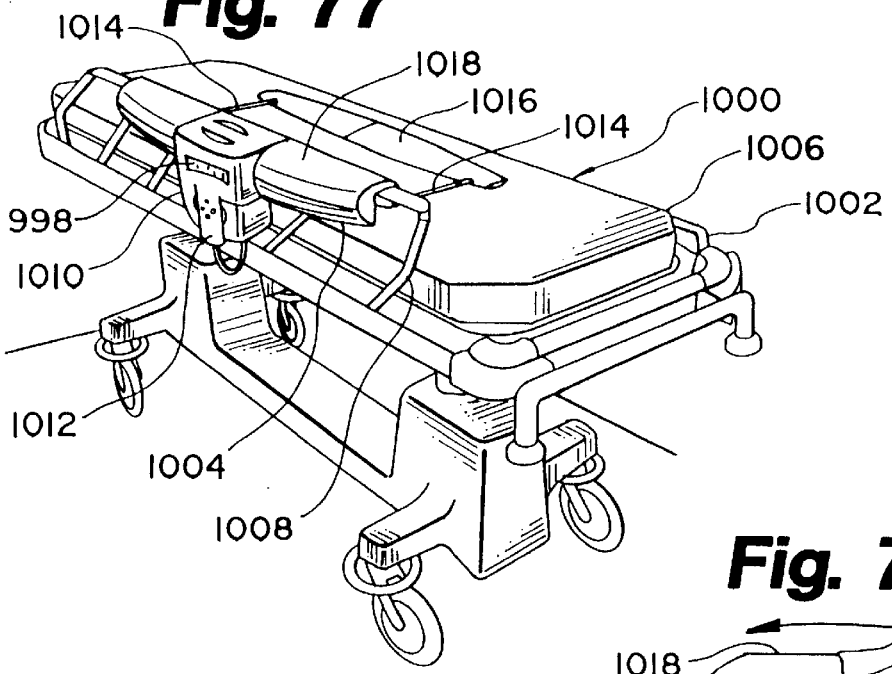
FIG. 77 is another embodiment of a portable transfer device installed onto a bed, and wherein one of the clamps of the present invention is connected thereto by means of belts.

The portable devices, as well as the other devices of the present invention, preferably also contain an automatic recording and/or display mechanism 998, representatively shown in FIG. 77. Mechanism 998 records each patient transfer event. Recording is via a print out of paper or other means, or may comprise storage or transfer of relevant information electronically. The stored information may then be transferred to a computer or other device as desired. Relevant information with regard to a transfer event may include the time of day, the patient's number and name, the attendant's name and number, and the time length of the transfer event. Other items, such as motor performance and torque received by the motor-winch assembly, speed, acceleration, alignment, or other parameters of the patient or the clamp when transferring the patient might also be recorded.

Figure 78:
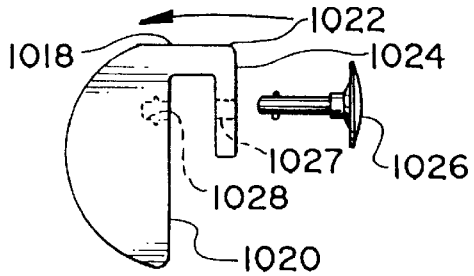
FIG. 78 is a side view of any of the portable transfer devices of the present invention, depicting a mounting bracket and quick release pin.

Referring to FIGS. 77 and 78, patient transfer system 1000 broadly includes bed 1002 and portable transfer unit 1004. Bed 1002 includes mattress 1006 and side rail 1008. Portable transfer unit 1004 includes housing 1010, control unit 1012, belts 1014 and an engaging mechanism, such as clamp 1016. Belts 1014 and clamp 1016 include any of the embodiments discussed herein. Portable transfer unit 1004 combines a housing which encloses the motor and winch assembly and which is easily and reversibly mounted onto side rail 1008. Mounting bracket 1018 may be integral to housing 1010 of portable transfer unit 1004 and readily and securely mounts onto side rail 1008. A side view of one embodiment of mounting bracket 1018 is depicted in FIG. 78. While shown as integral to the embodiment of FIG. 77, the concept depicted in FIG. 78 is applicable to any of the portable transfer units of the present invention. Mounting bracket 1018 includes lateral arm 1018, engaging side 1020 of portable transfer unit housing 1010, horizontal extension 1022 and substantially vertical member 1024.

In use, portable transfer unit 1004 is situated onto side rail 1008 such that the lower surface of horizontal extension 1022 rests on side rail 1008. Pin 1026 is then inserted in opening 1027, extending through member 1024 and into a slot or receiving orifice 1028, securely fastening therein. Mounting bracket 1018, thereby securely holds portable transfer unit 1004 onto side rail 1008 during a transfer event. Moreover, transfer unit 1004 is easily detachable from side rail 1008 by removing pin 1026.

Figure 94:
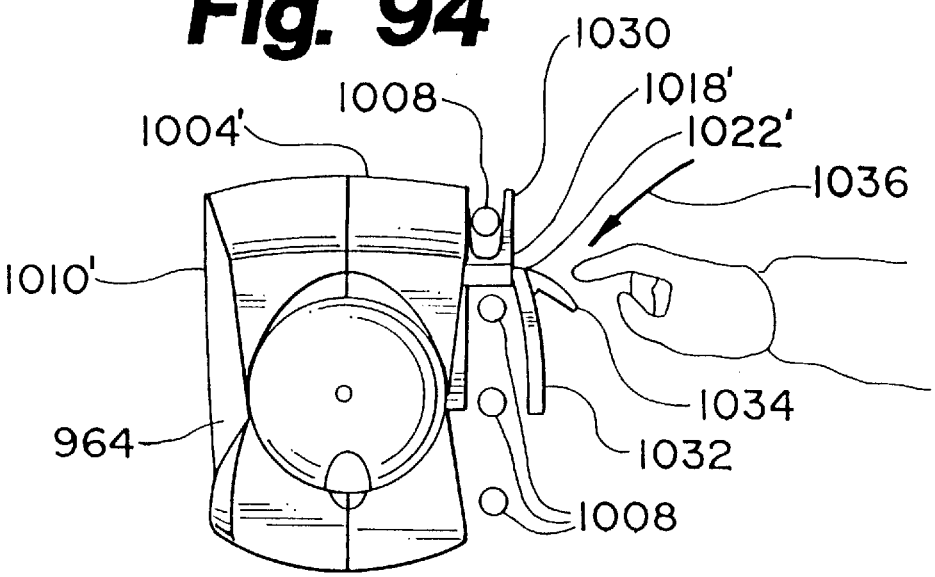
FIG. 94 is a side plan view of the portable transfer unit of FIG. 93.

An end view of another embodiment of a portable transfer unit 1004' is depicted in FIG. 94, where an alternate mounting bracket 1018' is disclosed. Mounting bracket 1018' includes horizontal extension 1022' extending integrally from housing 1010'. Extending generally vertically from horizontal extension 1022' are fixed upper vertical member 1030 and pivotally mounted, lower vertical member 1032. A locking mechanism, actuated by cam lever 1034, is included. To install portable transfer unit 1004' on a bed with side rails 1008, portable transfer unit 1004' is tilted, allowing upper vertical member 1030 to be disposed such that an upper side rail is between member 1030 and housing 1010'. Lower vertical member 1032, extended in an open position, allows portable transfer unit 1004' to be disposed in position and lower side rails 1008 to be disposed proximate housing 1010'. Lower vertical member 1032 is pivoted to a closed position, generally coaxial to that of upper vertical member 1030. Finally, cam lever 1034 is pivoted into a locked position in the direction of arrow 1036.

Figure 79:
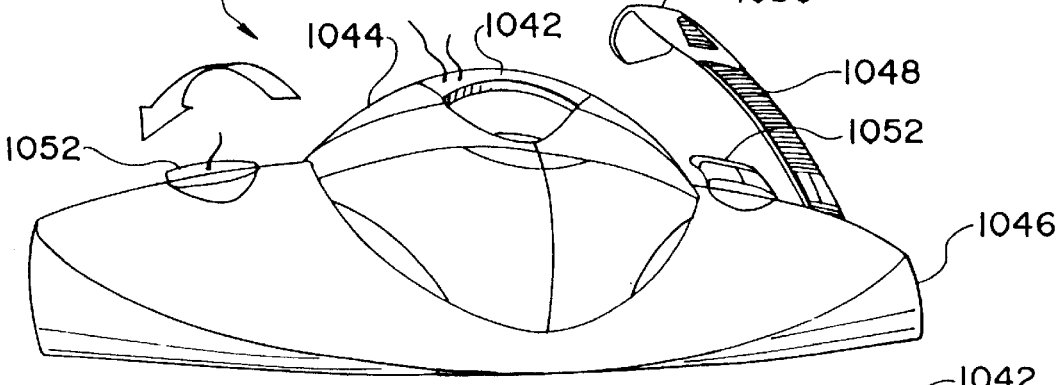
FIG. 79 is a top perspective view of another portable transfer device of the present invention.
Figure 80:
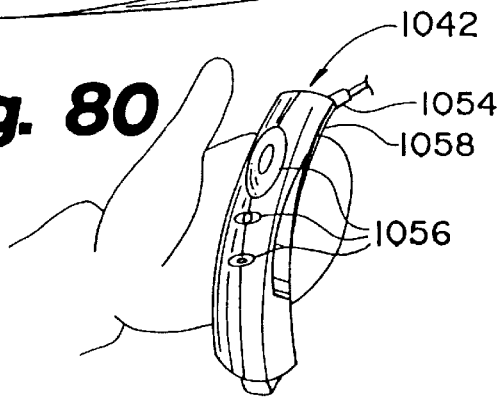
FIG. 80 is a top perspective view of a detachable remote control for any of the portable transfer devices of the present invention.

In FIGS. 79 and 80, another embodiment of a self-contained portable transfer unit 1040 of the present invention is depicted. Portable transfer unit 1040 broadly includes handle-control unit 1042, housing 1044, clamp 1046, belt 1048, hook 1050, and locking devices 1052. Portable transfer unit 1040 is self contained, containing both the belt, clamp, and enclosed motor-winch assembly. The motor-winch assembly of portable transfer unit 1040 is preferably totally enclosed within housing 1044. Belts 1048 may be extended to hook onto the framework of a bed or cart or they may be retracted to a position almost completely within housing 1044. Locking devices 1052 may be embodiments previously discussed with respect to the clamps of the present invention. Handle-control unit 1042 may be detached during a transfer event. Handle-control unit 1042 ideally includes controls 1056 disposed within housing 1058. Alternatively, handle-control unit 1042 may include the controls depicted in FIGS. 73, 74 and discussed hereinabove. Cord 1054 physically and electrically connects control unit 1042 to the remainder of portable transfer unit 1040. Ideally, cord 1054 is mounted to a pulley within housing 1044. Such a pulley-type mechanism is preferred so that cord 1054 is retracted unless pulled away by a user. Clamp 1046 ideally opens downwardly to admit a transfer sheet therein.

In use, portable transfer unit 1040 is placed onto a bed, onto which a patient to be transferred is disposed upon a sheet. As shown in FIGS. 79–84, locking devices 1052 are unlocked and the jaws of clamp 1046 are separated. A portion of the transfer sheet is placed between the jaws of clamp 1046, the jaws are then closed and locking devices 1052 locked. Belts 1048 are extended away from portable transfer unit 1040, across the bed or cart onto which the patient is to be transferred and hooks 1050 are hooked onto the bed frame. The attendant detaches handle-control unit 1042 and then begins the transfer by actuating the motor-winch assembly. When the patient has been transported onto the desired bed or cart, the attendant turns the motor-winch off. The transfer sheet is then freed from clamp 1046 and hooks 1050 are unhooked from the bed and retracted within housing 1044. Finally, handle-control unit 1042 is reconnected to portable transfer unit 1040. The attendant then may carry portable transfer unit away by grasping and holding handle-control unit 1042.

Figure 81:
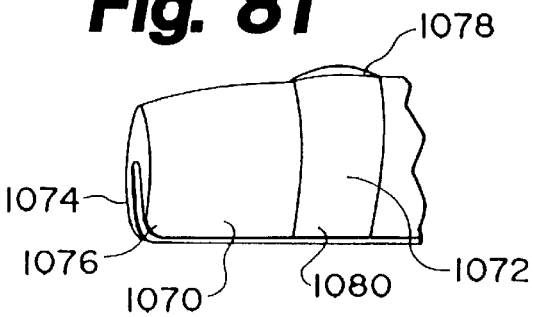
FIG. 81 is a fragmentary top perspective view of a portable transfer device of the present invention, depicting a clip for securing the jaws therein.
Figure 82:
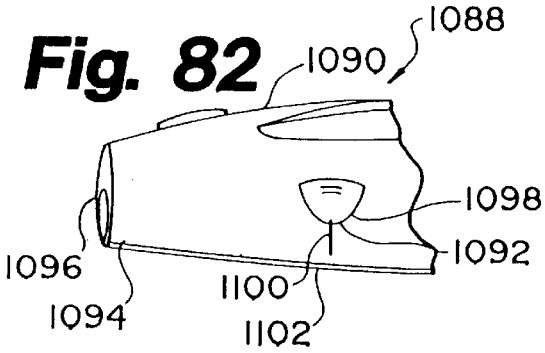
FIG. 82 is a fragmentary top perspective view of a portable transfer device of the present invention, depicting a lock-down device for securing the jaws thereto.

In FIGS. 81 and 82, several embodiments are shown for securing the clamps of the present invention. Referring to FIG. 81, clamp 1070 is secured in a closed position by the operation of clip 1072. Clamp 1070 includes lower pivoting member 1074 and upper clamp member 1076. Clamp 1072 includes free end 1078 and pivot 1080. When in an open position, free end 1078 has been pivoted away from the body of clamp 1070 and lower pivoting member 1074 is pivoted away from upper clamp member 1076. Functionally, a transfer sheet (not shown) is placed between lower pivoting member 1074 and upper clamp member 1076, which are then pressed together. Free end 1078 is then pivoted toward the body of clamp 1070, finally, being snapped around the front thereof. A locking mechanism is thereby actuated, locking lower pivoting member 1074 and upper clamp member 1076 securely together and the sheet therewithin.

Clamp assembly 1088 includes clamp 1090 and locking assembly 1092. Clamp 1090 further includes upper pivoting clamp member 1094 and lower clamp member 1096. Locking assembly 1092 includes handle 1098, which actuates the locking mechanism of clamp assembly 1088. Handle 1098 is affixed to the remainder of locking assembly 1092 via an elongated member. Handle 1098 and the elongated member are slidable within slot 1100. When clamp assembly 1088 is in an open position, upper pivoting clamp member 1094 is pivoted away from lower clamp member 1096 and handle 1098 is disposed toward rear edge 1102 of clamp 1090. In use, a transfer sheet is placed between upper pivoting clamp member 1094 and lower clamp member 1096 and they are pressed together, firmly securing the transfer sheet within. Handle 1098 is then grasped by the attendant and pushed away from rear edge 1102, thereby activating locking assembly 1092 and securing upper pivoting clamp member 1094 and lower clamp member 1096 together in a secure, closed position.

Figure 83:
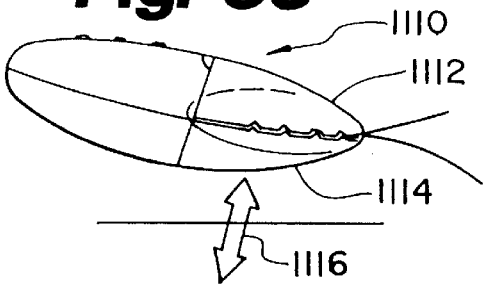
FIG. 83 is a top plan view of a portable transfer device of the present invention, depicting the downwardly opening jaw portion of the clamp thereto.

FIG. 83 is a side view of a self-contained portable transfer unit 1110. Portable transfer unit 1110 may include any of the self-contained portable transfer units described herein. Included are upper clamp member 1112 and lower pivoting clamp member 1114. When pivoted between an open and a closed position, lower pivoting clamp member 1114 may be moved in either direction as indicated by arrow 1116.

Figure 84:
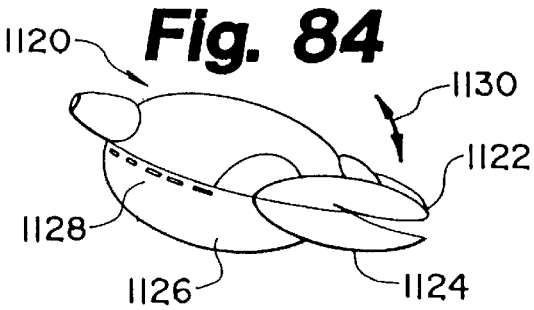
FIG. 84 is a side plan view of a portable transfer device of the present invention, depicting an upwardly opening jaw portion thereof.

FIG. 84 depicts self-contained portable transfer unit 1120. In addition to other features described for the self-contained portable transfer unit embodiments herein, transfer unit 1120 broadly includes upper pivoting clamp member 1122, lower clamp member 1124 and housing 1126. Venting 1128 is present within housing 1126. As indicated by arrow 1130 upper pivoting clamp member 1122 pivots upwardly toward an open position or downwardly toward lower clamp member 1124 when in a closed position. Venting 1128, present in housing 1126, facilitates air exchange and, consequently, enhances cooling of the motor-winch assembly within portable transfer unit 1120.

Figure 85:
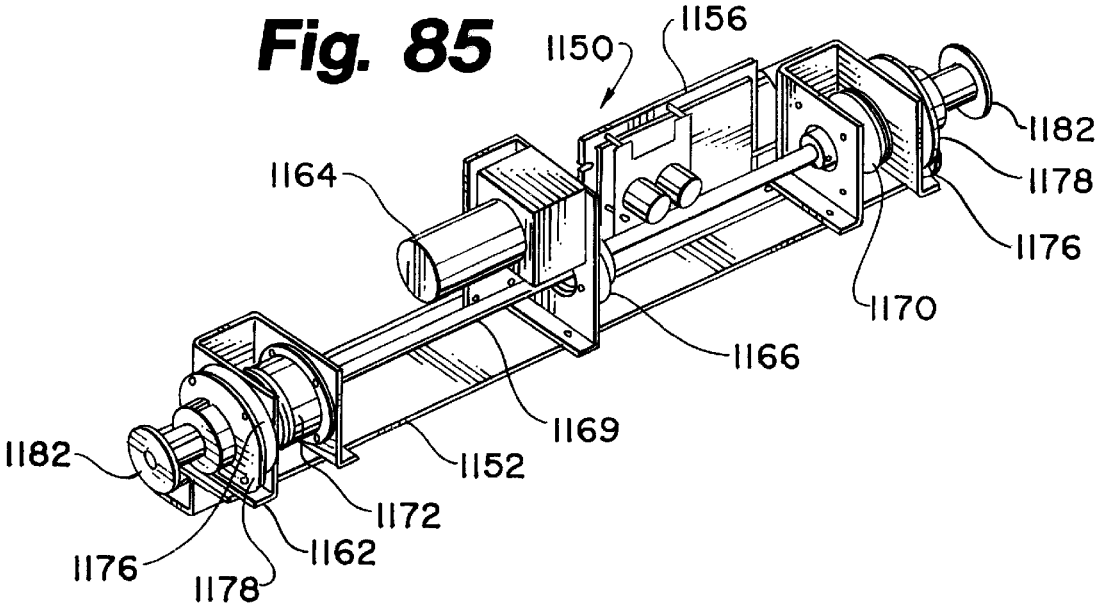
FIG. 85 is a top plan view of a motor and winch system, suitable for any of the transfer devices of the present invention.
Figure 86:
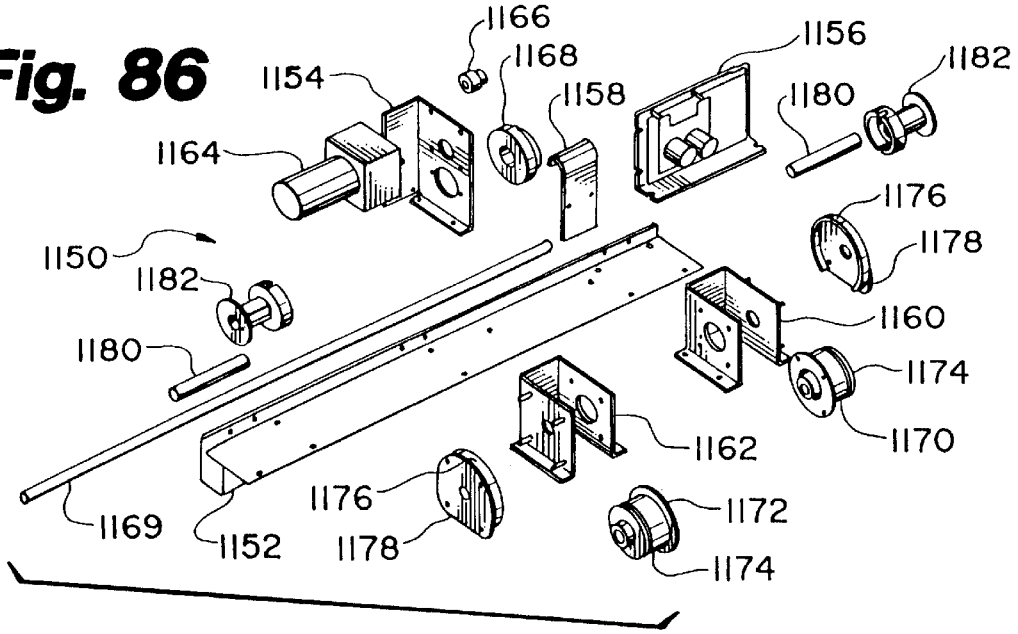
FIG. 86 is an exploded view of the motor and winch assembly of FIG. 85.
Figure 87:
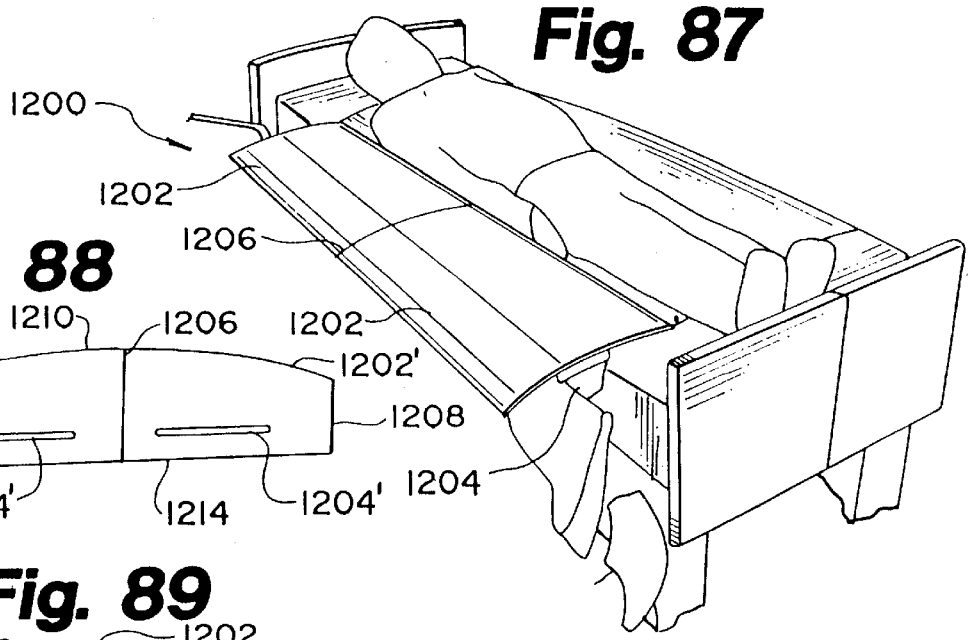
FIG. 87 is a top front perspective view of a transfer bridge spanning a gap between a bed with a patient reclining thereon and a transfer cart.

FIGS. 85 and 86 disclose one embodiment of motor-winch assembly 1150 of the present invention. Motor-winch assembly 1150 broadly includes frame 1152, upon which are mounted motor bracket 1154, control board 1156, hook 1158, right clutch bracket 1160 and left clutch bracket 1162. Motor 1164 is operationally mounted on an upper portion of motor bracket 1154. Gear 1166 (which in one embodiment is a 42-tooth gear) is attached to a shaft (not shown) extending from motor 1164. Gear 1166, in turn, operably engages gear 1168 which is mounted onto shaft 1169. Also mounted on shaft 1169 are right clutch 1170 and left clutch 1172. Right clutch 1170 is disposed within right clutch bracket 1160. Left clutch 1172 is disposed within left clutch bracket 1162. Spring 1174 is disposed about right clutch 1170 and about left clutch 1172. Spring 1174, in turn, is enclosed by spring cover 1176. Spring cover 1176 is attached to spring hub 1178. Spring hub 1178 is affixed to right clutch bracket 1160 and left clutch bracket 1162. Finally, spool 1182 may be detachably disposed on the outboard portion of shaft 1169. Motor-winch assembly 1150 is suitable for providing the necessary power to operate the transfer units described herein.

Optimized patient transfer requires smooth transition of the patient from one platform to another. One means for achieving such optimization is through use of a transfer bridge 1200, shown in FIGS. 87–90. A modified transfer bridge 1200 depicted in FIG. 87 differs from transfer bridge 1200. Transfer bridge 1200 broadly includes one or more sections 1202. A stabilizer 1204 is ideally present on the underside of each section 1202. Where multiple sections are used, such sections 1202 are joined by hinge 1206 (discussed hereinbelow), and stabilizer 1204 extends generally perpendicularly from each section. Functionally, transfer bridge 1200 is placed between a bed or cart onto which a patient is lying and another bed or cart onto which the patient is to be transferred. Stabilizer 1204 is disposed between the platforms, thereby securely holding transfer bridge 1200 in place and preventing transfer bridge 1200 from being displaced by patient contact during a transfer. After use, transfer bridge 1200 is folded along hinge 1206 for storage or transport to another location.

Figure 89:
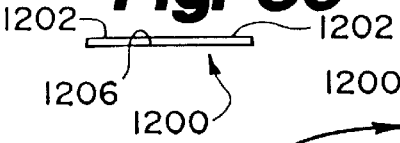
FIG. 89 is a fragmentary side view of the transfer bridge of FIG. 87 or FIG. 88, depicting the hinge thereon.
Figure 90:
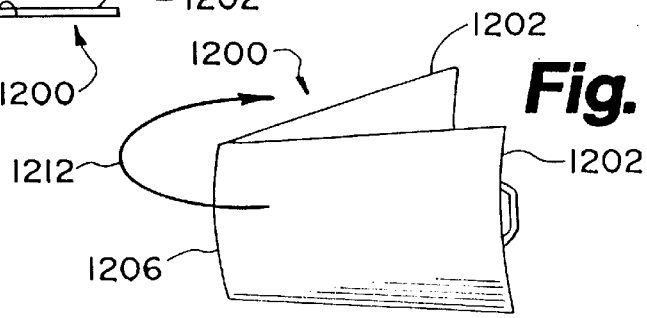
FIG. 90 is a top front perspective of the bridge of FIG. 87 being folded and prepared for either transport or storage.

One embodiment of the construction of hinge 1206 is depicted in FIG. 89. Hinge 1206 is preferably manufactured as a "living hinge", i.e. a hinge made by removing a narrow, linear portion of the material along a portion of transfer bridge 1200 or transfer bridge 1200'.

Figure 88:
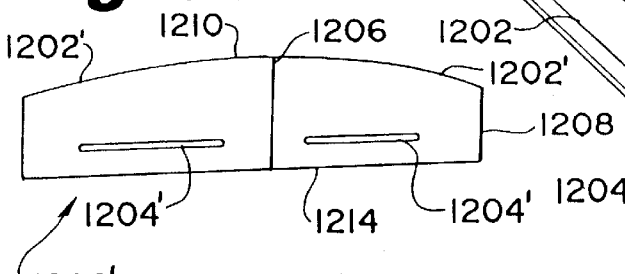
FIG. 88 is a bottom plan view of an alternate embodiment of the transfer bridge of FIG. 87.

Transfer bridge 1200', shown in FIG. 88, includes a plurality of sections 1202' and a stabilizer 1204', perpendicularly mounted on the underside of each section 1202. As in transfer bridge 1200, hinge 1206 is present and divides 1202. Leading edge 1210 is present on the portion of transfer bridge 1200' opposite stabilizers 1204'. Although not depicted, transfer bridge 1200 and 1200' may include one or more carrying handles. The carrying handles may be attachable or integral or may be cutout sections within sections 1202 or 1202'. Preparing transfer bridge 1200' for a patient transfer is essentially done in an identical manner as preparing transfer bridge 1200, the only exception being leading edge 1210 is oriented toward the patient to be transferred.

Both transfer bridge 1200 and 1200' are preferably constructed of a smooth polyethylene sheet material, which is generally about 1.5 millimeters in thickness. Alternatively, hinge 1206 may be reinforced with a thin sheet of polyethylene on the underside of transfer bridge 1200, 1200'. Stabilizer 1204' may be centered about 7.5 centimeters from edge 1214. One embodiment of transfer bridge 1200' is preferably about 31 centimeters wide at hinge 1206 and tapering to about 25 centimeters in width at each end. The cambered radius for a side section of transfer bridge 1200' is about 105 centimeters. The cambered radius for the leading edge of transfer bridge 1200' is about 225 centimeters. The side camber insures that leading edge 1210 will firmly contact the mattress on which the patient is disposed, such that transfer bridge 1200' will not be displaced during a patient transfer. The leading edge camber allows for a gradually increasing amount of contact during patient transfer, rather than immediate total contact. The gradually increasing contact also tends to allow the patient to be pulled atop transfer bridge 1200', rather than fully abutting and possibly displacing transfer bridge 1200'. Transfer bridge 1200' is most advantageously positioned when leading edge 1210 is placed under at least a portion of the patient.

In an average male patient, 90% of the patient's weight resides in the portion between the patient's buttocks and shoulders. Hence, the overall length of transfer bridge 1200 or 1200' should minimally provide support therefor. Accordingly, preferred lengths for transfer bridge 1200 or 1200' include about 65, 120 and 173 centimeters, with the most preferred length being 120 centimeters.

Figure 91:
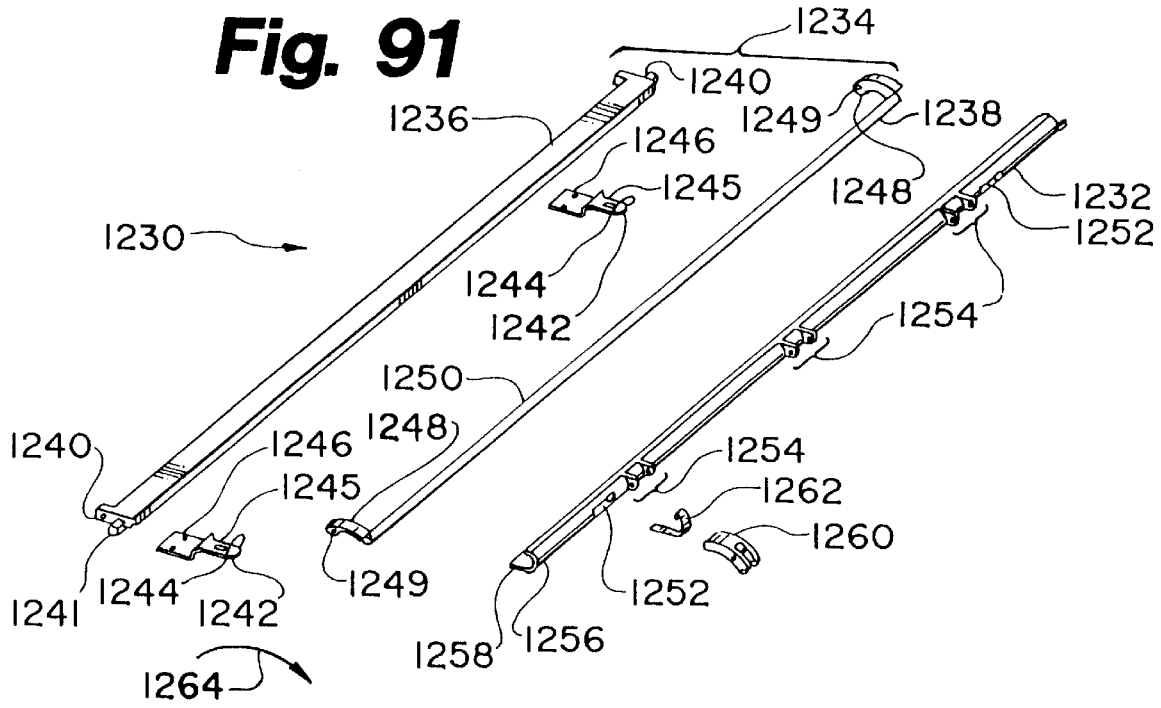
FIG. 91 is an exploded view of a clamp of the present invention.
Figure 92:
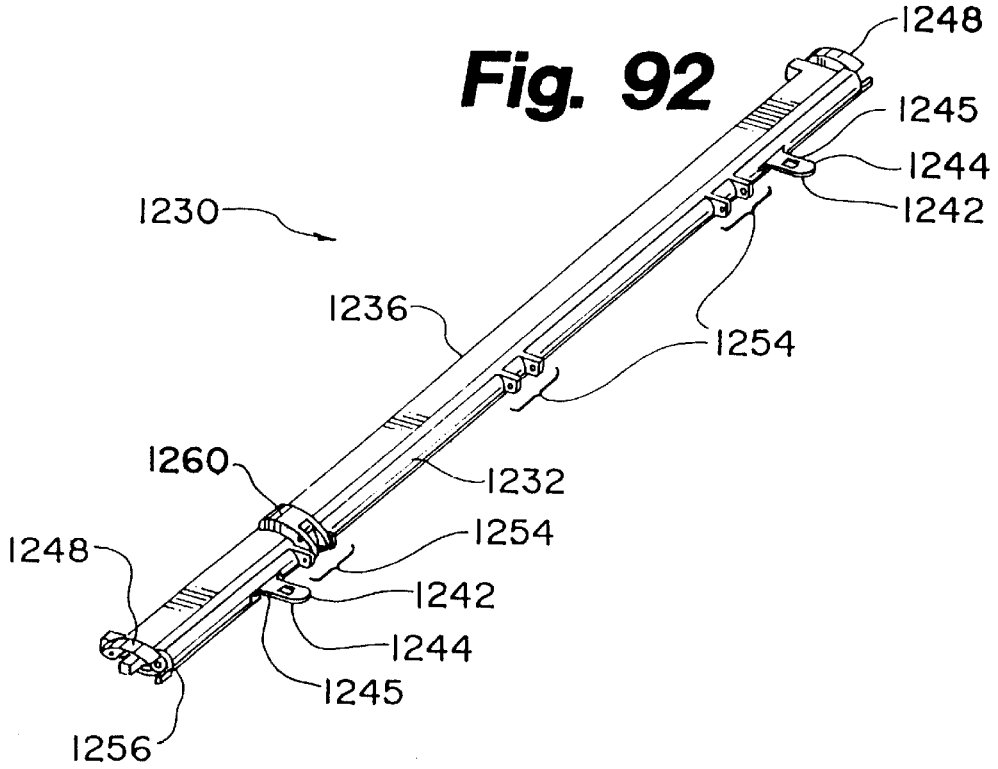
FIG. 92 is a top perspective view of the assembled clamp of FIG. 91.

Yet another embodiment of an engaging means or clamp 1230 for use with this invention is depicted in FIGS. 91 and 92. Clamp 1230 broadly includes U-channel member 1232 and pivot assembly 1234. Pivot assembly 1234, in turn, includes pivot member 1236 and pivot rod 1238. Disposed laterally on each end of pivot member 1236 is a pivot point orifice 1240 and tab 1241. Preferably and symmetrically affixed to pivot member 1236 is a plurality of belt engaging elements 1242. Each belt engaging element 1242 generally includes a tongue section 1244 and a planer member 1246.

Each tongue section 1244 defines an engaging slot 1245 disposed therein. Tongue section 1244 and planar member 1246 are joined in a stair step fashion. A pair of pivot rod brackets 1248 are laterally attached to pivot member 1236 by means of a rivet or belt. Orifice 1249 is defined by each pivot rod bracket 1248 and provides the opening through which pivot point 1240 is disposed. At least one cylindrical member 1250 is affixed to each pivot rod bracket 1248. U-channel member 1232 includes a plurality of slots 1252 and a plurality of brackets 1254. U-channel member 1232 has leading edge 1256 and inner surface 1258 which will be discussed hereinbelow. Mounted on brackets 1254 is a plurality of cam levers 1260 and springs 1262.

Operationally, a transfer sheet 1263 is wrapped about cylindrical member 1250. Cylindrical member 1250 and the enwrapped portion of the transfer sheet 1263 are then pivoted in the direction of arrow 1264 until brackets 1248 rest upon tabs 1241. Slots 1252 on U-channel member 1232 are aligned with belt engaging elements 1242. U-channel member 1232 and pivot assembly 1234 are then pressed together, thus allowing belt engaging elements 1242 to pass through slots 1252 and protrude forwardly therefrom. U-channel member 1232 and pivot assembly 1234 may be biased away from each other by means of a plurality of springs. Also another alternative embodiment of clamp 1230 employs a spring to bias cylindrical member 1250 in an open position. Cam levers 1260 are then rotated over pivot member 1246, thereby biasing pivot member 1236 against U-channel member 1232 and cylindrical member 1250 firmly against inner surface 1258. Finally, a belt buckle may be affixed to belt engaging elements 1242. Leading edge 1256 of U-channel member 1232 is preferably arcuate in conformation, thereby allowing clamp 1230 to more positively be pulled upon a transfer bridge during patient transfer, rather than abutting and displacing the transfer bridge.

Various modifications and alterations of this invention will become apparent to those skilled in the art without departing from the scope and spirit of this invention.

What is claimed is:

1. A transfer system for transferring a patient from a first platform to a second platform by a single attendant, the transfer system comprising:

a portable transfer unit, the portable transfer unit attachable to a bed or a cart, the portable transfer unit including a housing;

a plurality of brackets attached to the housing for reversibly attaching the transfer unit to the bed or cart;

a motor disposed within the housing;

a rotary motion transferal system partially disposed outside the housing and in mechanical communication with the motor;

means for winding a plurality of belts, in which a rotary motion is generated by the motor and transferred to the rotary motion transferal system, thence to the belt winding means thereon;

a retaining member assembly operatively coupled to the plurality of belts; and a contact element assembly operatively disposed proximate the retaining member assembly and cooperating with the retaining member assembly to releasably grip a transfer sheet upon which the patient is positioned so that when a transfer force is supplied by the motor to the retaining member assembly, the patient is transferred from the first platform to the second platform.

2. The transfer system of claim 1, the belt winding means comprising a plurality of detachable first spools, each first spool detachably mounted on the rotary motion transferal system outside the housing and attached to one of the plurality of belts proximate the second end thereof.

3. The transfer system of claim 1, the portable transfer unit further including a control unit in controlling communication with the motor and in which the portable transfer unit weighs less than about 30 pounds.

4. The transfer system of claim 1, further including first means for discontinuing the rotary motion and means for detecting a patient position, the first discontinuing means and the patient detecting means being configured so that when the patient detecting means detects the patient within a predetermined distance from the portable transfer unit the discontinuing means discontinues the rotary motion.

5. The transfer system of claim 1, further comprising means for optionally and automatically recording a transfer event, the recording means operatively disposed proximate the portable transfer unit.

6. The transfer system of claim 1, further comprising means for sensing asynchronous operation among the transfer mechanisms and second means for deactivating the motor, the asynchronous operation sensing means and the second motor deactivating means operatively disposed proximate the housing and in which the second deactivating means deactivates the motor when the asynchronous operation sensing means senses an asynchronous operation.

7. The transfer system of claim 1, in which the belt winding means and the motor are operable so that the transfer system transfers a patient within a patient transfer time of between about 20 seconds and 28 seconds.

8. The transfer system of claim 1, in which the rotary motion transferral system further comprises a control mechanism, the control mechanism operable at a distance from the transfer system.

9. The transfer system of claim 8, in which the control mechanism is detachable from the transfer system.

10. The transfer system of claim 1, in which the system is entirely operable by a single operator.

11. A transfer system for transferring a patient from a first platform to a second platform by a single attendant, the transfer system comprising:

patient transfer means for transferring the patient;

means for supporting the patient during a transfer on a transfer sheet;

a retaining member assembly including an elongated member generally U-shaped in cross section, the retaining member assembly being operatively coupled to the patient transfer means; and a contact element assembly including two planar sections integrally joined at a bend and pivotally affixed to the retaining member assembly, an edge of the contact element assembly being biased toward an inner surface of the retaining member assembly and operatively disposed proximate the retaining member assembly, the contact element assembly cooperating with the retaining member assembly to releasably grip the transfer sheet proximate the patient disposed upon the transfer sheet such that a transfer force is exerted by the patient transfer means and such that the retaining member assembly and the contact element assembly further grip the transfer sheet in response to the transfer force and effectively transfer the patient from the first to the second platform.

12. The transfer system of claim 11, the patient transfer means including a housing, a motor, a winch, at least one belt and a handle, the housing disposed about the elongated member, the motor and the winch disposed within the housing, the winch being in mechanical communication with the motor, the belt being affixed to the winch, and the handle being affixed to the belt.

13. The transfer system of claim 12, the patient transfer means further including a control unit disposed within the housing and in operable communication with the motor.

14. The transfer system of claim 11, the contact element assembly further including an elongated cylindrical element.

15. A transfer system for transferring a patient from a first platform to a second platform by a single attendant, the transfer system comprising:

patient transfer means for transferring the patient;

means for supporting the patient during a transfer on a transfer sheet;

a retaining member assembly including substantially rigid first and second members and a plurality of third members, the first member defining a lateral interior cavity, the second member having an extension disposable within the cavity defined by the first member, the third members being affixed to the second member and slidably engaged to the first member, the retaining member assembly being operatively coupled to the patient transfer means; and a contact element assembly including a generally cylindrical element pivotally attached to the second member and being disposable within the cavity defined by the first member, the contact element assembly being operatively disposed proximate the retaining member assembly, the contact element assembly cooperating with the retaining member assembly to releasably grip the transfer sheet proximate the patient disposed upon the transfer sheet, such that a transfer force is exerted by the patient transfer means and such that the retaining member assembly and the contact element assembly further grip the transfer sheet in response to the transfer force and effectively transfer the patient from the first to the second platform.

16. The transfer system of claim 15, the transfer means comprising a plurality of belts, each belt with a first and a second end, each of the plurality of third members attached to one of the plurality of belts and in which attaching any of the belts cooperatively places the first, second, third and cylindrical elements in a closed position.

17. The transfer system of claim 15, each of the plurality of belts further comprising an attachment mechanism affixed proximate the first end of the belt for releasably attaching the belt to one of the third members.

* * * * *